US011026509B2

(12) United States Patent
Walker

(10) Patent No.: US 11,026,509 B2
(45) Date of Patent: Jun. 8, 2021

(54) SHELVING SYSTEM

(71) Applicant: Peak Innovations Inc., Richmond (CA)

(72) Inventor: Simon Walker, Delta (CA)

(73) Assignee: Peak Innovations Inc., Richmond (CA)

( * ) Notice: Subject to any disclaimer, the term of this patent is extended or adjusted under 35 U.S.C. 154(b) by 0 days.

(21) Appl. No.: 16/468,249

(22) PCT Filed: Dec. 18, 2017

(86) PCT No.: PCT/CA2017/000271
§ 371 (c)(1),
(2) Date: Jun. 10, 2019

(87) PCT Pub. No.: WO2018/107267
PCT Pub. Date: Jun. 21, 2018

(65) Prior Publication Data

US 2019/0328134 A1 Oct. 31, 2019

Related U.S. Application Data

(60) Provisional application No. 62/549,840, filed on Aug. 24, 2017, provisional application No. 62/551,642, (Continued)

(51) Int. Cl.
*A47B 57/48* (2006.01)
*A47B 47/00* (2006.01)
(Continued)

(52) U.S. Cl.
CPC ..... *A47B 57/482* (2013.01); *A47B 47/0083* (2013.01); *A47B 96/1408* (2013.01); (Continued)

(58) Field of Classification Search
CPC ..... A47B 57/482; A47B 47/0083; A47B 96/1408; A47B 96/1416; A47B 96/1441; A47B 96/20
See application file for complete search history.

(56) References Cited

U.S. PATENT DOCUMENTS

RE24,535 E * 9/1958 Franks ..... A47B 57/402 211/191
2,895,619 A * 7/1959 Frazier ..... A47B 57/404 211/192
(Continued)

FOREIGN PATENT DOCUMENTS

CA 2737714 A1 * 10/2012 ..... A47B 57/402
DE 202012009433 U1 * 11/2012 ..... A47B 47/0083
(Continued)

*Primary Examiner* — Stanton L Krycinski
(74) *Attorney, Agent, or Firm* — Smiths IP; Lawrence Chan

(57) ABSTRACT

A shelving system comprises four corner columns, a plurality of substantially horizontal support beams, and a plurality of beam braces. Each of the support beams extends between two of the four corner columns, and each support beam is paired with a corresponding second support beam to form pairs of support beams. Each of the beam braces extends between the support beams of one of the pairs of support beams and comprises a first end portion, a second end portion, and a middle portion. The first and second end portions comprise substantially planar faces. The middle portion is between the first end portion and the second end portion and comprises first and second edges, wherein the first end portion and the second end portion extend away from the first and second edges, respectively, in opposite directions.

16 Claims, 47 Drawing Sheets

Related U.S. Application Data filed on Aug. 29, 2017, provisional application No. 62/565,987, filed on Sep. 29, 2017, provisional application No. 62/481,042, filed on Apr. 3, 2017, provisional application No. 62/435,200, filed on Dec. 16, 2016.

(51) Int. Cl.
*A47B 96/14* (2006.01)
*A47B 96/20* (2006.01)

(52) U.S. Cl.
CPC ..... *A47B 96/1416* (2013.01); *A47B 96/1441* (2013.01); *A47B 96/20* (2013.01)

(56) References Cited

U.S. PATENT DOCUMENTS 2,925,920 A * 2/1960 Skubic ..... A47B 57/402 108/107
2,950,826 A * 8/1960 Degener ..... A47B 57/402 211/191
3,042,221 A * 7/1962 Rasmussen ..... A47B 57/50 211/183
3,048,245 A * 8/1962 Shewell ..... F16B 7/22 403/190
3,142,386 A * 7/1964 Skubic ..... A47B 57/402 211/191
3,266,635 A * 8/1966 McConnell ..... A47B 57/50 211/191
3,273,720 A * 9/1966 Seiz ..... A47B 57/402 211/192
3,278,043 A 10/1966 Kimpton
3,349,924 A * 10/1967 Maurer ..... A47F 7/0042 211/41.1
3,378,976 A * 4/1968 Meredith, Jr. ..... E04B 9/122 52/506.07
3,463,325 A * 8/1969 Rogers ..... F16B 12/32 211/191
3,465,895 A * 9/1969 Miller ..... A47B 57/402 211/191
3,475,044 A * 10/1969 Konstant ..... E04G 1/12 403/217
3,584,904 A * 6/1971 Lickliter ..... E04B 9/122 403/252
3,606,027 A * 9/1971 Clements ..... A47B 57/402 211/191
3,695,456 A * 10/1972 Lewis ..... F16B 7/00 211/191
3,999,875 A * 12/1976 Simon ..... F16B 7/22 403/186
4,023,683 A * 5/1977 Vargo ..... A47B 57/402 211/192
4,067,445 A * 1/1978 Derclaye ..... A47B 57/402 211/191
4,074,812 A * 2/1978 Skubic ..... A47B 57/50 211/182
4,078,664 A * 3/1978 McConnell ..... A47B 96/00 108/159
4,101,233 A * 7/1978 McConnell ..... A47B 96/024 108/159
4,201,139 A * 5/1980 Suttles ..... A47B 57/40 108/109
4,285,436 A * 8/1981 Konstant ..... A47B 57/482 211/192
4,379,431 A * 4/1983 Clement ..... A47F 5/101 108/1
4,665,838 A * 5/1987 Minshall ..... A47B 47/021 108/157.13
4,801,026 A * 1/1989 Andersson ..... A47B 96/00 211/183
5,012,938 A * 5/1991 King ..... A47B 47/027 211/182
5,540,340 A * 7/1996 Betteley ..... A47B 96/1475 211/183
5,628,415 A * 5/1997 Mulholland ..... A47B 47/027 211/186
5,749,481 A * 5/1998 Miller ..... A47B 47/021 211/187
6,105,798 A * 8/2000 Gruber ..... B65G 1/023 211/151
6,510,955 B2 * 1/2003 Pellegrino ..... F16B 7/0446 211/192
6,520,357 B1 * 2/2003 Kautz ..... A47B 96/061 211/151
6,974,036 B2 * 12/2005 Wyatt ..... A47B 96/1408 211/189
7,614,511 B2 * 11/2009 Konstant ..... A47B 47/021 211/189
7,641,063 B2 * 1/2010 Wishart ..... A47B 47/027 211/189
8,443,992 B2 * 5/2013 Lawson ..... A47B 47/028 211/190
8,695,816 B2 * 4/2014 Troyner ..... A47B 96/14 211/191
9,027,767 B2 * 5/2015 Buckley ..... A47B 47/0083 211/134
9,215,926 B1 12/2015 Offerman
9,215,931 B1 * 12/2015 Offerman ..... A47B 96/02
9,290,322 B2 * 3/2016 Heijmink ..... A47B 57/402
9,301,610 B1 * 4/2016 Berry ..... A47B 57/34
9,375,102 B2 6/2016 Troyner et al.
9,386,855 B2 * 7/2016 Sabounjian ..... A47B 96/14
9,661,921 B1 * 5/2017 Tsai ..... A47B 47/0083
10,299,594 B2 * 5/2019 Liss ..... A47B 55/00
2004/0035812 A1 * 2/2004 Bohnacker ..... A47B 96/145 211/183
2004/0084394 A1 * 5/2004 Powell ..... A47B 57/50 211/192
2007/0199666 A1 * 8/2007 Neuwald ..... A47B 96/1408 160/135
2008/0272676 A1 * 11/2008 Eustace ..... A47B 47/0083 312/243
2009/0277854 A1 11/2009 Eustace et al.
2011/0042336 A1 * 2/2011 Cheng ..... A47B 96/02 211/153
2012/0000871 A1 * 1/2012 Troyner ..... A47B 96/02 211/134
2013/0098856 A1 4/2013 Troyner et al.
2015/0048040 A1 * 2/2015 Chang ..... A47B 96/1416 211/126.16
2015/0313357 A1 * 11/2015 David ..... A47B 57/20 211/187
2017/0280875 A1 * 10/2017 Buckley ..... A47B 47/021
2018/0066691 A1 * 3/2018 Matsumoto ..... A47B 96/1441

FOREIGN PATENT DOCUMENTS

DE 202013000557 U1 * 5/2013 ..... A47B 96/1408
EP 1618815 A2 * 1/2006 ..... A47B 47/024
GB 810693 3/1959
GB 2067887 A * 8/1981 ..... A47B 47/021
WO WO-9532346 A1 * 11/1995 ..... E04C 3/32

* cited by examiner

FIG. 90
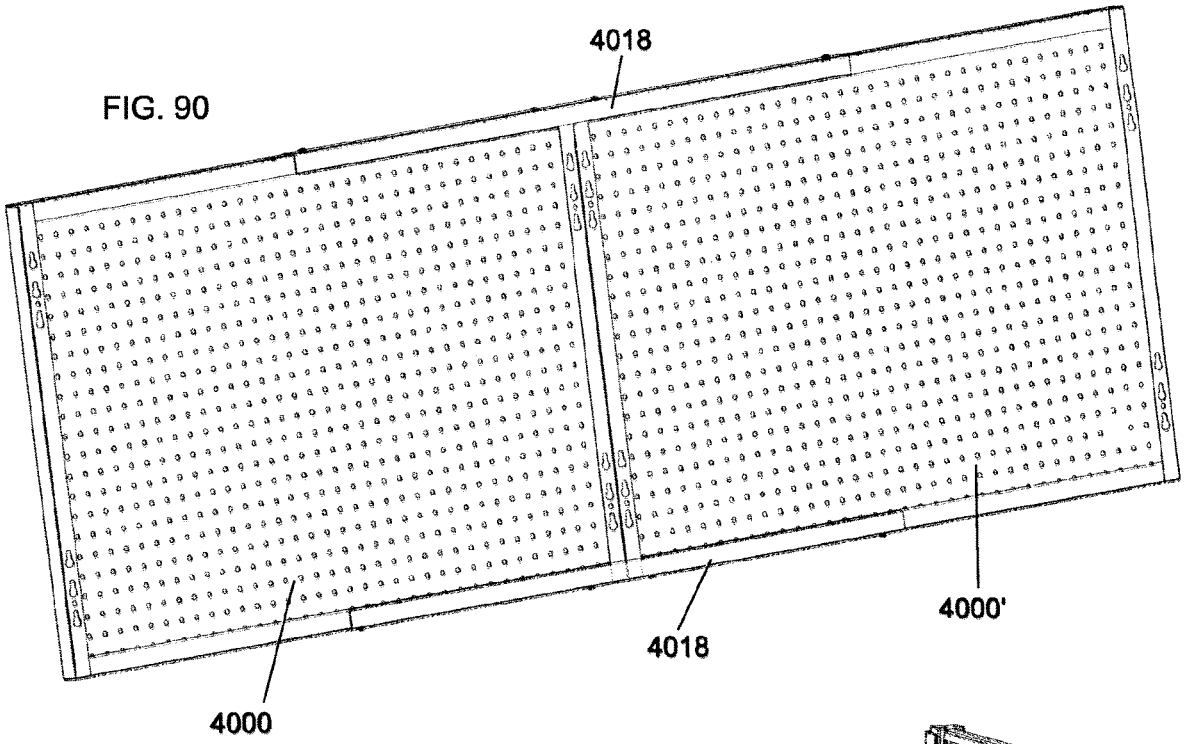
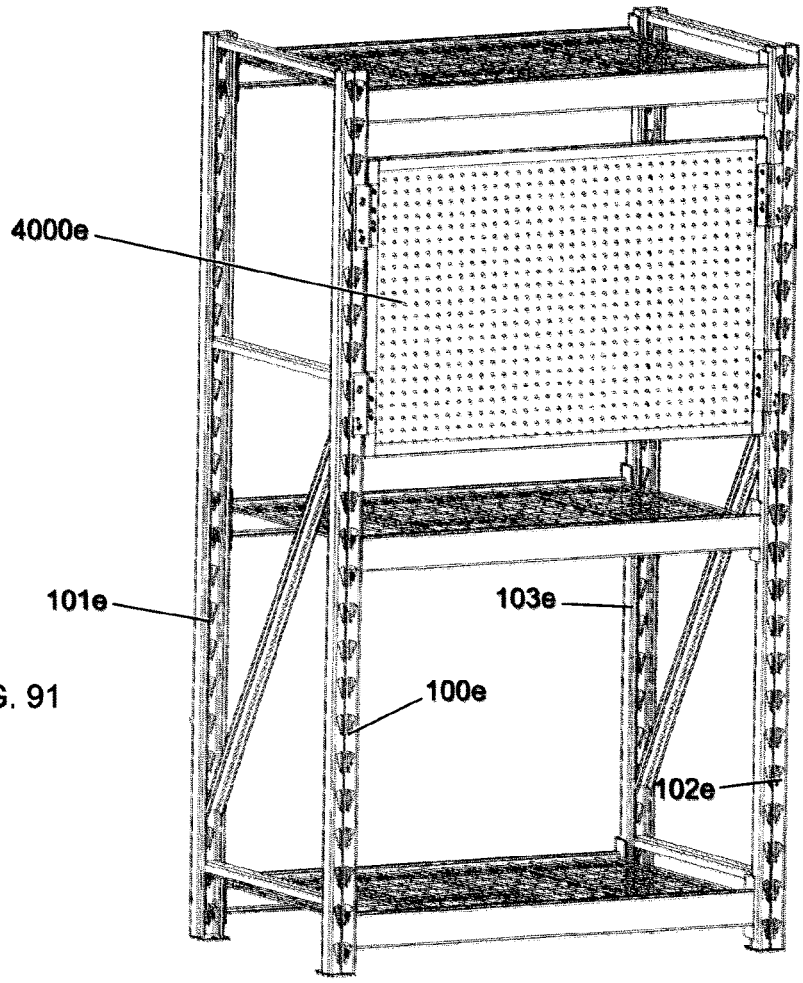
FIG. 91

SHELVING SYSTEM

FIELD OF THE INVENTION

The present invention relates to shelving and, in particular, to a shelving system.

BACKGROUND OF THE INVENTION

Many types of shelving units are known. For example, one type of freestanding shelving unit comprises four vertical corner columns, with horizontal beams supporting horizontal shelves. Additional crossbeams may be used to increase the strength or rigidity of the beams.

U.S. Pat. No. 9,375,102 to Troyner et al. discloses a typical shelving unit with four upright vertical corner support columns. Horizontal shelves are supported by front and rear horizontal beams extending between the corner support columns. C-shaped the bars extend between the front and rear beams increase the structural integrity of the shelving unit.

In such shelving units, it is desired for the shelves to withstand heavier loads by providing improved reinforcement of the beams and the columns.

In addition, it is desired for such shelving units to accommodate accessories in addition to the horizontal shelves.

SUMMARY OF THE INVENTION

In accordance with one embodiment of the invention, a shelving system comprises four corner columns comprising a plurality of slots arranged substantially vertically; a plurality of substantially horizontal support beams; and a plurality of beam braces. Each of the support beams extends between two of the four corner columns, and each support beam is paired with a corresponding second support beam to form pairs of support beams. Each support beam comprises an outer face, an upper horizontal face extending from the outer face, an inward face extending from the upper horizontal face, a shelf support ledge extending from the inward face, and a lower horizontal face extending from the outer face. The shelf support ledge comprises one or more slot openings. The lower horizontal face comprises one or more beam openings. Each of the beam braces extends between the support beams of one of the pairs of support beams and comprises a first end portion, a second end portion, and a middle portion. The first end portion comprises a substantially planar first face and tabs extending from opposing ends of the first face, the tabs sized to fit into the slot openings. The second end portion comprises a substantially planar second face with brace openings proximate to opposing ends of the second face, the brace openings aligning with the beam openings. The middle portion is between the first end portion and the second end portion and comprises first and second edges, wherein the first end portion and the second end portion extend away from the first and second edges, respectively, in opposite directions.

In another embodiment, the middle portion comprises a vertical face.

In a further embodiment, the vertical face comprises notches on opposing ends of the vertical face, proximate to the first edge.

In still a further embodiment, the middle portion comprises a vertical segment, upper and lower inclined segments extending angularly from the vertical segment, an upper portion extending from the upper inclined segment, a lower portion extending from the lower inclined segment, and notches on opposing ends of the middle portion, the notches extending at least a portion through the upper portion and the upper inclined segment.

In still another embodiment, the middle portion comprises an inclined surface, the inclined surface having an angle away from a vertical plane.

In yet another embodiment, the angle is such that the first face and the second face are substantially aligned with one another.

In yet still another embodiment, the shelving system further comprises one or more fasteners, where the beam openings and the brace openings are adapted to engage with the fasteners to secure the beam braces to the support beams.

In still a further embodiment, the shelving system further comprises a pin extending through at least one beam opening on each of the support beams, the pin also extending through a corresponding one of the brace openings on one of the beam braces to allow for pivotable movement of the beam brace with respect to the support beam.

In yet another embodiment, the pin comprises opposed ends, and a diameter of the opposed ends is greater than a diameter of the brace openings or the beam openings.

In another embodiment, a shelving system comprises first and second pairs of substantially vertical corner columns, a plurality of substantially horizontal support beams extending between one of the first pair of corner columns and one of the second pair of corner columns, and a plurality of substantially horizontal side braces extending between the first pair of corner columns or between the second pair of corner columns. Each of the corner columns comprises an outer surface and walls extending from the outer surface. The outer surface comprises first and second angled surfaces, the first and second angled surfaces comprising a plurality of slots arranged substantially vertically. Each of the support beams comprises an elongated portion comprising first and second ends, and brackets extending from the first and second ends. Each of the brackets comprises first and second members configured to snugly fit against a portion of the outer surface and the wall.

In yet another embodiment, the first member comprises a plurality of tabs configured to engage with the slots.

In a further embodiment, the first and second angled surfaces form an indentation. The walls extend from the first and second angled surfaces at an angle away from perpendicular.

In still a further embodiment, the first and second angled surfaces form an acute angle with the walls.

In still yet a further embodiment, the acute angle is approximately 78 degrees or less.

In still another embodiment, the first and second angled surfaces form a protrusion and wherein the walls extend from the first and second angled surfaces at an angle away from perpendicular.

In yet a further embodiment, the first and second angled surfaces form an obtuse angle with the walls.

In yet another embodiment, the obtuse angle is approximately 102 degrees or greater.

In a further embodiment, the obtuse angle is approximately 115 degrees or greater.

In another embodiment, a shelving system comprising four corner columns, a plurality of substantially horizontal support beams, and a plurality of beam braces. Each of the corner columns comprises a plurality of slots arranged substantially vertically. Each of the support beams extends between two of the four corner columns, and each support beam is paired with a corresponding second support beam to form pairs of support beams. Each support beam comprises an outer face, an upper horizontal face extending from the outer face, an inward face extending from the upper horizontal face, a shelf support ledge extending from the inward face, and a lower horizontal face extending from the outer face. Each of the beam braces extends between the support beams of one of the pairs of support beams and comprises a first end portion comprising a substantially planar first face, a second end portion comprising a substantially planar second face, and a middle portion between the first end portion and the second end portion. The middle portion comprises first and second edges, with the first face and the second face extending away from the first and second edges, respectively, in opposite directions. Each of the beam braces is pivotably connected with one of the support beams.

In yet another embodiment, the middle portion comprises a planar face.

In still yet another embodiment, the shelving system further comprises a plurality of fasteners, where the fasteners pivotably connect the upper horizontal face with the first end portion and the lower horizontal face with the second end portion.

In still a further embodiment, the shelf support ledge comprises one or more slot openings, where the first end portion comprises a tab extending from one end of the first face, and wherein the tab is sized to fit into the slot openings.

In still another embodiment, the lower horizontal face comprises one or more beam openings, where the second end portion comprises a knob extending from the second face, and where the knob is sized to engage with the beam openings.

In a further embodiment, a shelving system further comprises one or more shelving racks attached to two of the corner columns. Each of the shelving racks comprises a rack surface and two brackets. Each of the brackets comprises a support member adapted to support the rack surface, an attachment flange comprising one or more rack tabs adapted to engage with the slots on one of the corner columns, and an upright member extending from the attachment flange. The attachment flange and the upright member are adapted to rest against the corner column.

In another embodiment, a shelving system further comprises one or more door assemblies attached to two of the corner columns. Each of the door assemblies comprises a door panel and one or more hinge plates pivotably connected to the door panel. Each of the hinge plates comprises a first hinge member comprising one or more hinge tabs adapted to engage with the slots on one of the corner columns, and a second hinge member extending from the first hinge member. The first and second hinge members are adapted to rest against the corner column.

In still another embodiment, a shelving system further comprises one or more hook plates attached to two of the corner columns. Each of the hook plates comprises first and second plate ends and a central plate. Each of the first and second plate ends comprises a plate attachment member comprising one or more plate tabs adapted to engage with the slots on one of the corner columns, and a plate support member extending from the plate attachment member. The plate attachment member and the plate support member are adapted to rest against the corner column. The central plate comprises one or more central plate slots and extends between the first and second plate ends.

In a further embodiment, a shelving system further comprises one or more pegboard assemblies attached to one or more of the corner columns. Each of the pegboard assemblies comprises a pegboard and one or more pegboard brackets attached to the pegboard. Each of the pegboard brackets comprises a first bracket member comprising one or more bracket tabs adapted to engage with the slots on one of the corner columns, and a second bracket member extending from the first bracket member, wherein the first and second bracket members are adapted to rest against the corner column.

In another embodiment, a shelving system further comprises one or more wall ties for attaching the shelving system to a wall. The wall tie comprises a hook portion adapted to engage with one of the support beams, and an anchor portion attached to the wall. The anchor portion is removably attached to the hook portion.

In a further embodiment, a shelving system comprises first and second pairs of substantially vertical corner columns; a plurality of substantially horizontal support beams; and a plurality of substantially horizontal side braces. Each of the corner columns comprises first and second angled surfaces. The horizontal support beams extend between one of the first pair of corner columns and one of the second pair of corner columns. Each of the support beams comprises an elongated portion comprising first and second ends, and brackets extending from the first and second ends. Each of the brackets comprises a substantially planar surface configured to fit substantially flush against one of the first and second angled surfaces. The side braces extend between the first pair of corner columns or between the second pair of corner columns. The first and second angled surfaces are angled to form a substantially V-shaped cross-section. The first and second angled surfaces comprise a plurality of slots arranged substantially vertically.

In still a further embodiment, the bracket comprises a plurality of tabs configured to engage with the slots.

The foregoing was intended as a summary only and of only some of the aspects of the invention. It was not intended to define the limits or requirements of the invention. Other aspects of the invention will be appreciated by reference to the detailed description of the preferred embodiments. Moreover, this summary should be read as though the claims wee incorporated herein for completeness.

BRIEF DESCRIPTION OF THE DRAWINGS

The embodiments of the invention will be described by reference to the drawings thereof, in which:

FIG. 90 is a perspective view showing two pegboards connected together;

FIG. 91 is a front perspective view of a shelving system with another embodiment of the pegboard assembly;

DETAILED DESCRIPTION OF THE INVENTION

Figure 1:
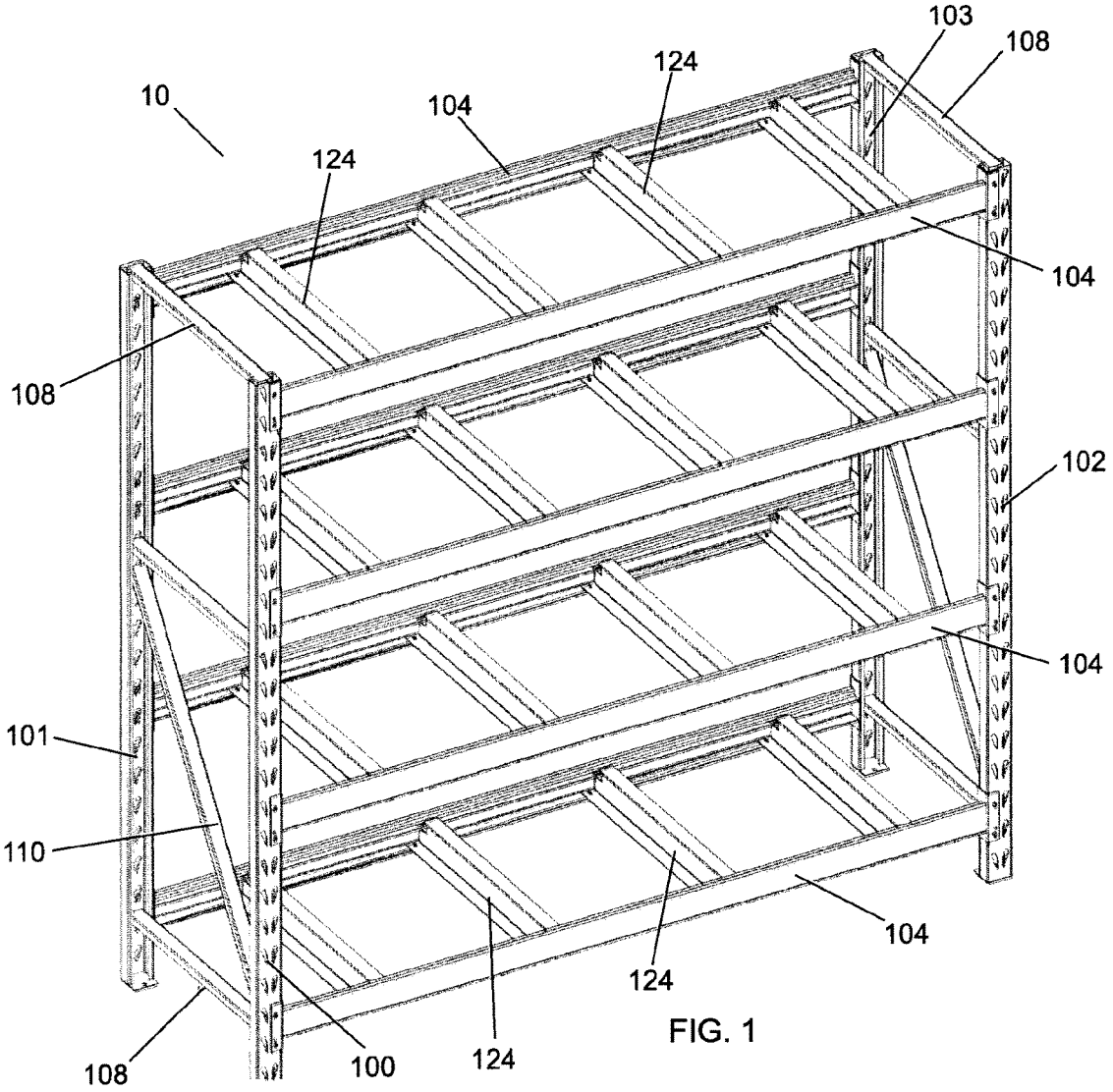
FIG. 1 is a perspective view showing an embodiment of the shelving system in accordance with the invention.
Figure 56:
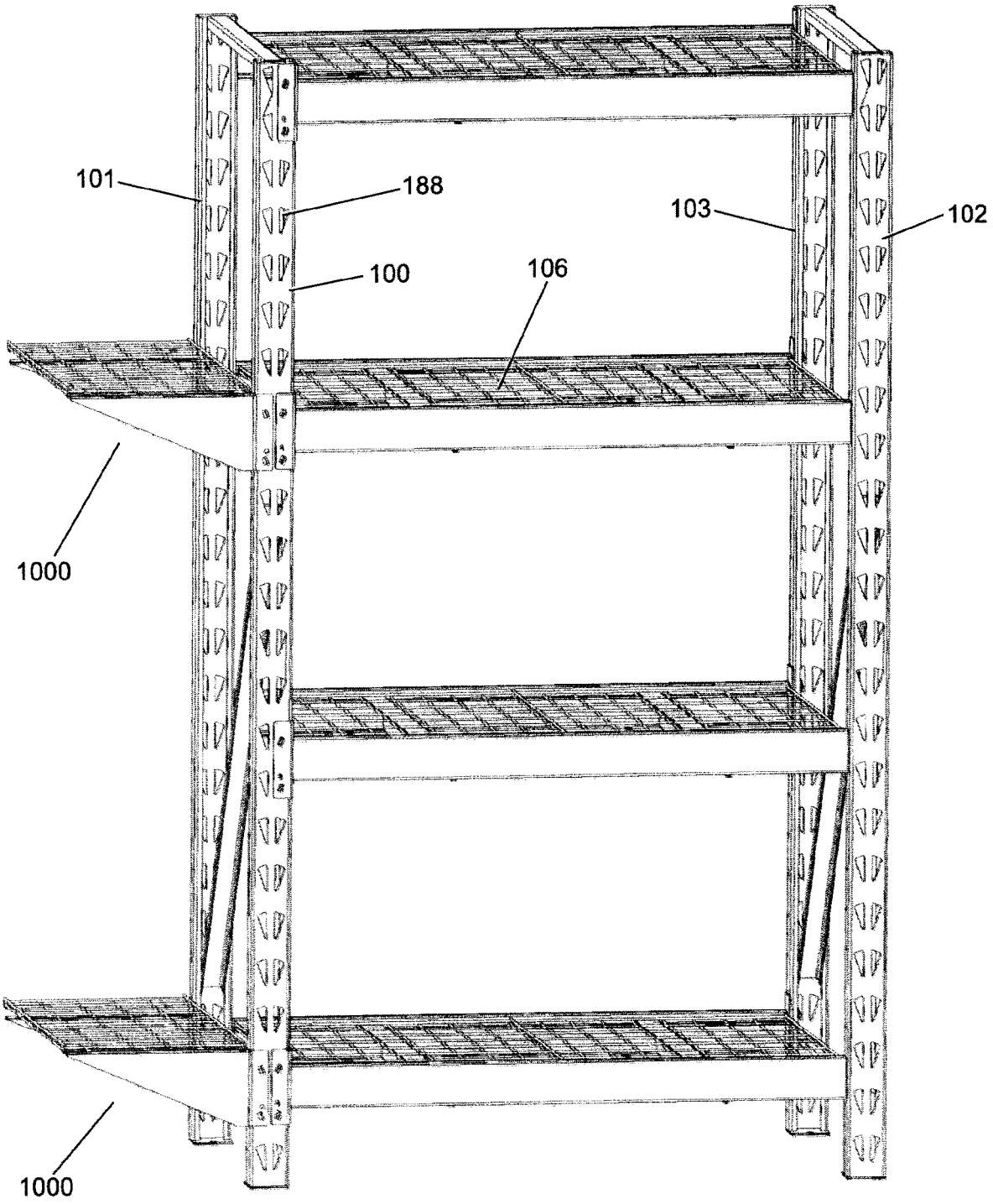
FIG. 56 is a front perspective view of a shelving system with two shelving racks.

Referring to FIG. 1, a shelving system 10 in accordance with one embodiment of the present invention comprises four substantially vertical corner columns 100, 101, 102, 103 and a plurality of substantially horizontal support beams 104 extending between the corner columns 100, 101, 102, 103. The support beams 104 are preferably arranged in pairs and can be used to support horizontally-oriented shelves 106. For example, FIG. 56 shows a version of the shelving system 10 with shelves 106 that are wire shelves. However, it is understood that other types of shelves (e.g. planar shelves) are also possible. Support beams 104 may extend between corner columns 100 and 102, and between corner columns 101 and 103. The support beams 104 in each pair of support beams 104 are preferably at the same height, although this is not necessarily required.

The corner columns 100, 101, 102, 103 are also preferably arranged in pairs, with corner columns 100 and 101 forming one pair, and corner columns 102 and 103 forming another pair. One or more substantially horizontal side braces 108 may extend between the corner columns 100 and 101, and between the corner columns 102 and 103. Furthermore, one or more inclined braces 110 may extend between the corner columns 100 and 101, and between the corner columns 102 and 103. The inclined braces 110 preferably extend at a angle (with respect to the substantially horizontal side braces 108).

Figure 2:
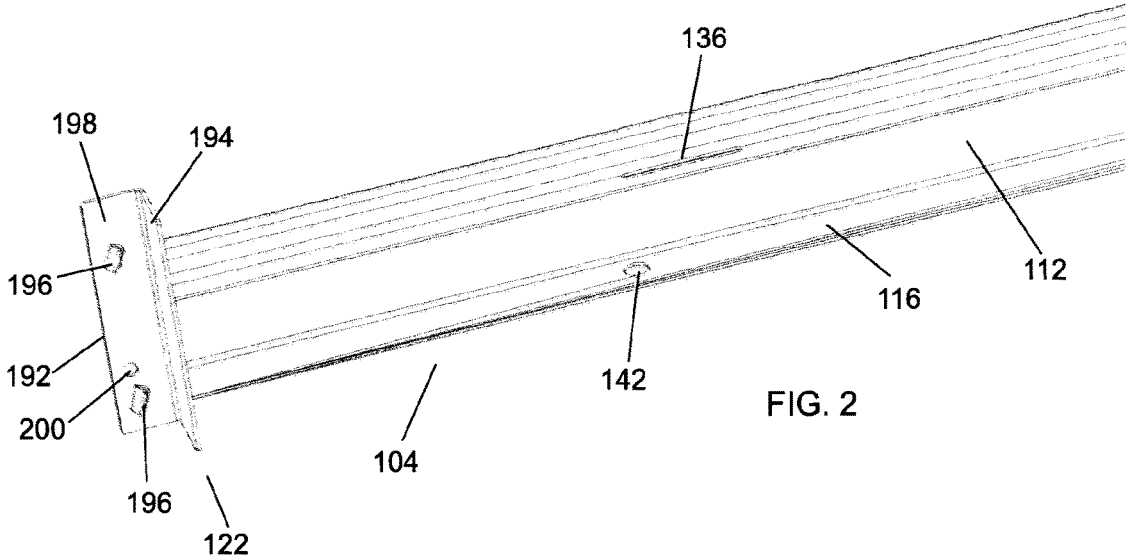
FIG. 2 is a partial perspective view of a support beam of the shelving system.
Figure 3:
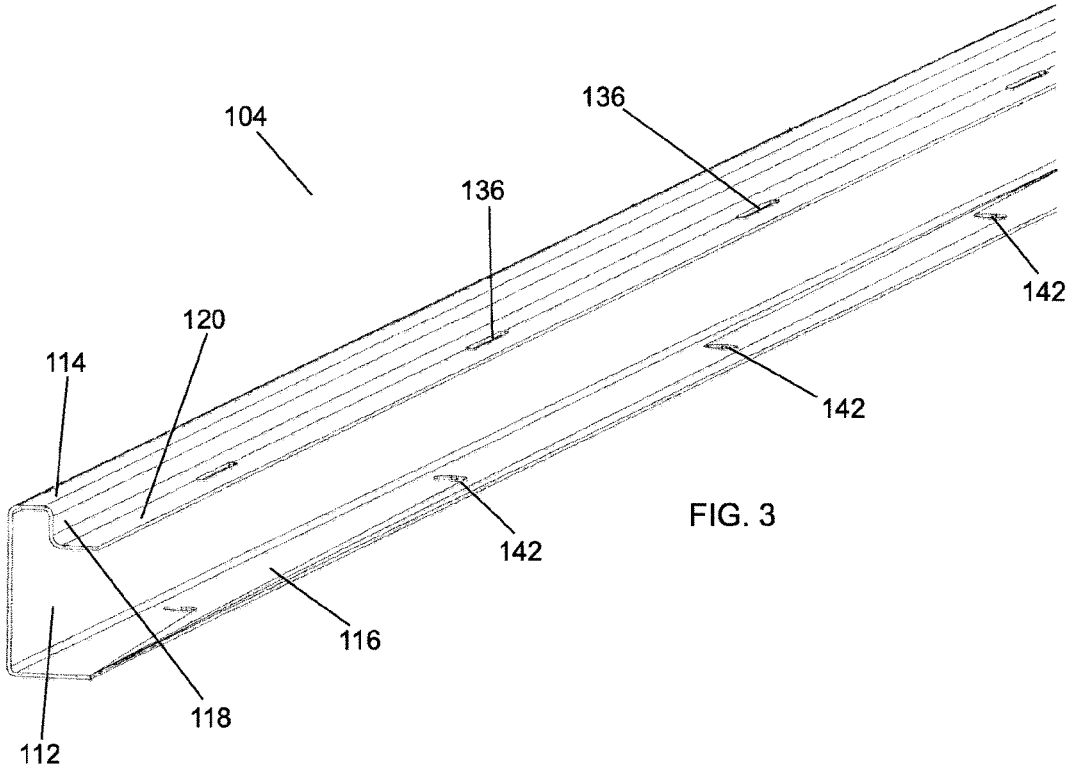
FIG. 3 is another partial perspective view of the support beam of FIG. 2.

The support beams 104 comprise an elongated member 218 that is preferably formed by bending a single sheet of material, such as metal. Referring to FIGS. 2 and 3, the elongated member 218 extend along a generally longitudinal direction. Each of the elongated member 218 comprises an outer face 112 extending between upper and lower horizontal faces 114, 116. An inward face 118 extends from the upper horizontal face 114, and a shelf support ledge 120 extends from the inward face 118. The support beams 104 in each pair of support beams 104 are preferably arranged such that the outer faces 112 of the support beams 104 are on an exterior of the shelving system 10. In other words, the shelf support ledges 120 for the support beams 104 for each pair of support beams 104 preferably extend inwardly towards an interior of the shelving system 10.

Shelf 106 is preferably supported by the shelf support ledges 120 of the support beams 104 in each pair of support beams 104. The presence of the inward faces 118 limits any lateral movement of the shelves 106.

The support beams 104 further comprise generally angled end connectors 122 on opposing ends of the elongated member 218. The end connectors 122 are configured to attach to the corner columns 100, 101, 102, 103, as described later. The end connectors 122 may be connected to the elongated member 218 by welding or some other connection means.

A number of beam braces 124 preferably extend between support beams 104. The beam braces 124 comprise first and second brace ends 172, 174 and preferably extend between the support beams 104 of a pair of support beams 104, such that the beam braces 124 extend substantially horizontally. The beam braces 124 are preferably made by bending a single sheet of material, such as metal. Referring to FIGS. 4 to 8, the beam braces 124 have a generally Z-shaped cross-section comprising a middle portion 126 extending between first and second portions 128, 130. The first portion 128 and the second portion 130 extend in generally opposite directions away from the middle portion 126, thus forming the generally Z-shaped cross-section.

The first portion 128 preferably comprises a generally planar first surface 132 with downward-facing tabs 134 extending from opposing ends of the first surface 132. The tabs 132 are sized and configured to fit into slot openings 136 formed on the support beams 104. The slot openings 136 are preferably formed on the shelf support ledge 120, proximate to its juncture with the inward face 118, as shown in FIG. 2.

Figure 4:
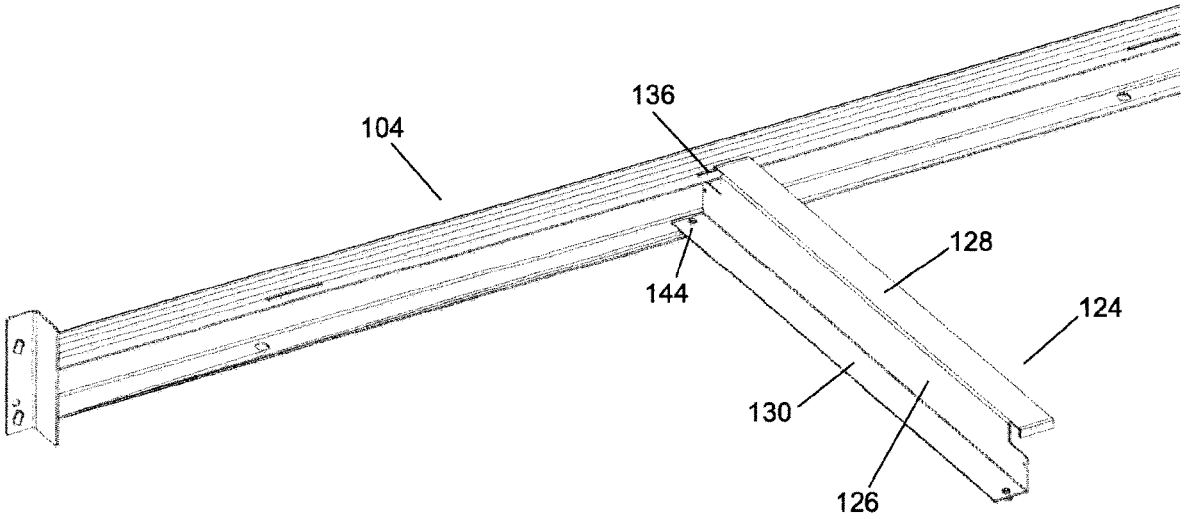
FIG. 4 is a partial perspective view of a support beam and a beam brace.
Figure 5:
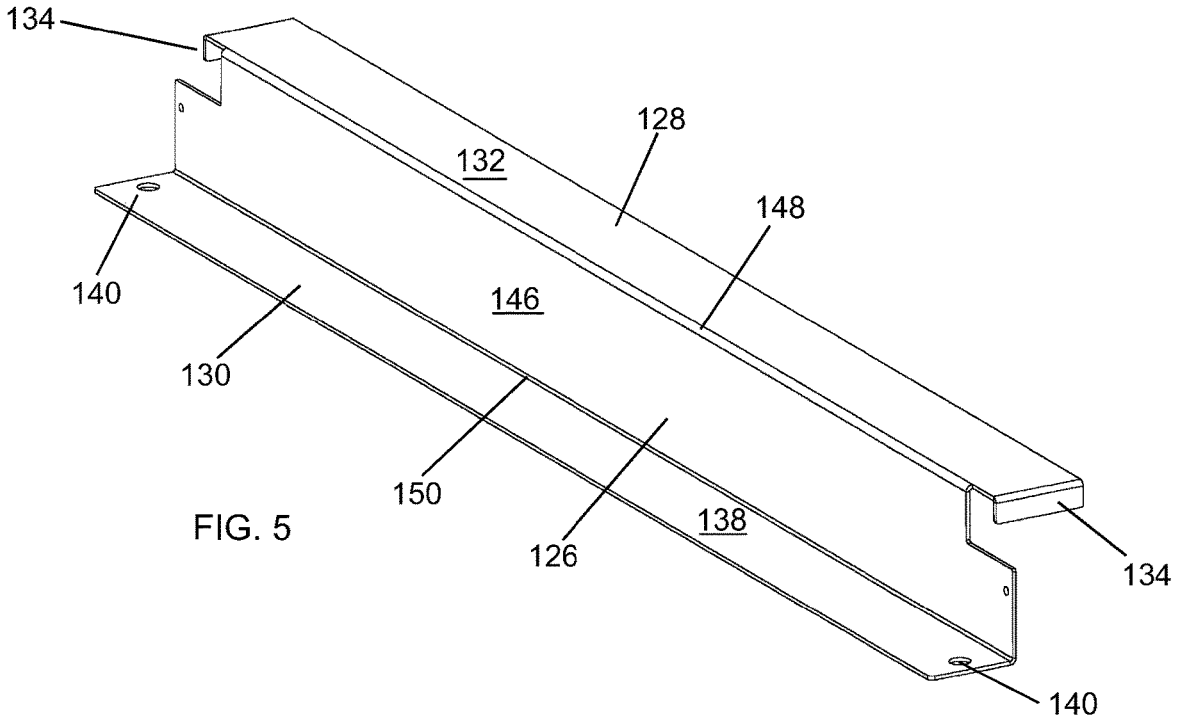
FIG. 5 is a perspective view of the beam brace of FIG. 4.
Figure 6:
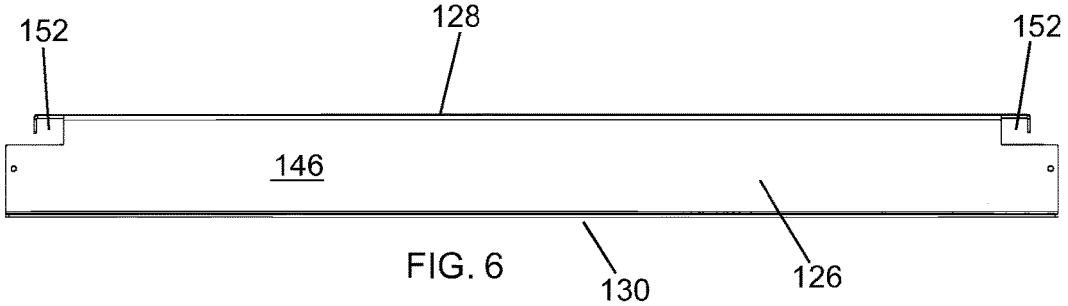
FIG. 6 is a front view of the beam brace of FIG. 5.

The second portion 130 preferably comprises a generally planar second surface 138 with a generally round brace opening 140 formed thereon proximate to the first brace end 172. The brace opening 140 generally correspond with one of the beam openings 142 formed on the lower horizontal face 116. The brace openings 140 of the beam braces 124 and the beam openings 142 are generally sized and configured to engage with brace fasteners 144 for securing the beam braces 124 to the support beams 104, as shown in FIG. 4. The brace fasteners 144 may be any suitable type of mechanical fasteners, such as nut-and-bolt fasteners, threaded fasteners, rivets, pins, etc. The number of slot openings 136 and the beam openings 142 on the support beam 104 preferably correspond to the number of beam braces 124 intended to extend from the support beam 104. For example, in the embodiment shown in FIG. 1, four beam braces 124 extend between each pair of support beams 104. Accordingly, each of the support beams 104 preferably comprises four slot openings 136 and four beam openings 142.

The second portion 130 also preferably comprises a knob 176 extending from the lower portion of the second surface 138. The knob 176 is preferably sized such that it is able engage within one of the brace openings 140.

Figure 7:
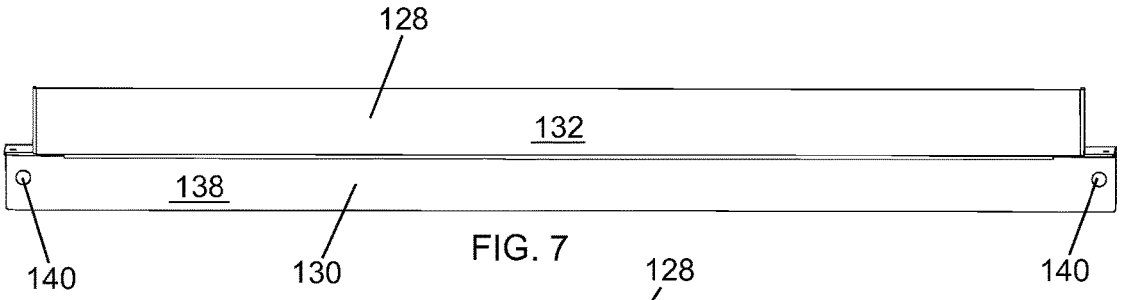
FIG. 7 is a top view of the beam brace of FIG. 5.

When the beam brace 124 is attached to the support beam 104, the first surface 132 and the second surface 138 are substantially horizontal and parallel to each other. As shown in FIG. 7, the second surface 138 is preferably slightly longer in length than the first surface 132.

In the embodiment shown in FIGS. 5 to 8, the middle portion 126 comprises a substantially planar vertical surface 146 with first and second edges 148, 150. The vertical surface 146 is substantially perpendicular to both the first surface 132 and the second surface 138. The vertical surface 146 preferably comprises notches 152 cut out from opposing ends of the vertical surface 146, proximate to the first edge 148. The presence of the notches 152 allows the opposing ends of the vertical surface 146 to fit under the shelf support ledge 120 when the beam brace 124 extends between the support beams 104, as shown in FIG. 4.

Figure 8:
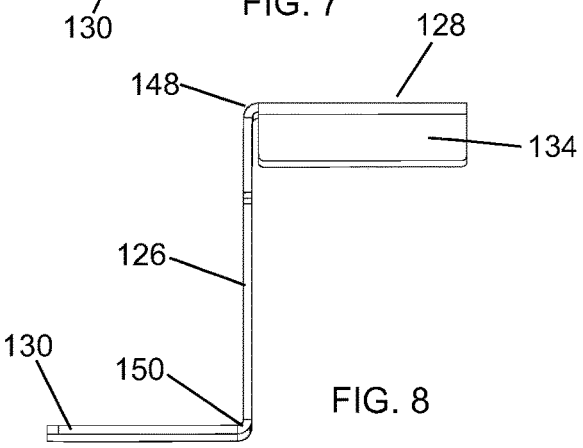
FIG. 8 is a side view of the beam brace of FIG. 5.

Because of the substantial verticality of the vertical surface 146, the first surface 132 and the second surface 138 are offset from each other, as shown in FIG. 8. In other words, the first surface 132 and the second surface 138 are both fully visible when the beam brace 124 is viewed directly from above (e.g. FIG. 7) or below.

The first portion 128 extends from the first edge 148, and the second portion 130 extends from the second edge 150. As shown in FIG. 7, the length of the second edge 150 is preferably substantially similar to the length of the second surface 138. However, because of the presence of the notches 152, the length of the first edge 148 is less than the length of the first surface 132. Preferably, the length of the first surface 132 is somewhere between the lengths of the first edge 148 and the second edge 150.

Figure 9:
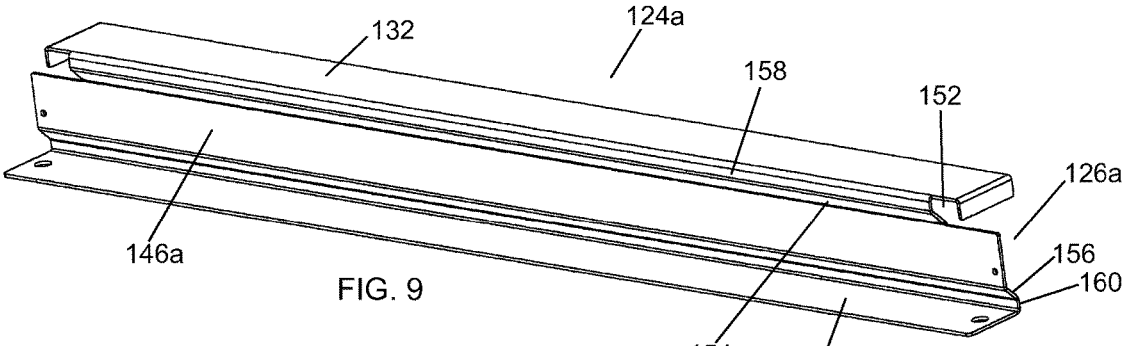
FIG. 9 is a perspective view of another embodiment of the beam brace.
Figure 10:
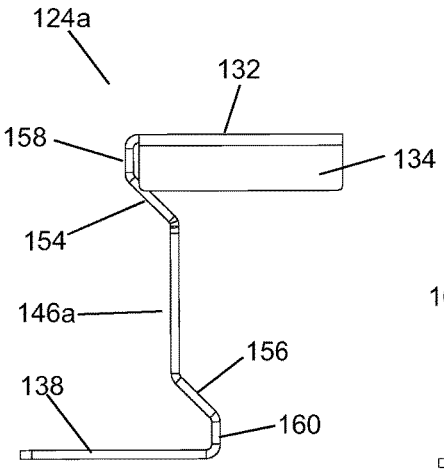
FIG. 10 is a side view of the beam brace of FIG. 9.

FIGS. 9 to 14 show alternate embodiments for the middle portion 126 of the beam brace 124. Referring to FIGS. 9 and 10, in this embodiment, the middle portion 126*a* of the beam brace 124*a* comprises vertical surface 146*a* and upper and lower inclined surfaces 154, 156. The vertical surface 146*a* extends between the upper inclined surface 154 and the lower inclined surface 156. In addition, an upper surface 158 may extend between the upper inclined surface 154 and the first surface 132, and a lower surface 160 may extend between the lower inclined surface 156 and the second surface 138. Preferably, the upper surface 158 and the lower surface 160 are substantially vertical; however, this is not always the case. In the embodiment shown in FIGS. 9 and 10, the upper inclined surface 154 and the lower inclined surface 156 are substantially parallel to each other; however, this is also not always the case. Notches 152 may only extend in the upper inclined surface 154 and the upper surface 158 (as shown in FIG. 9). Alternatively, the notches 152 may extend into the vertical surface 146*a* as well.

As shown in FIG. 10, the first surface 132 and the second surface 138 are now partially offset from each other, because of the presence of the upper and lower inclined surfaces 154, 156. In other words, the first surface 132 and the second surface 138 overlap one another when the beam brace 124*a* is viewed directly from above or below.

Figure 11:
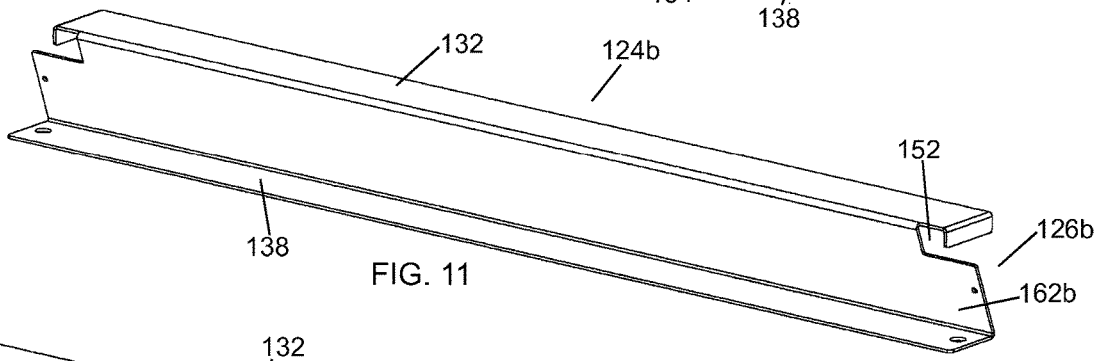
FIG. 11 is a perspective view of a further embodiment of the beam brace.
Figure 12:
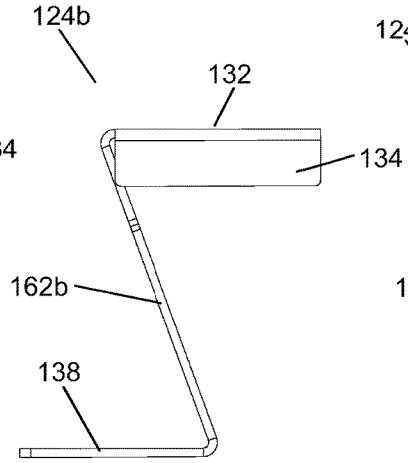
FIG. 12 is a side view of the beam brace of FIG. 11.

FIGS. 11 and 12 show another alternate embodiment for the middle portion 126*b* of the beam brace 124*b*. In this configuration, the middle portion 126*b* comprises an inclined surface 162*b* extending between the first surface 132 and the second surface 138. The inclined surface 162*b* is angled such that the first surface 132 and the second surface 138 are partially offset from each other. In other words, the first surface 132 and the second surface 138 overlap one another when the beam brace 124*b* is viewed directly from above or below. Notches 152 are formed on opposing ends of the inclined surface 162*b*, proximate to the first edge 148.

Figure 13:
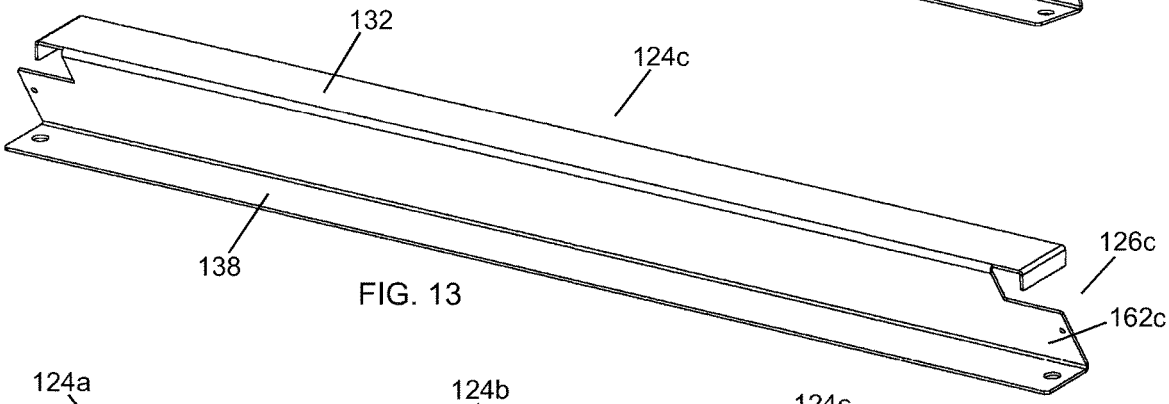
FIG. 13 is a perspective view of still a further embodiment of the beam brace.
Figure 14:
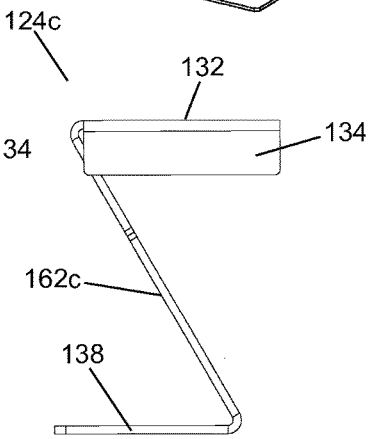
FIG. 14 is a side view of the beam brace of FIG. 13.

FIGS. 13 and 14 show yet another alternate embodiment for the middle portion 126*c* of the beam brace 124*c*. In this configuration, the middle portion 126*c* also comprises inclined surface 162*c*; however, in this configuration, the inclined surface 162*c* is at such an angle that the first surface 132 and the second surface 138 are substantially aligned. In other words, the first surface 132 and the second surface 138 lie substantially on top of one another when the beam brace 124*c* is viewed directly from above or below.

Figure 15:
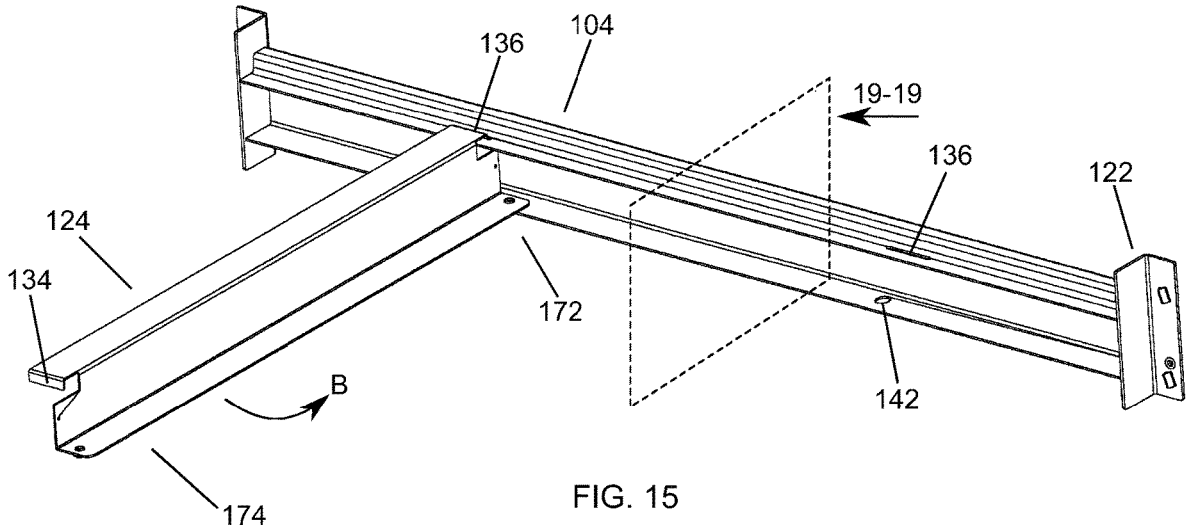
FIG. 15 is a top perspective view of a support beam and a beam brace in the open configuration.
Figure 16:
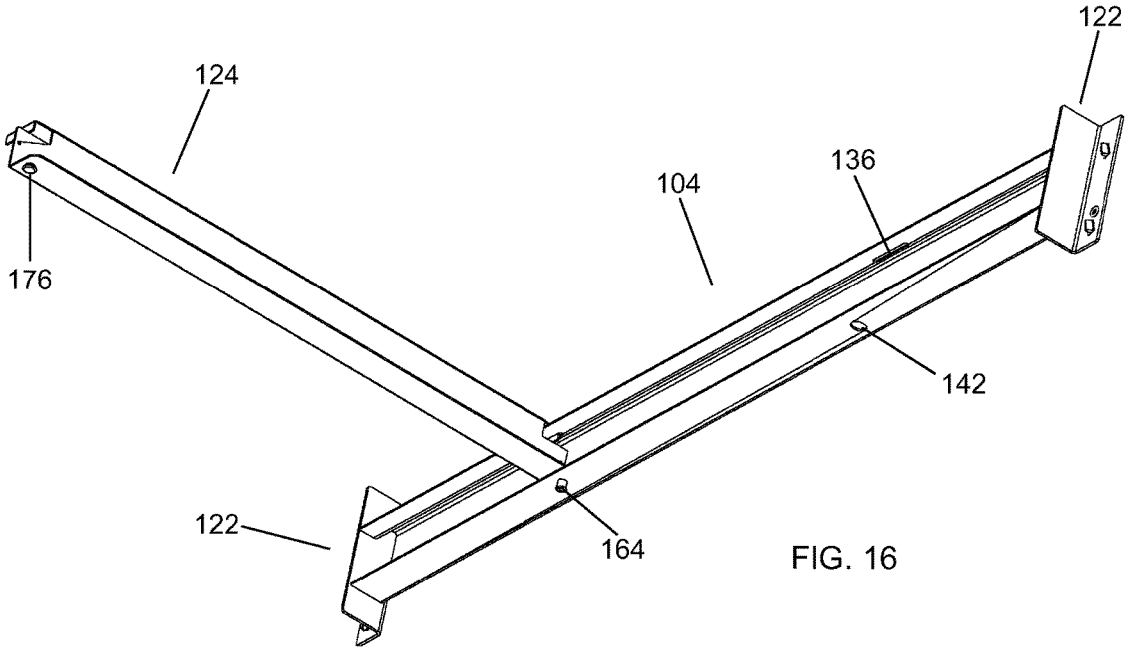
FIG. 16 is a bottom perspective view of the support beam and beam brace of FIG. 15.
Figure 17:
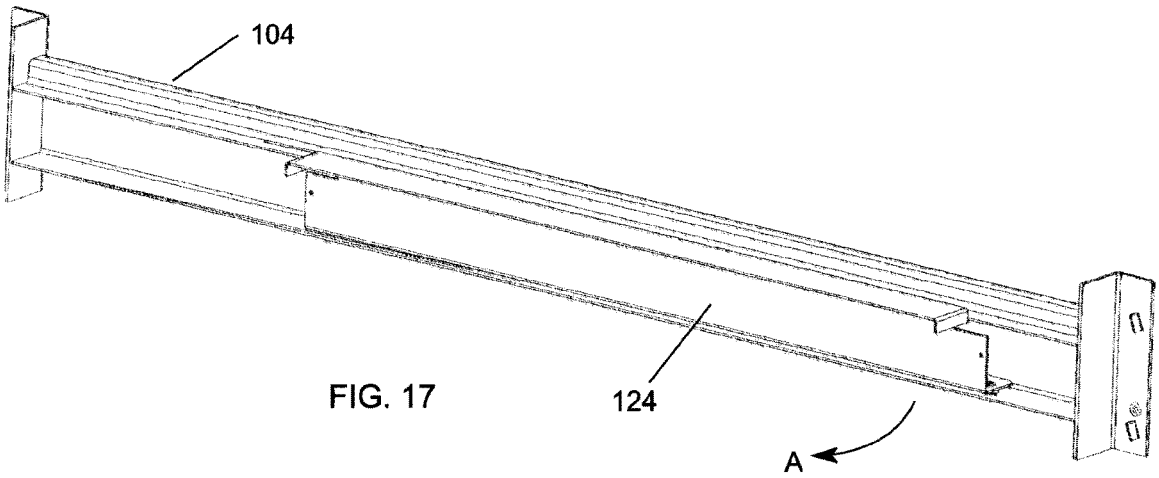
FIG. 17 is a top perspective view of a support beam and a beam brace in the closed configuration.
Figure 18:
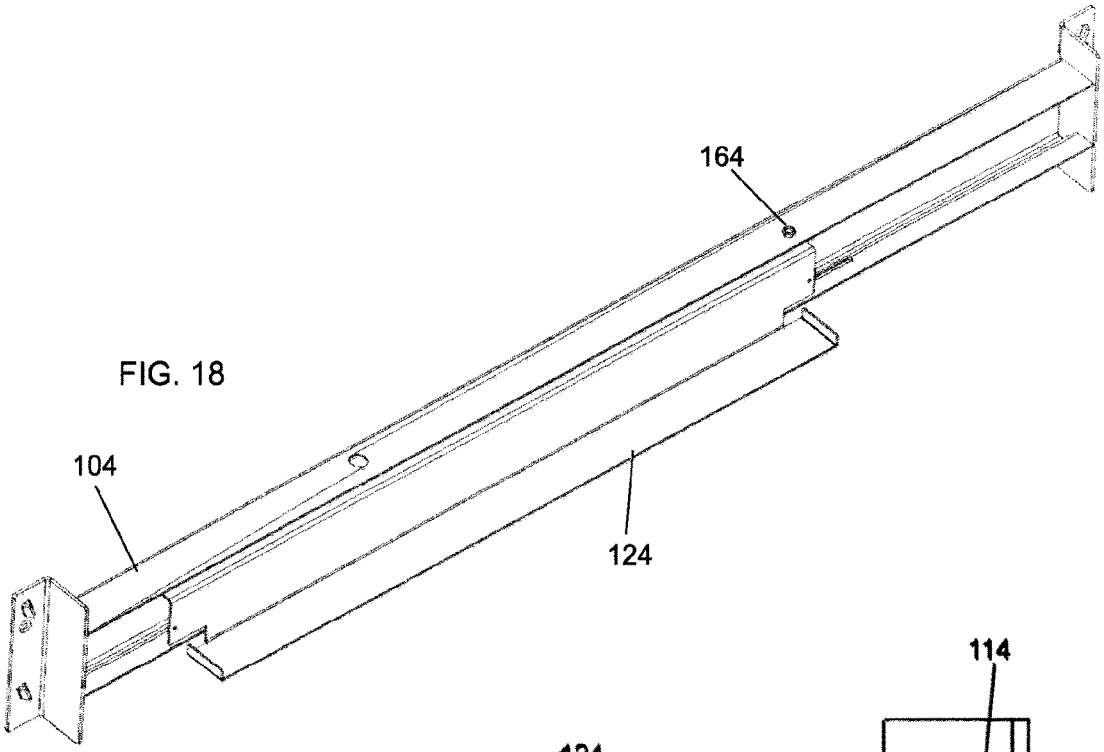
FIG. 18 is a bottom perspective view of the support beam and beam brace of FIG. 17.

FIGS. 15 to 19 show a partial view of the shelving system 10 showing support beam 104 with associated beam brace 124. The support beam 104 and the beam brace 124 may be in a closed configuration (as shown in FIGS. 17 and 18) or in an open configuration (as shown in FIGS. 15 and 16). The closed configuration may be appropriate when the shelving system is in a disassembled form, while the open configuration is appropriate when the shelving system 10 is assembled (i.e. as depicted in FIG. 1).

Figure 19:
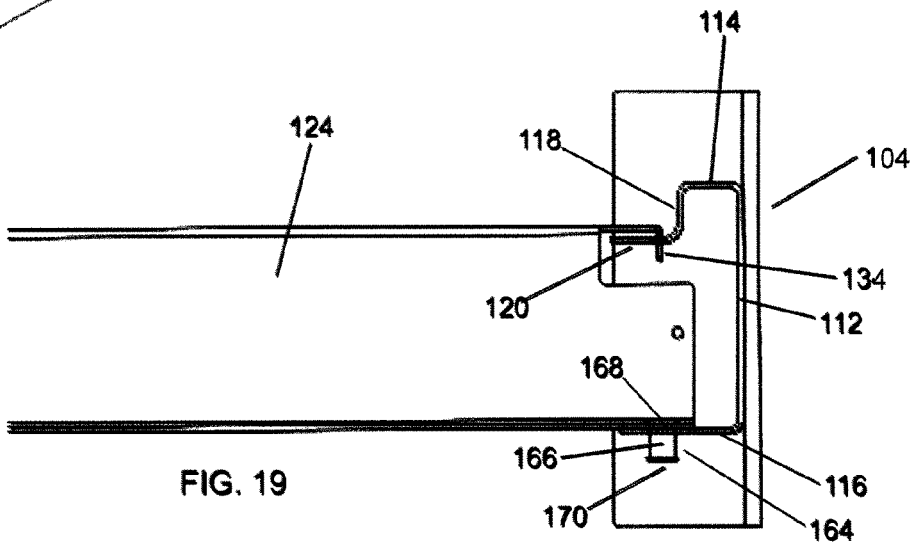
FIG. 19 is a cross-sectional view of FIG. 15 taken along plane 19-19.

Referring to FIGS. 15, 16, and 19, as described earlier, the beam brace 124 may be secured to the support beam 104 through the brace fastener 144. The brace fastener 144 may be a pin 164 that extends through one of the brace openings 140 and one of the beam openings 142. The pin 164 comprises an elongated portion 166 with opposing first and second pin ends 168, 170. Preferably, the elongated portion 166 has a diameter that is smaller than that of the brace opening 140 or the beam opening 142. In addition, preferably, the first and second pin ends 168, 170 have a diameter that is greater than that of the brace opening 140 or the beam opening 142. Accordingly, the pin 164 cannot be easily removed and ensures that the beam brace 124 is held securely to the support beam 104.

Through the pin 164, the beam brace 124 is able to pivot from the closed configuration to the open configuration, as described below.

Referring to FIGS. 17 and 18, the beam brace 124 is shown in the closed configuration with respect to the support beam 104. The pin 164 extends through one of the beam openings 142 and through the brace opening 140 that is proximate to the first brace end 172. While pivoting to the open configuration, the downward-facing tabs 134 on the first brace end 172 will come into contact with the shelf support ledge 120 of the support beam 104. The first surface 132 proximate to the first brace end 172 may then be deformed slightly (e.g. lifted upward) from its substantially planar orientation in order to allow the tab 134 to slide across the surface of the shelf support ledge 120. As the beam brace 124 continues to pivot away from the support beam 104 (in direction A, as shown in FIG. 17), the tab 134 will eventually slide across the top of slop opening 136, at which point the tab 134 will engage into and fit within the slot opening 136. The engagement of the tab 134 within the slot opening 136 causes the first surface 132 to revert back to its substantially planar orientation, thus locking the beam brace 124 in place with respect to the support beam 104 and achieving the open configuration.

In order to move the beam brace 124 from the open configuration back to the closed configuration, the tab 134 proximate to the first brace end 172 may be lifted out of the slot opening 136, resulting in a slight deformation to the first surface 132 proximate to the first brace end 172. Through the pin 164, the beam brace 124 can then be pivoted towards the support beam 104 (in direction B, as shown in FIG. 15). The tab 134 can then slide across the surface of the shelf support ledge 120 until it clears the surface, at which point the first surface 132 will revert back to its substantially planar orientation. The beam brace 124 can continue to pivot towards the support beam 104 until it is substantially collinear with the support beam 104, thus achieving the closed configuration.

Figure 20:
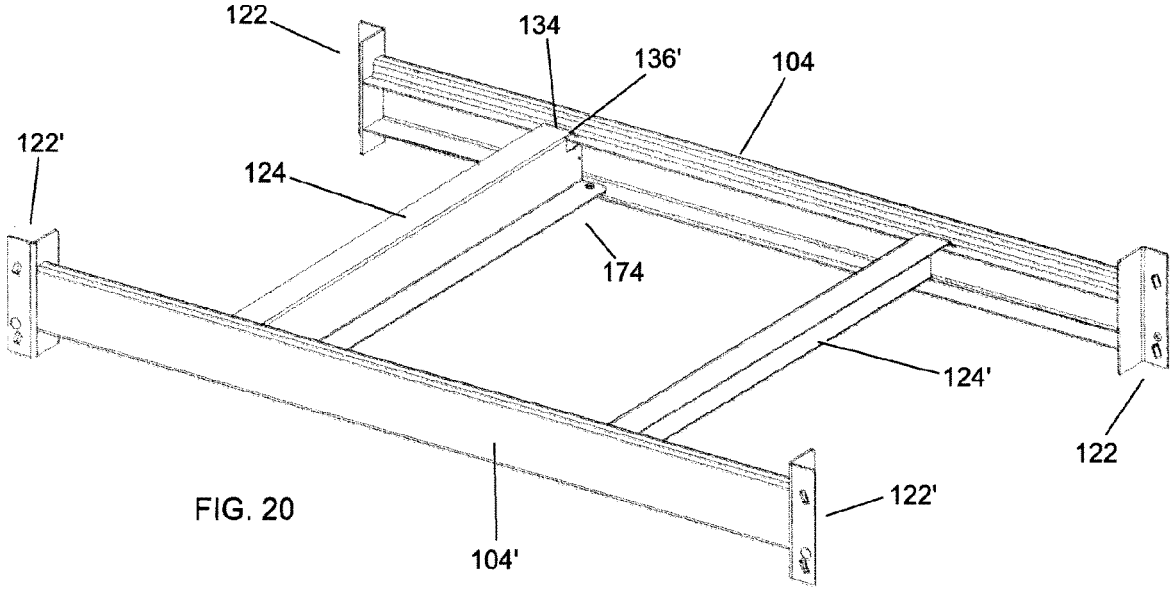
FIG. 20 is a perspective view of two support beams and two beam braces connected together.
Figure 21:
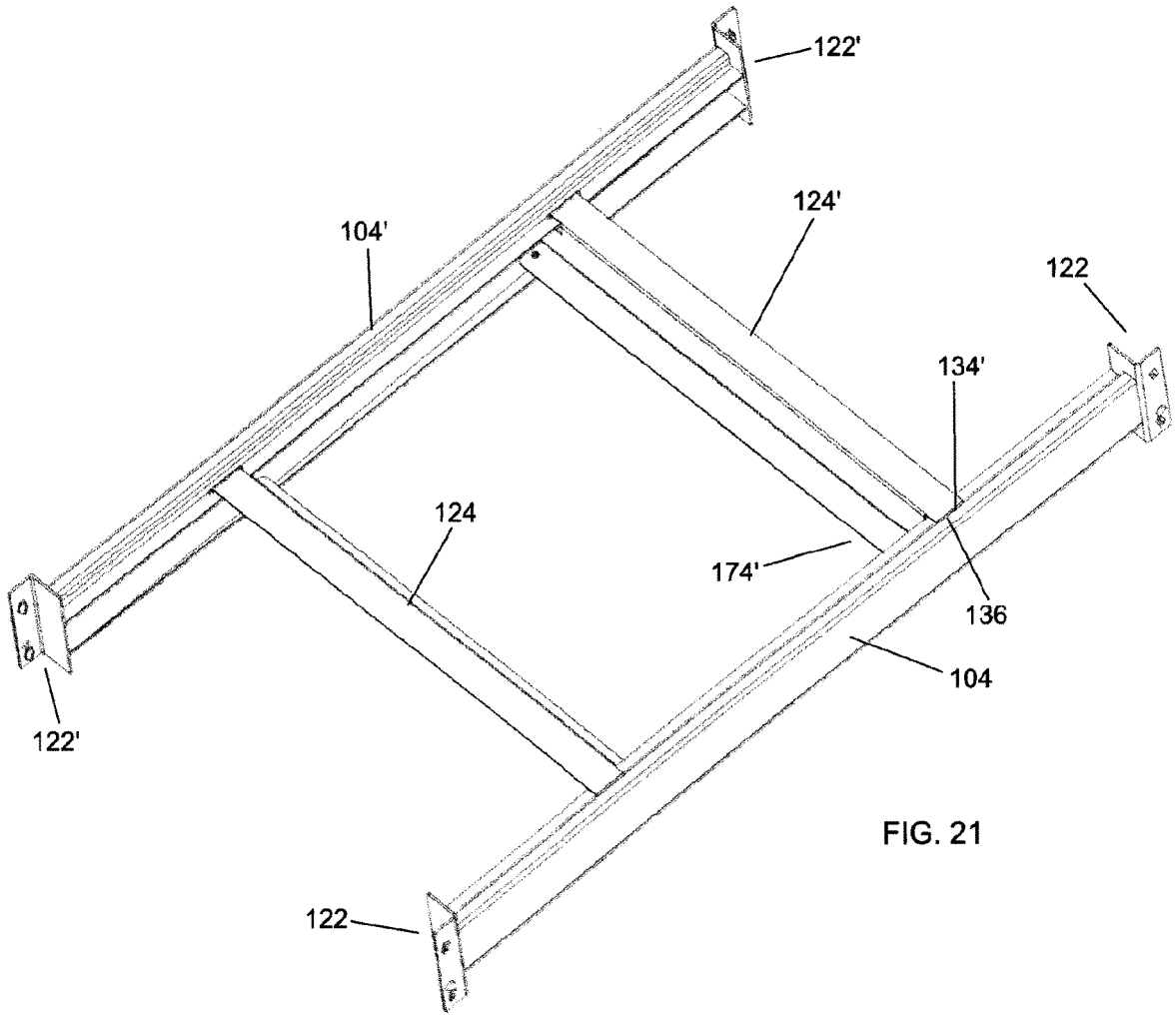
FIG. 21 is another perspective view of the two support beams and two beam braces of FIG. 20.

Referring to FIGS. 20 and 21, when assembling the shelf system 100, two support beams 104 may be connected via two or more beam braces 124 to form part of one level of the shelf system 100. FIGS. 20 and 21 depict two support beam 104, 104' connected with two beam braces 124, 124'; however, it is understood that additional beam braces 124 may also be used. The beam braces 124, 124' are first placed in the open configuration (as described above) with their respective support beams 104, 104'. The tab 134 proximate to the second brace end 174 of beam brace 124 can be inserted into one of the slot openings 136' of the support beam 104'. Similarly, the tab 134' proximate to the second brace end 174' of beam brace 124' can be inserted into one of the slot openings 136 of the support beam 104.

Preferably, the knob 176 of the beam brace 124 engages with one of the beam openings 142' on support beam 104', and the knob 176' of the beam brace 124' engages with one of the beam openings 142 on support beam 104.

In this manner, a rigid configuration comprising two support beam 104, 104' and at least two beam braces 124, 124' is formed. The end connectors 122, 122' can then be attached to the corner columns 100, 101, 102, 103 to continue the assembly of the shelf system 100.

Figure 22:
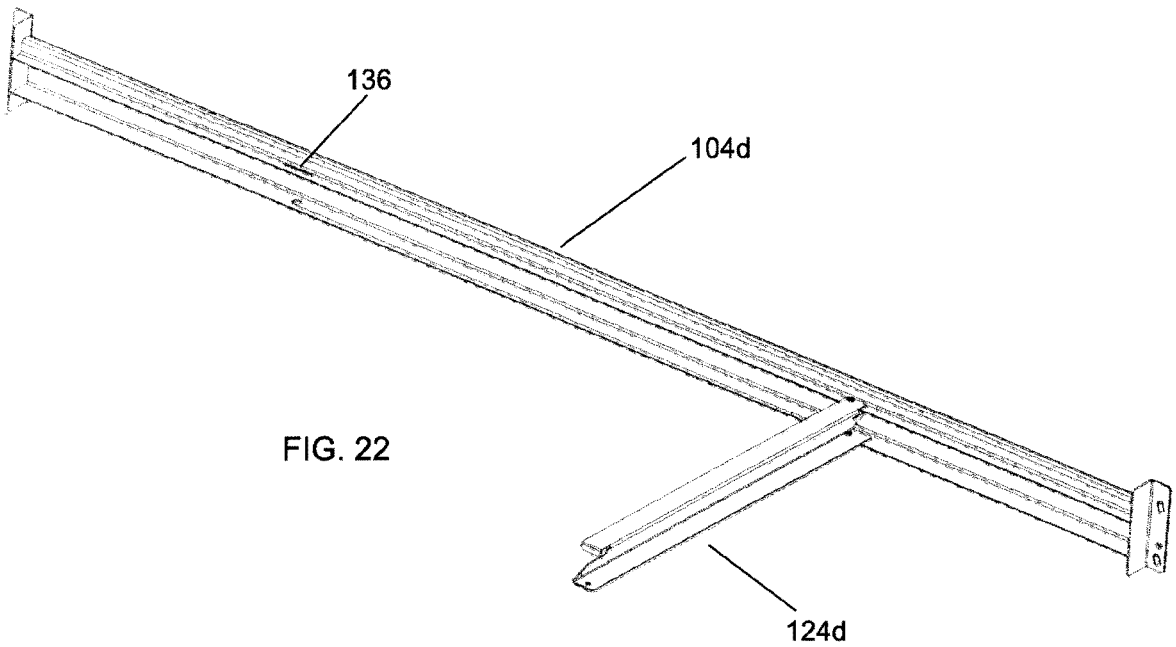
FIG. 22 is a top perspective view of another embodiment of the support beam and beam brace in the open configuration.

FIGS. 22 to 27 show another embodiment for support beam **104*d* and its associated beam brace(s) 124*d*. Although FIG. 22 shows support beam 104*d* having only one associated beam brace 124*d*, it is understood that the support beam 104*d* may have multiple beam braces 124*d***.

Figure 23:
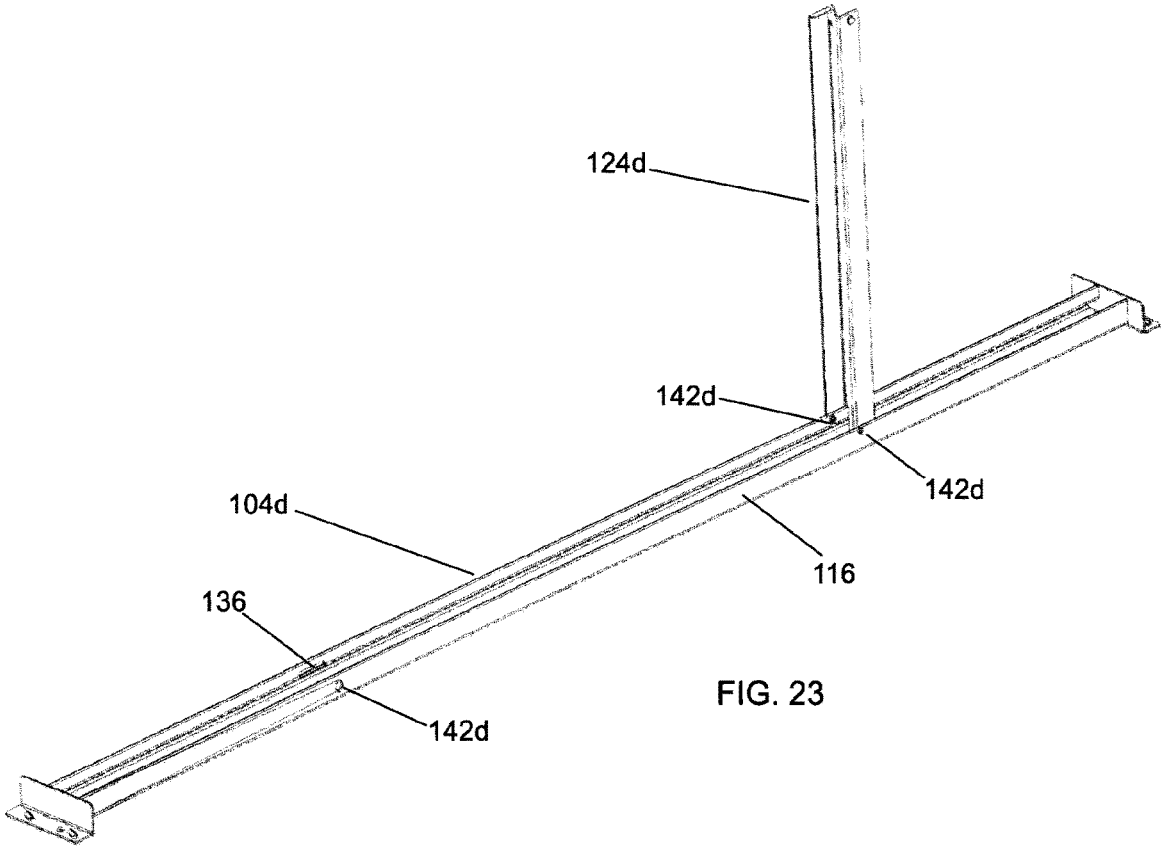
FIG. 23 is a bottom perspective view of the support beam and beam brace of FIG. 22.
Figure 24:
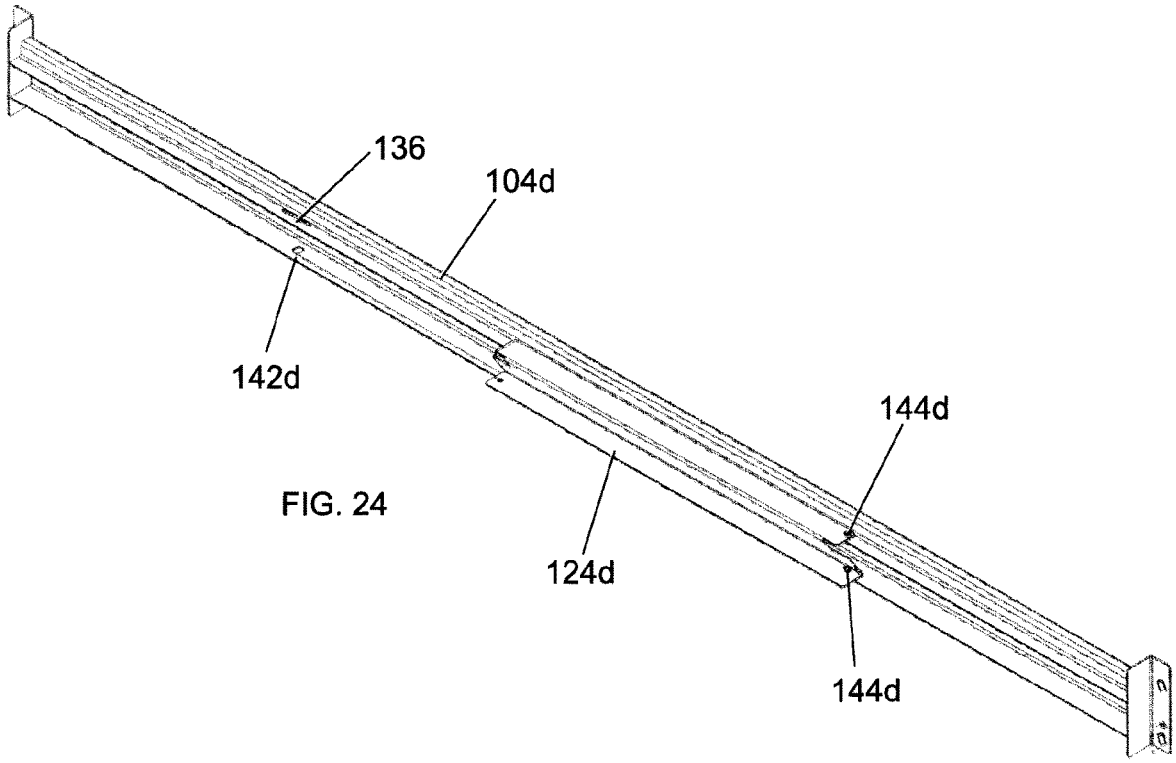
FIG. 24 is a top perspective view of the embodiment of the support beam and beam brace of FIG. 22 is the closed configuration.
Figure 25:
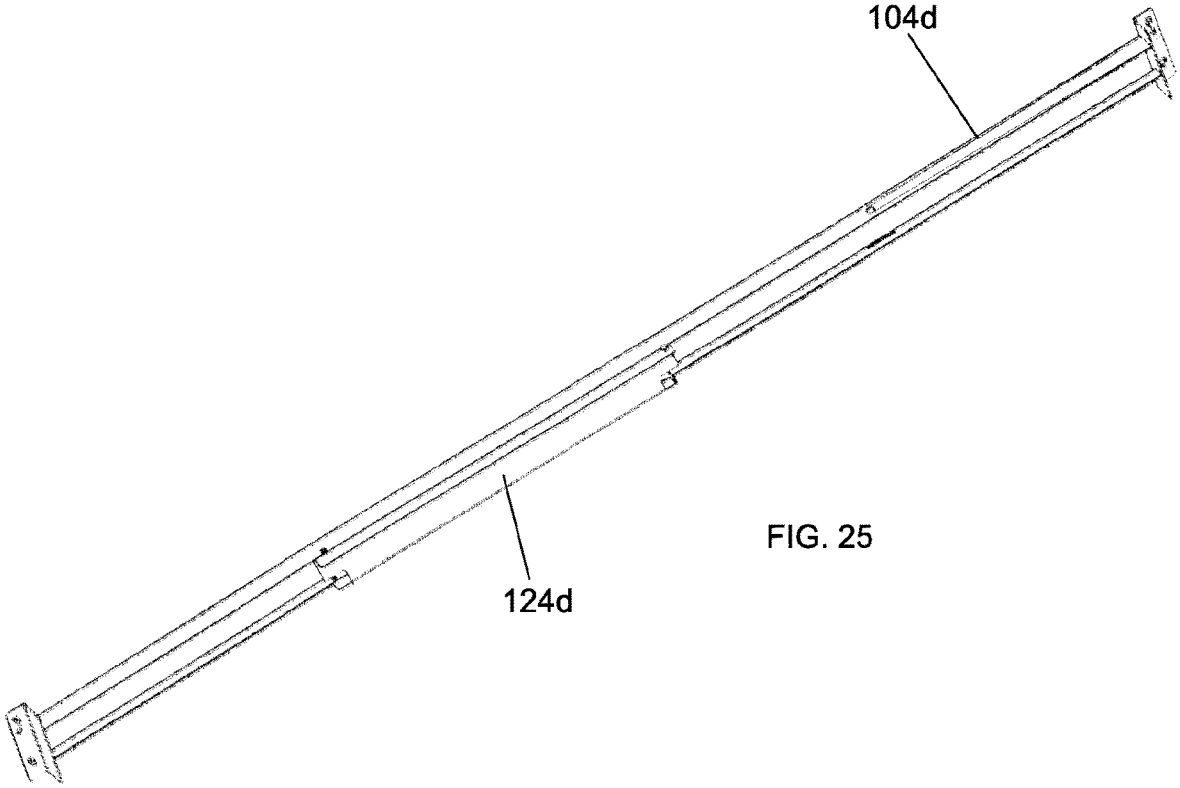
FIG. 25 is a bottom perspective view of the support beam and brace of FIG. 24.

As with the previous embodiment, the support beam **104*d* and its associated beam brace(s) 124*d* may be in either a closed configuration (as shown in FIGS. 24 and 25) or in an open configuration (as shown in FIGS. 22 and 23). Similar to the previous embodiment, the support beam 104*d* comprises outer face 112 extending between upper and lower horizontal faces 114, 116, with inward face 118 extending from the upper horizontal face 114, and the shelf support ledge 120 extending from the inward face 118. Slot openings 136 are formed on the shelf support ledges 120**.

Unlike the previous embodiment where beam openings 142 are present on the lower horizontal face 116 only, in this embodiment, beam openings **142*d* are preferably located on both the upper and lower horizontal faces 114, 116. Preferably, as shown in the embodiment in FIGS. 22 to 27, the beam openings 142*d* are arranged such that each of the beam openings 142*d* on the upper horizontal face 114 is substantially in line with one beam opening 142*d* on the lower horizontal face 116. Additionally, each of the slot openings 136 on the upper horizontal face 114 is preferably substantially in line with one beam opening 142*d* on the lower horizontal face 116**.

Referring to FIGS. 22 and 23, the beam braces **124*d* are pivotably connected to the support beam 104*d*, as with the previous embodiment. However, the manner of attachment of the beam brace 124*d* to the support beam 104*d*** is different, as described below.

Figure 27:
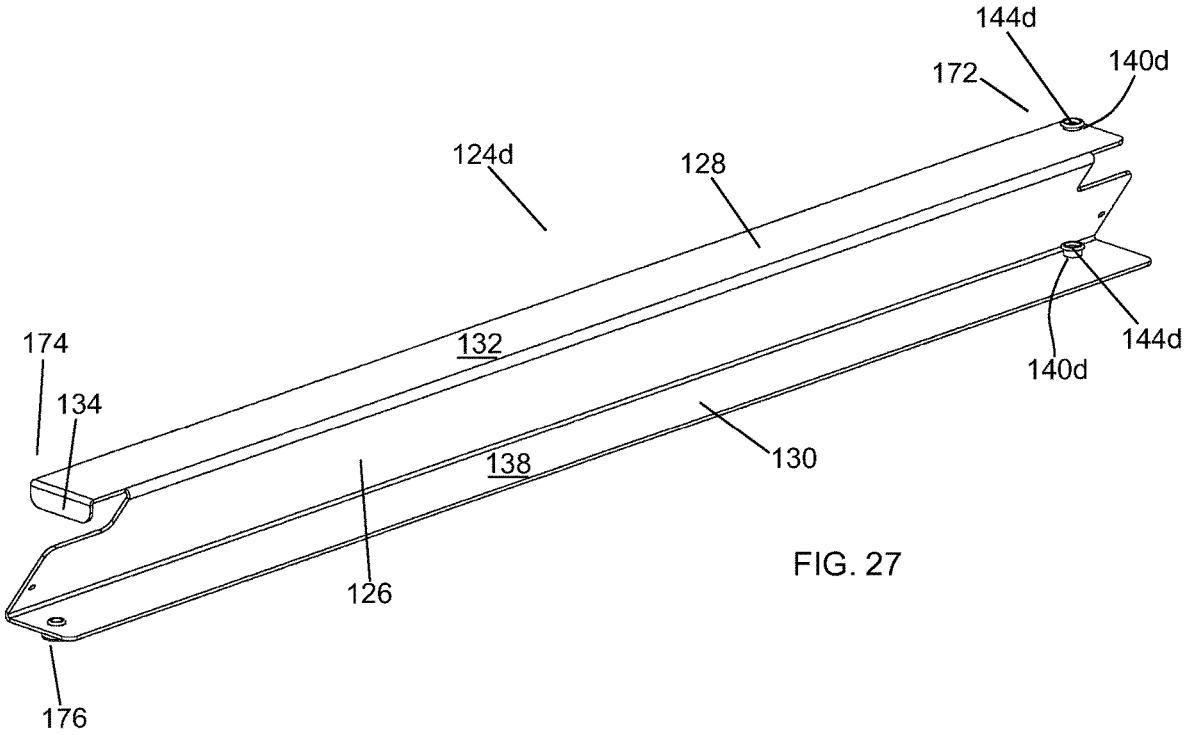
FIG. 27 is a perspective view of the beam brace of FIG. 22.

As with the previous embodiment, the beam brace **124*d* has first and second brace ends 172, 174, with each beam brace 124 further comprising a middle portion 126 extending between first and second portions 128, 130. Referring to FIG. 27, first portion 128 comprises generally planar first surface 132, while second portion 130 comprises generally planar second surface 138. In this embodiment, the middle portion 126 is preferably inclined, such that the first surface 132 and the second surface 138 lie substantially on top of one another when the beam brace 124*d* is viewed directly from above or below (i.e. similar in configuration to that of beam brace 124*c***).

Both the first portion 128 and the second portion 130 comprise brace openings **140*d* proximate to the first brace end 172. The first portion 128 also comprises downward-facing tab 134 extending from the first surface 132 proximate to the second brace end 174. As with the previous embodiment, the second portion 130 also preferably comprises knob 176 extending from the lower portion of the second surface 138**.

The beam brace **124*d* is pivotably connected to the support beam 104*d* by means of brace fasteners 144*d*. Each beam brace 124*d* is preferably pivotably connected to the support beam 104*d* by two brace fasteners 144*d*, as shown in FIG. 24. One brace fastener 144*d* extends through the beam opening 142*d* on the upper horizontal face 114 and the brace opening 140 on the first portion 128. Another brace fastener 144*d* extends through the beam opening 142*d* on the lower horizontal face 116 and the brace opening 140 on the second portion 130**.

The brace fasteners **144*d* may be in the form of pins 164. Preferably, the elongated portion 166 of the pin 164 has a diameter that is smaller than that of the brace opening 140 or the beam opening 142*d*. In addition, preferably, the first and second pin ends 168, 170 have a diameter that is greater than that of the brace opening 140 or the beam opening 142*d***.

Figure 26:
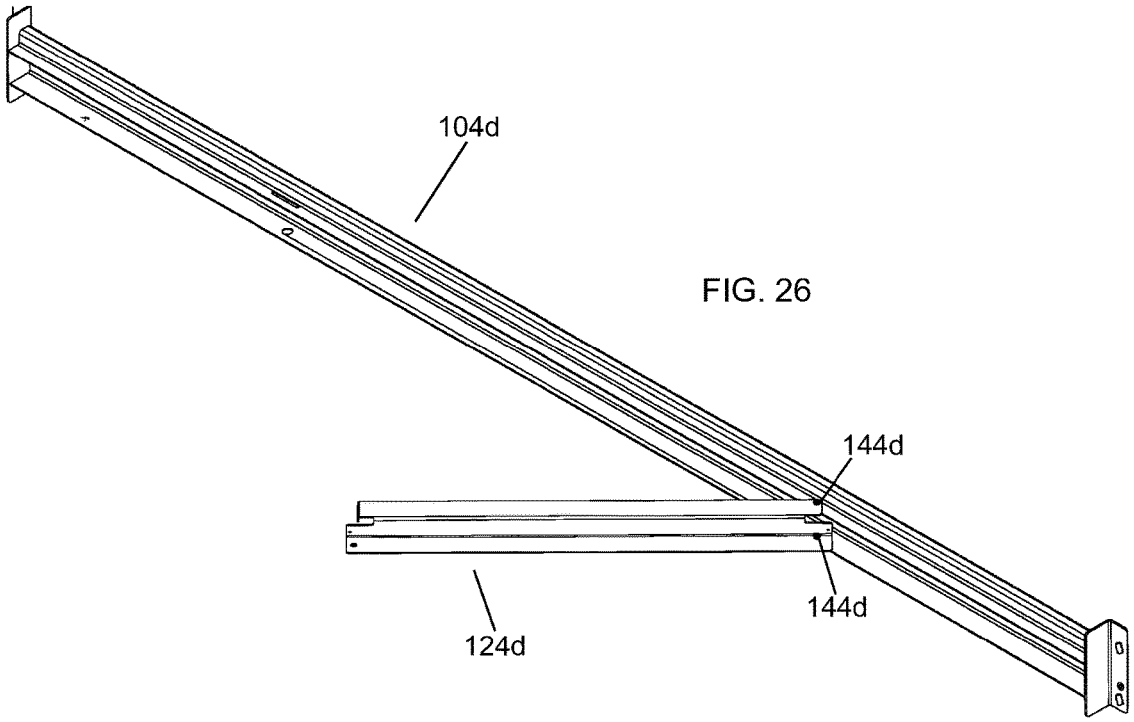
FIG. 26 is a perspective view of the embodiment of the support beam and beam brace of FIG. 22 in a partially open configuration.

Through brace fasteners **144*d*, the beam brace 124*d* is able to pivot from the closed configuration to the open configuration (and vice versa). While pivoting from the closed configuration to the open configuration, the beam brace 124*d* moves from being substantially collinear with the support beam 104*d* to be substantially perpendicular to the support beam 104*d*. For example, FIG. 26 shows the beam brace 124*d*** in midst of the transition from the closed configuration to the open configuration.

When two support beams **104*d* are to be attached together (e.g. via two beam braces 124*d*), tab 134 and knob 176 of a first beam brace 124*d* (already+connected to the first support beam 104*d*) may be used to engage slot opening 136 and beam opening 142*d*, respectively, of the second support beam 104*d*, as described for previous embodiments. Similarly, tab 134 and knob 176 of the second beam brace 124*d* (already connected to the second support beam 104*d*) may be used to engage slot opening 136 and beam opening 142*d*, respectively, of the first support beam 104*d***.

Figure 28:
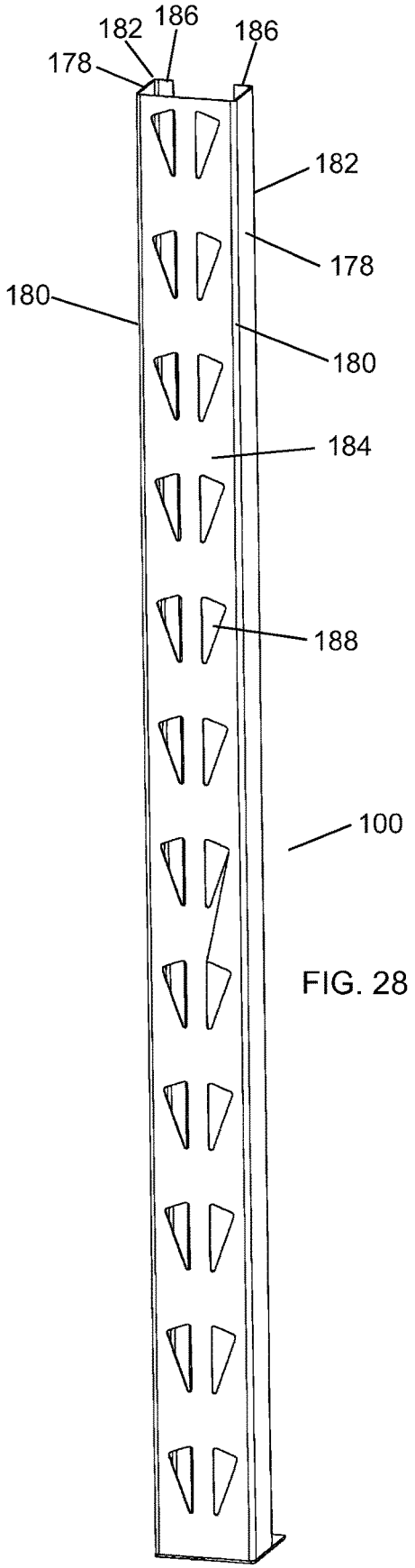
FIG. 28 is a perspective view of an embodiment of the corner column.
Figure 29:
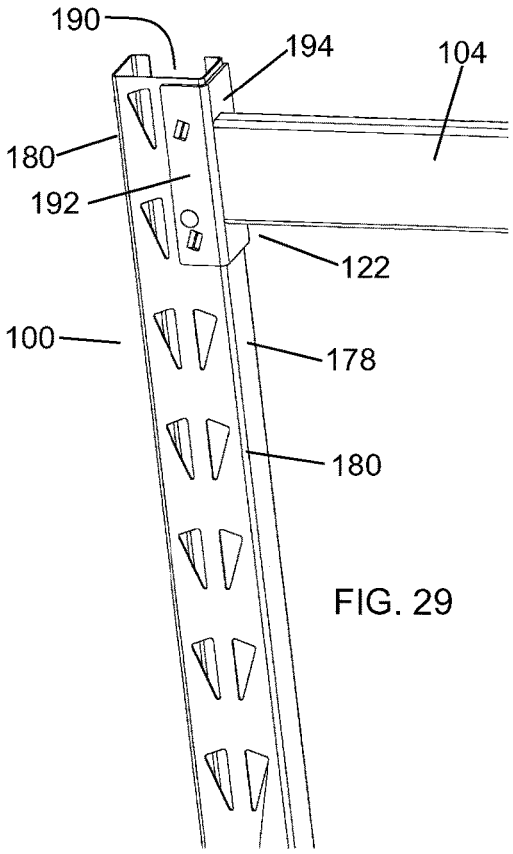
FIG. 29 is a partial front perspective view of the corner column of FIG. 28 connected to a support beam.
Figure 30:
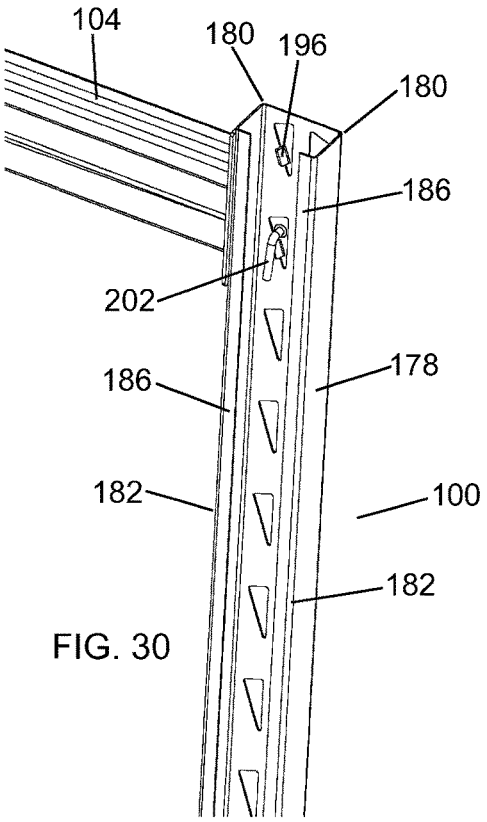
FIG. 30 is a partial rear perspective view of the corner column and support beam of FIG. 29.
Figure 31:
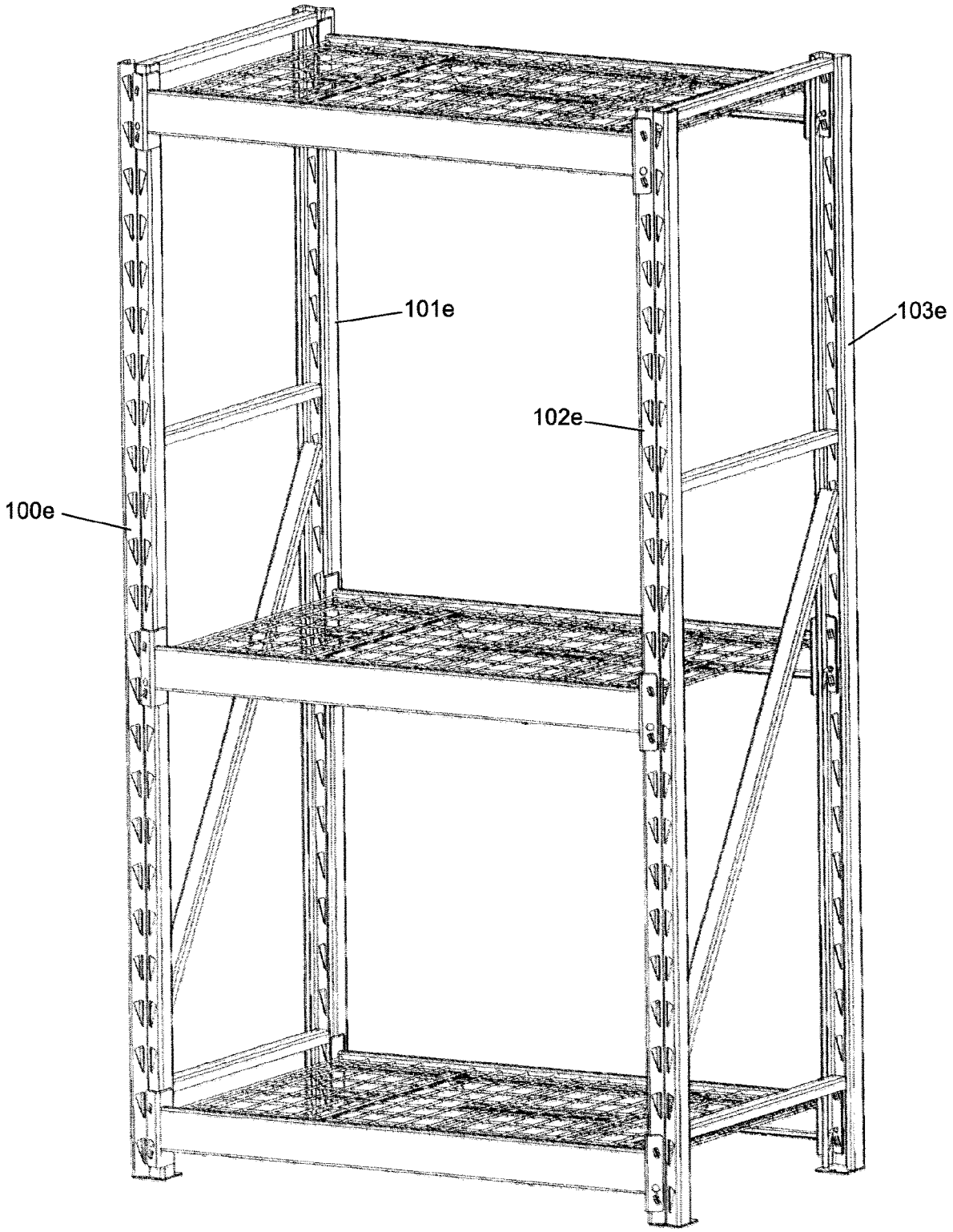
FIG. 31 is a perspective view of a shelving system with another embodiment of the corner column.
Figure 32:
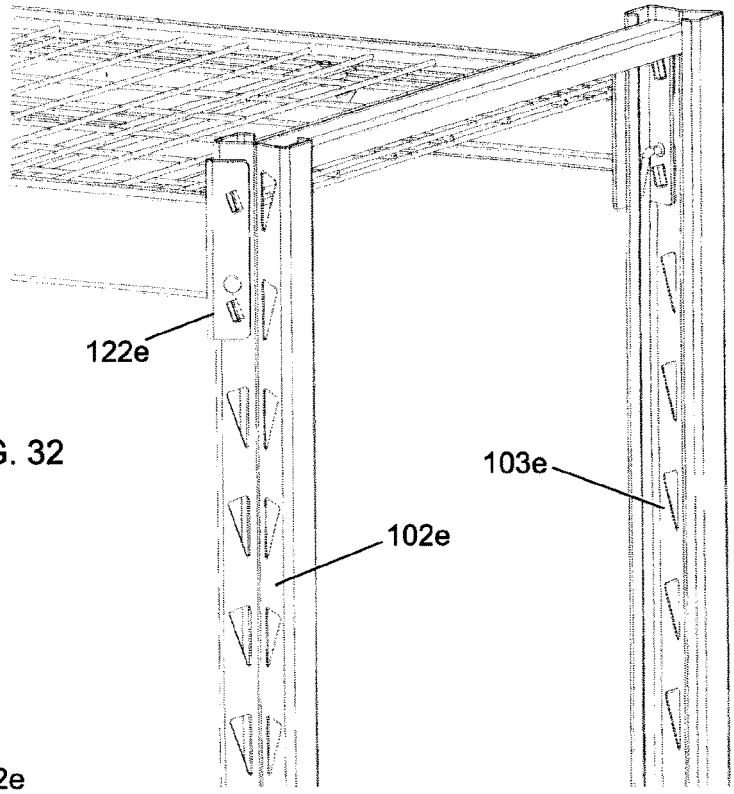
FIG. 32 is a partial perspective view of the shelving system of FIG. 31.

Referring to FIGS. 28 to 30, each of the corner columns 100, 101, 102, 103 is preferably formed from a single sheet of material, such as metal, that is bent to form a substantially C-shaped cross-section.

FIGS. 28 to 30 show one embodiment of the corner columns 100, 101, 102, 103. In this embodiment, each of the corner columns 100, 101, 102, 103 comprises opposed column walls 178, each with first and second column edges 180, 182. A central portion 184 extends between the opposed column walls 178 from the respective first column edges 180. Preferably, column flanges 186 extend from the respective second column edges 182 of the opposed column walls 178. Each of the column flanges 186 is preferably substantially perpendicular to the column wall 178 from which it extends. FIGS. 28 to 30 shows corner column 100, but it is understood that the other corner columns 101, 102, 103 are similar.

As shown in FIG. 1, the corner columns 100, 101, 102, 103 are preferably arranged such that their respective central portions 184 are on the exterior of the shelving system 10. The central portions 184 also comprise a plurality of slots 188. The slots 188 are used when connecting the end connectors 122 of the support beams 104 to the corner columns 100, 101, 102, 103. Preferably, the slots 188 are generally angled (as shown in FIGS. 28 to 30). However, it is understood that other orientations (and shapes) are also possible (e.g. round, rectangular, etc.).

The arrangement of the opposed column walls 178, the central portion 184, and the column flanges 186 form a generally C-shaped cross-section (as shown in FIGS. 28 to 30) that generally defines a channel 190. The channel 190 is shaped to engage with the side braces 108 and the inclined braces 110.

The shape of the central portion 184 may be different in different embodiments. In one embodiment, as shown in FIGS. 28 to 30, the central portion 184 is generally planar, with the central portion 184 being substantially perpendicular to the opposed column walls 178. In this embodiment, the slots 188 are preferably arranged in two columns that extend for at least a portion of the height of the central portion 184. The slots 188 may be further arranged such that the two slots 188 in each row are mirror images of each other, thus forming a generally V shape for each row. It is understood that other shapes and arrangements of the slots 188 may also be used.

In order to attach the support beam 104 to one of the corner columns 100, 101, 102, 103, one of the end connectors 122 of the support beam 104 is utilized. FIGS. 29 and 30 show one of the end connectors 122. The end connector 122 comprises first and second end plates 192, 194. The first and second end plates 192, 194 are preferably substantially perpendicular to each other.

Referring to FIGS. 2, 29 and 30, the first end plate 192 preferably comprises one or more end plate tabs 196. The end plate tabs 196 are protrusions that extend from an inner plate surface 198 of the first end plate 192. Preferably, the end plate tabs 196 are formed by cutting through the first end plate 192 and bending the cut portion towards the second end plate 194 such that it protrudes from the inner plate surface 198. However, other methods for forming the end plate tabs 196 are also possible. The position and size of the end plate tabs 196 are chosen so that they will fit within the slots 188 on the corner columns 100, 101, 102, 103, thereby allowing the attachment of the end connector 122 (and thus the support beam 104) to the corner columns 100, 101, 102, 103.

The first end plate 192 also preferably comprises one or more pin openings 200. The pin openings 200 allow a beam pin 202 to be inserted through the first end plate 192 and one of the slots 188. The beam pin 202 has a generally tubular shape with a bend in it. The beam pin 202 acts to further secure the end connector 122 to the corner columns 100, 101, 102, 103 and prevents the unintended detachment of the end connector 122 from the corner columns 100, 101, 102, 103.

Other shapes for the central portion 184 are also possible. In another embodiment of the corner columns **100*e*, 101*e*, 102*e*, 103*e*, the central portion 184*e* is not substantially planar (as in the previous embodiment) but is instead indented (i.e. towards the interior of the shelving system 10). FIGS. 31 to 34 show this embodiment. In this embodiment, the central portion 184*e* comprises first and second angled surfaces 204, 206, with each of the first and second angled surfaces 204, 206 forming acute angles C, D with their respective column wall 178**. Preferably, the acute angles C, D are identical to each other, but this is not necessarily required. The acute angles C, D are preferably at least approximately 12 degrees from perpendicular (i.e. approximately 78 degrees or less); however, other angles are also possible.

The slots 188 may also still be arranged in two columns, with one column of slots 188 on the first angled surface 204 and a second column of slots on the second angled surface 206.

Figure 35:
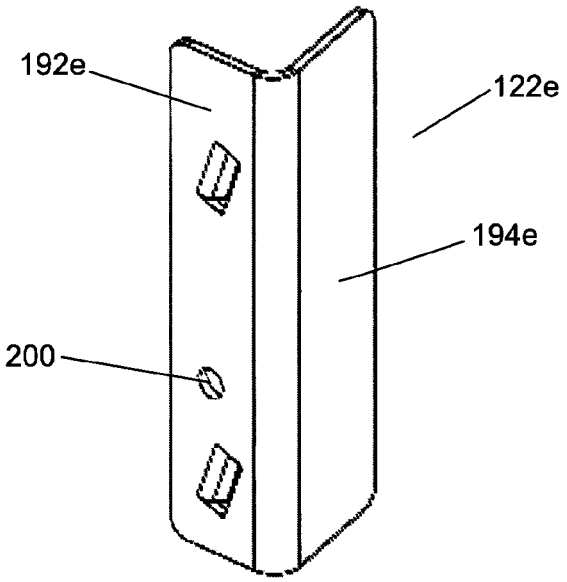
FIG. 35 is a perspective view of the end connector of FIG. 33.
Figure 36:
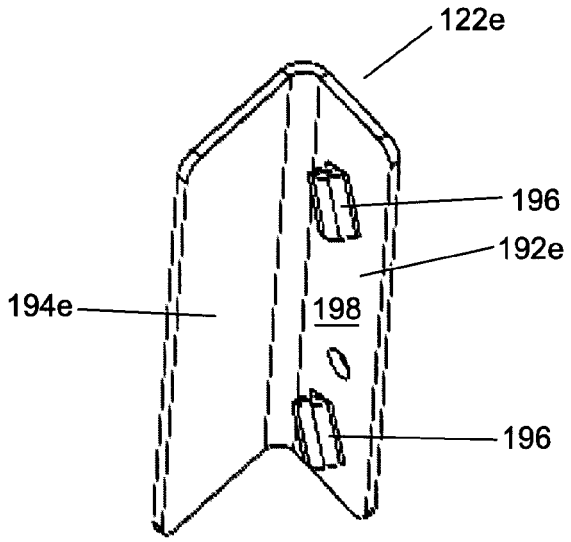
FIG. 36 is another perspective view of the end connector of FIG. 35.
Figure 37:
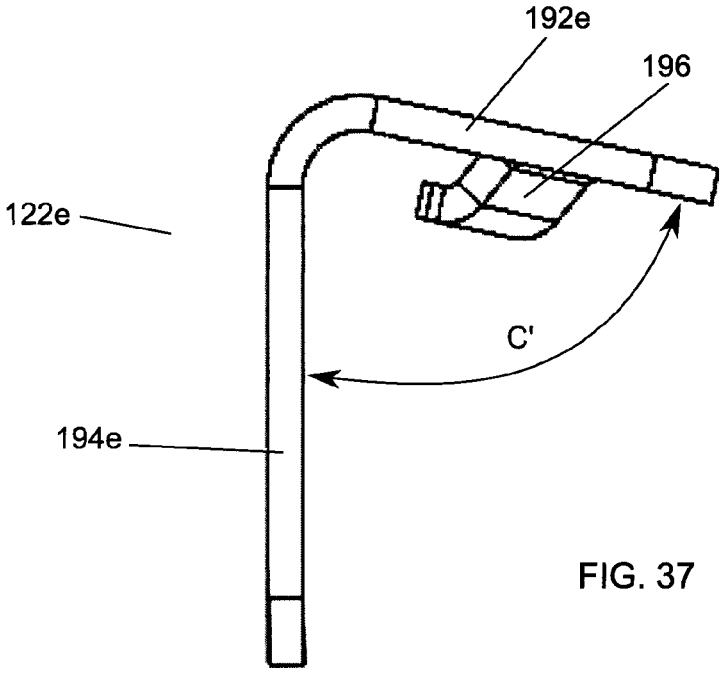
FIG. 37 is a top view of the end connector of FIG. 35.
Figure 38:
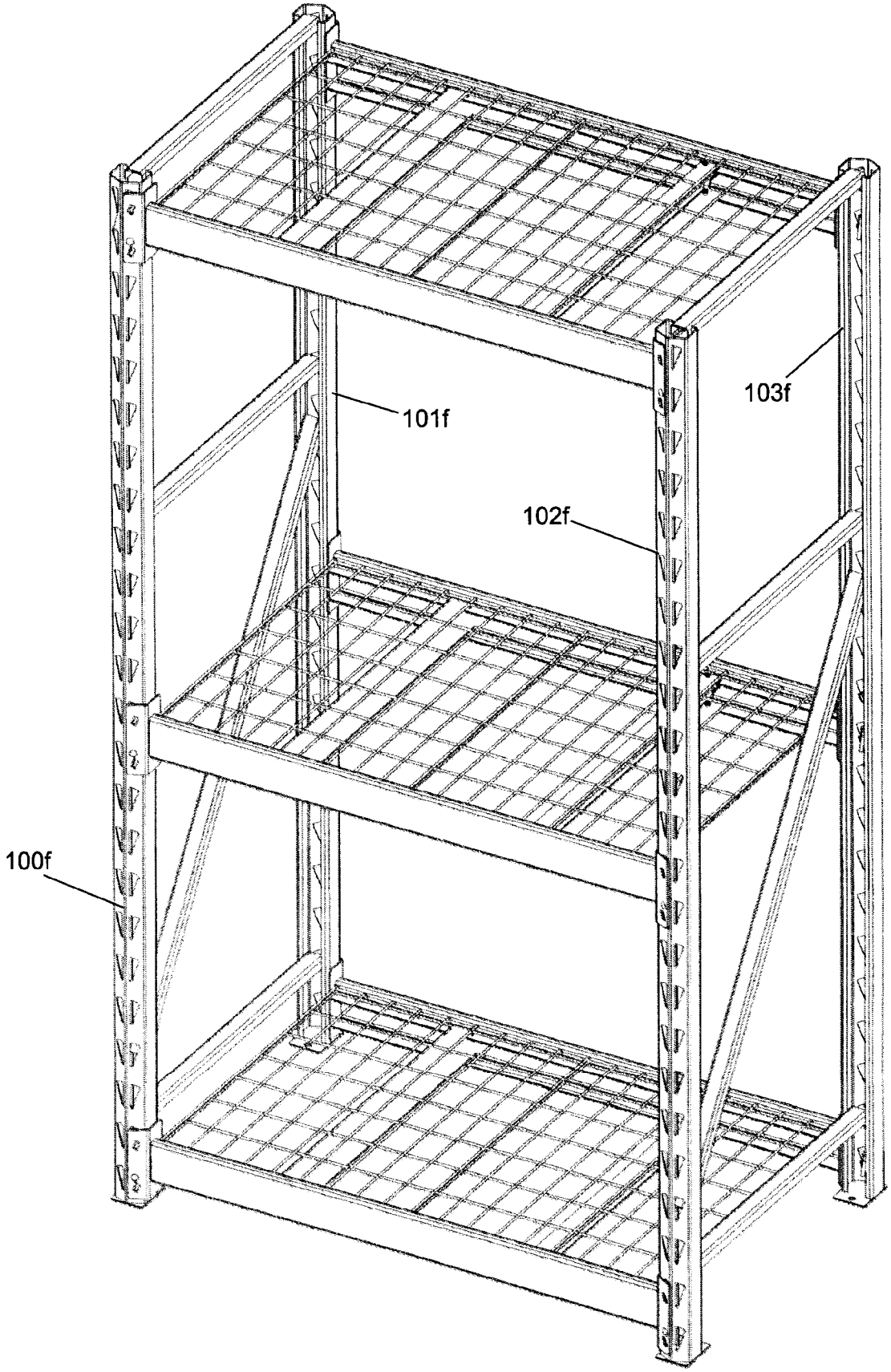
FIG. 38 is a perspective view of a shelving system with a further embodiment of the corner column.
Figure 39:
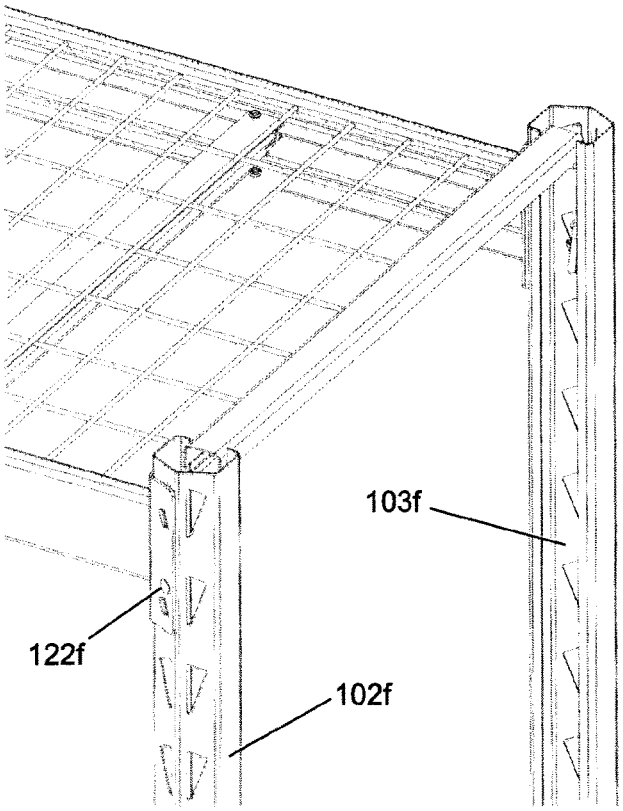
FIG. 39 is a partial perspective view of the shelving system of FIG. 38.

Referring to FIG. 35 to 37, in this embodiment, the end connectors **122*e* are preferably adapted to take into account the indentation in the central portion 184*e*. Accordingly, the first and second end plates 192*e*, 194*e* are preferably angled to each other at an angle that is substantially identical to the angle between the first or second angled surfaces 204, 206 and their respective column wall 178**.

Figure 33:
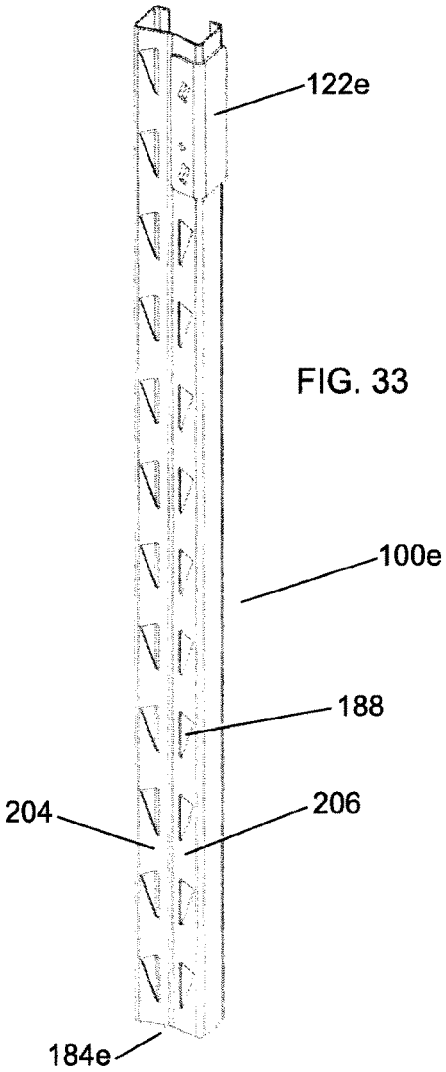
FIG. 33 is a perspective view of the corner column and end connector of the shelving system of FIG. 31.
Figure 34:
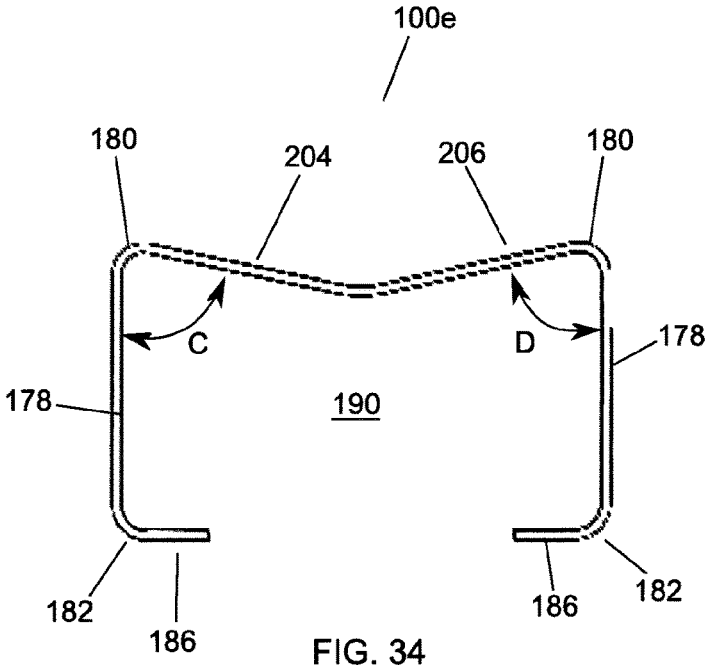
FIG. 34 is a top view of the corner column of FIG. 33.

FIG. 33 shows the end connector **122*e* attached to corner column 100*e*. The first end plate 192*e* comes into contact with the first angled surface 204, and the second end plate 194*e* comes into contact with the column wall 178. Therefore, the angle C' between the first end plate 192*e* and the second end plate 194*e* preferably corresponds to the angle C between the first angled surface 204 and the column wall 178 to allow the end connector 122*e* to fit snugly against the corner column 100*e*. Although only corner column 100*e* is shown, it is understood that the other corner columns 101*e*, 102*e*, 103*e* are similar. However, for corner columns 101*e*, 102*e*, due to their orientation, the end connectors 122*e* would come into contact with the second angled surfaces 206** instead.

FIGS. 38 to 41 show another embodiment for the corner columns **100*f*, 101*f*, 102*f*, 103*f*. In this embodiment, the first and second angled surfaces 204*f*, 206*f* of the central portion 184*f* are not indented, but instead protrude outwards. In this embodiment, the first and second angled surfaces 204*f*, 206*f* each form obtuse angles E, F with their respective column wall 178**. Preferably, the obtuse angles E, F are identical to each other, but this is not necessarily required. The obtuse angles E, F should be at least approximately 12 degrees from perpendicular (i.e. approximately 102 degrees or greater). More particularly, the obtuse angles E, F are preferably approximately 115 degrees or greater.

Figure 42:
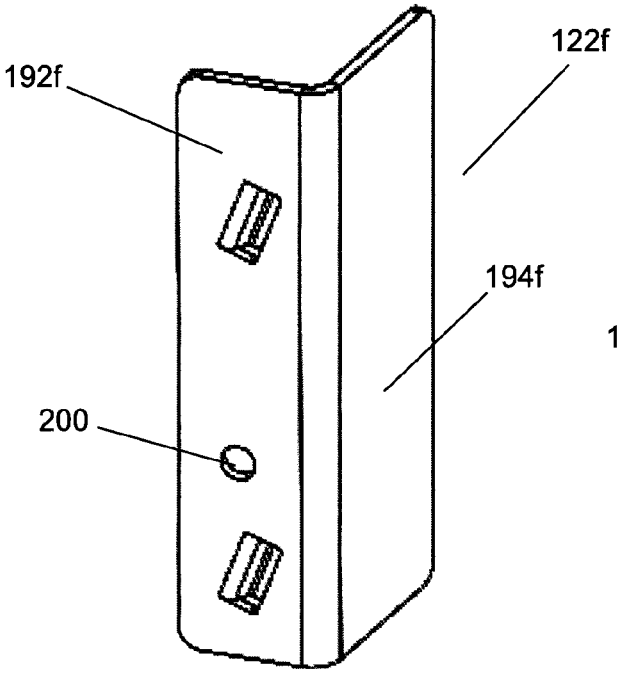
FIG. 42 is a perspective view of the end connector of FIG. 40.
Figure 43:
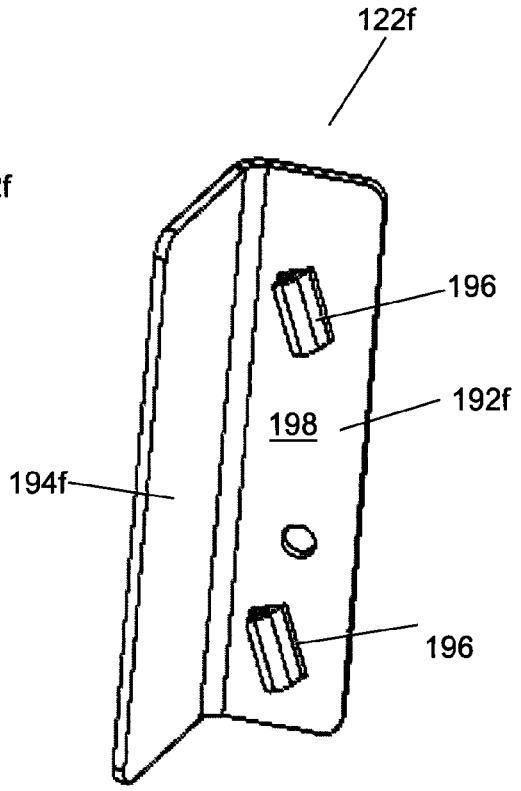
FIG. 43 is another perspective view of the end connector of FIG. 42.
Figure 44:
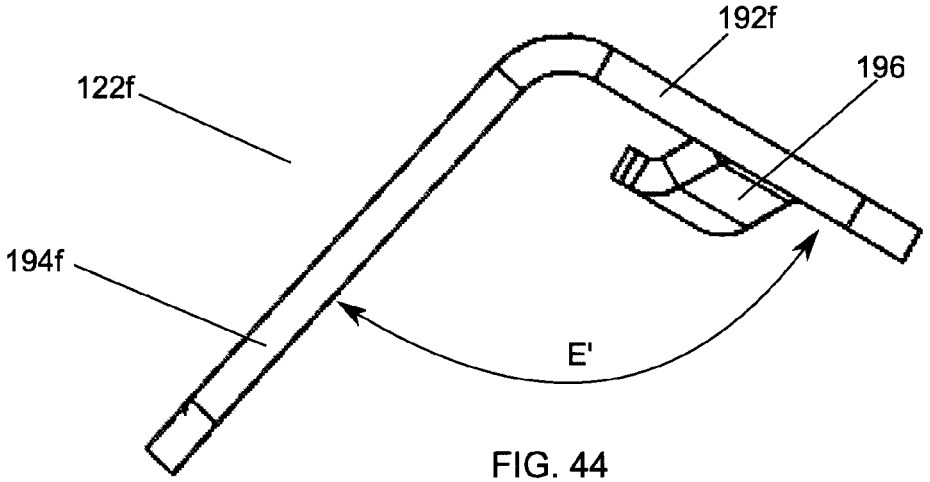
FIG. 44 is a top view of the end connector of FIG. 42.

Referring to FIGS. 42 to 44, in this embodiment, the end connectors **122*f* are again preferably adapted to take into account the protrusion in the central portion 184*f*. Accordingly, the first and second end plates 192*f*, 194*f* are preferably angled to each other at an angle that is substantially identical to the angle between the first or second angled surfaces 204*f*, 206*f* and their respective column wall 178**.

Figure 40:
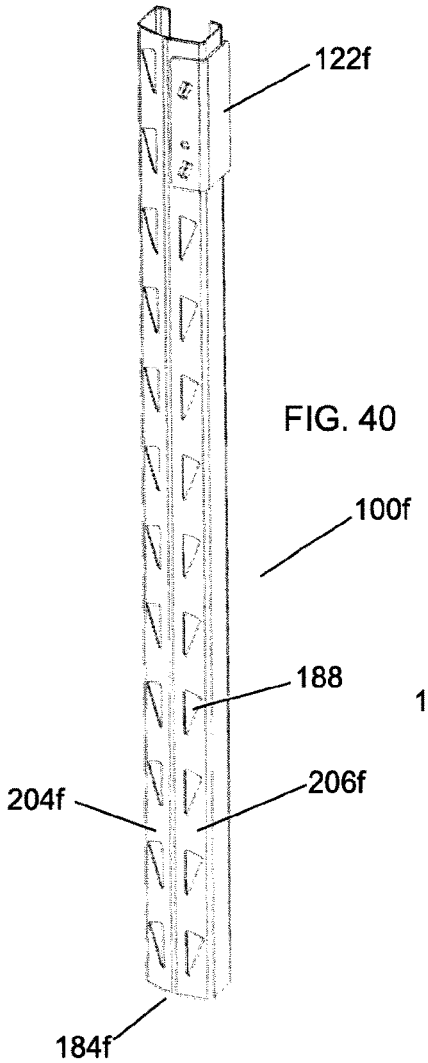
FIG. 40 is a perspective view of the corner column and end connector of the shelving system of FIG. 38.
Figure 41:
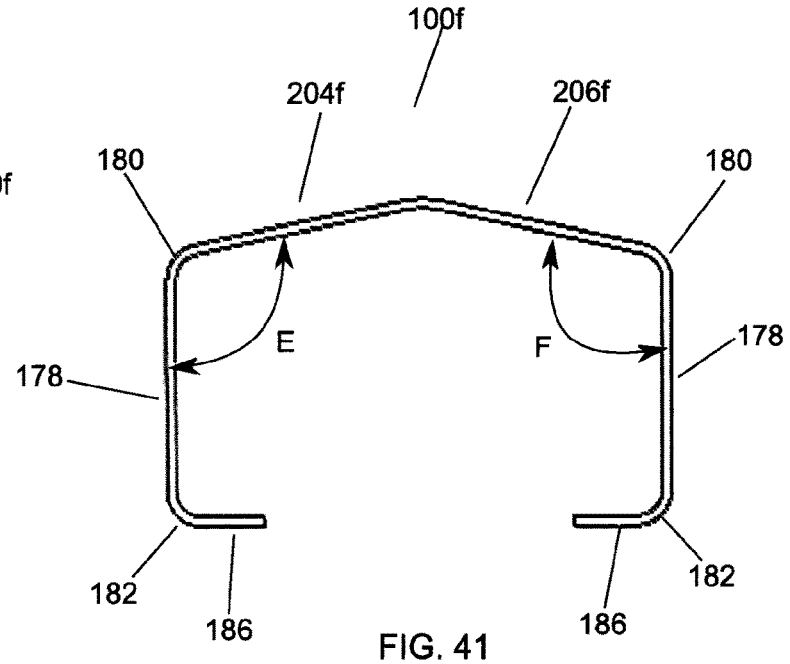
FIG. 41 is a top view of the corner column of FIG. 40.

FIG. 40 shows the end connector **122*f* attached to corner column 100*f*. The first end plate 192*f* comes into contact with the first angled surface 204*f*, and the second end plate 194*f* comes into contact with the column wall 178. Therefore, the angle E' between the first end plate 192*f* and the second end plate 194*f* preferably corresponds to the angle E between the first angled surface 204*f* and the column wall 178 to allow the end connector 122*f* to fit snugly against the corner column 100*f*. Although only corner column 100*f* is shown, it is understood that the other corner columns 101*f*, 102*f*, 103*f* are similar. However, for corner columns 101*f*, 102*f*, due to their orientation, the end connectors 122*f* would come into contact with the second angled surfaces 206*f*** instead.

In the above embodiments where the central portion 184 is not planar, the angling of the central portion 184 increases the overall strength of the corner columns 100, 101, 102, 103. In addition, by angling the central portion 184 with respect to the column walls 178, any end connectors 122 that will be used to attach the support beams 110 to the corner columns 100, 101, 102, 103 will preferably have a similar angle as well. This prevents non-compatible parts from other shelving systems from being used with the present shelving system 10. In particular, when the angle between the first or second angled surfaces 204, 206 and its respective column wall 178 is at least approximately 12 degrees from perpendicular, this will prevent end connectors 122 from non-compatible shelving systems (e.g. end connectors with perpendicular first and second end plates) from being attached to the corner column 100, 101, 102, 103.

Figure 45:
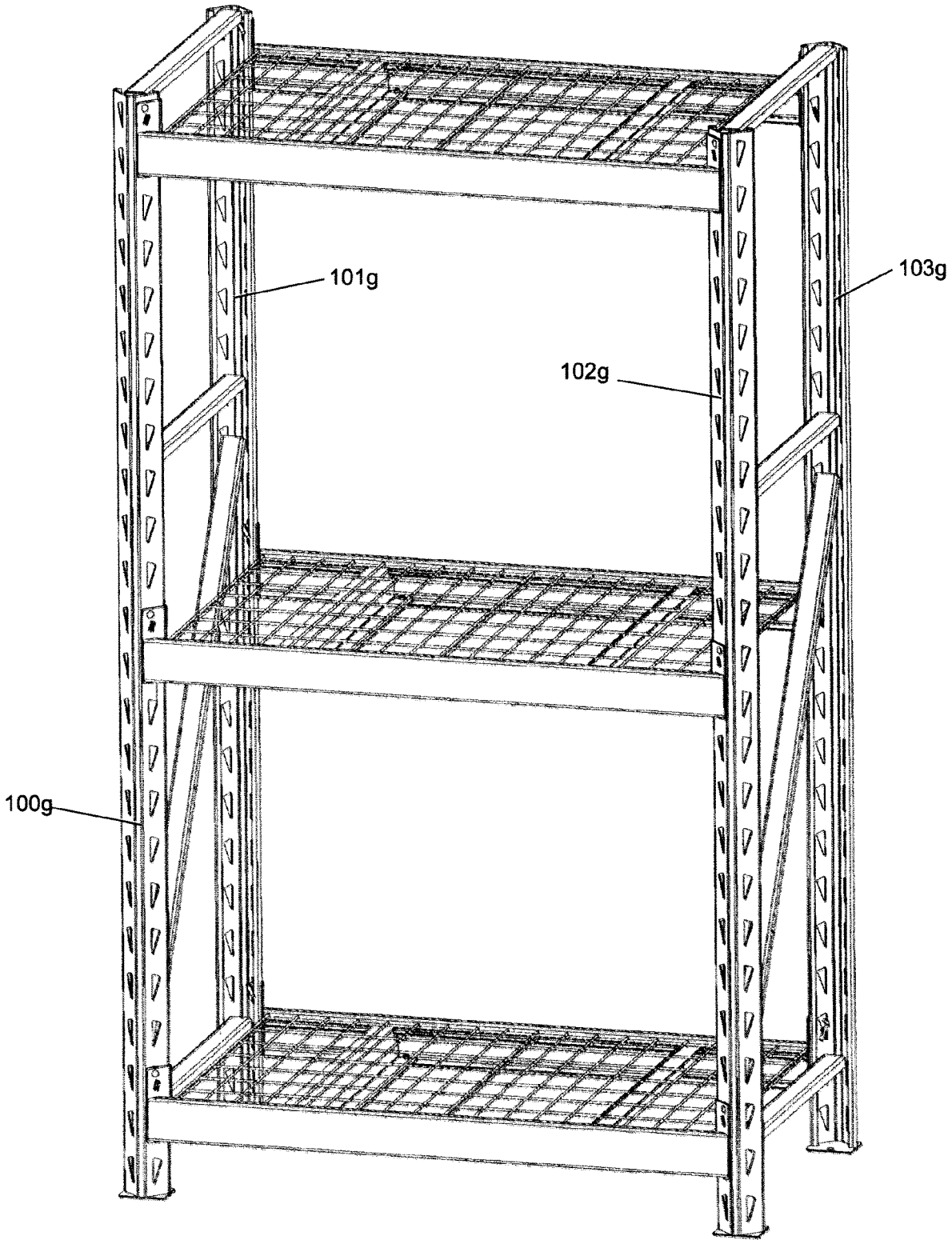
FIG. 45 is a perspective view of a shelving system with another embodiment of the corner column.
Figure 46:
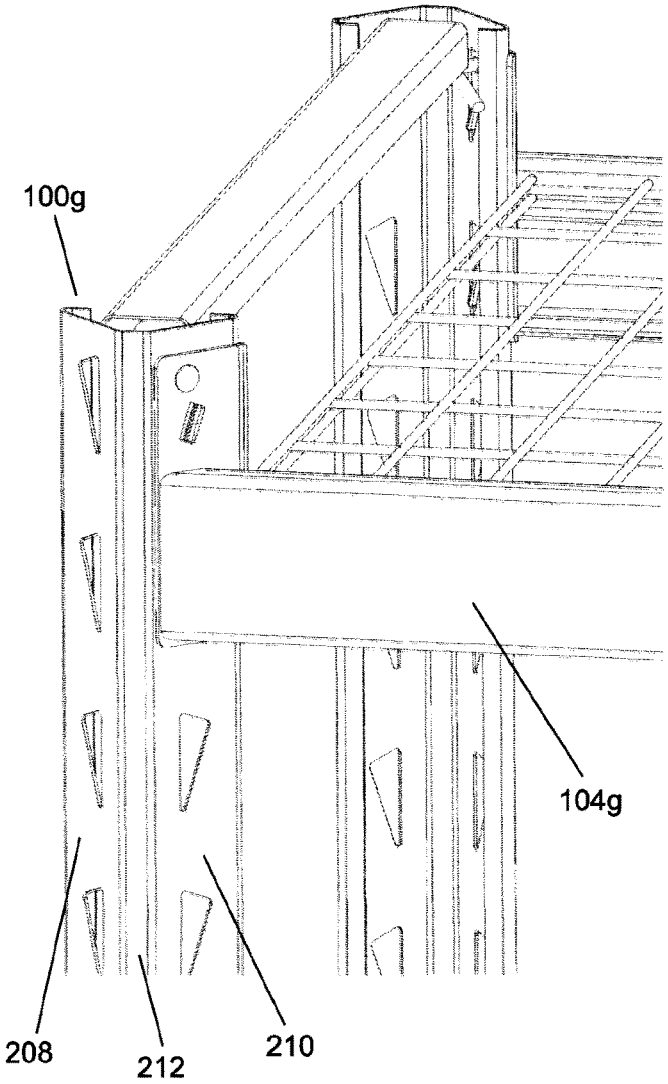
FIG. 46 is a partial perspective view of the shelving system of FIG. 45.
Figure 47:
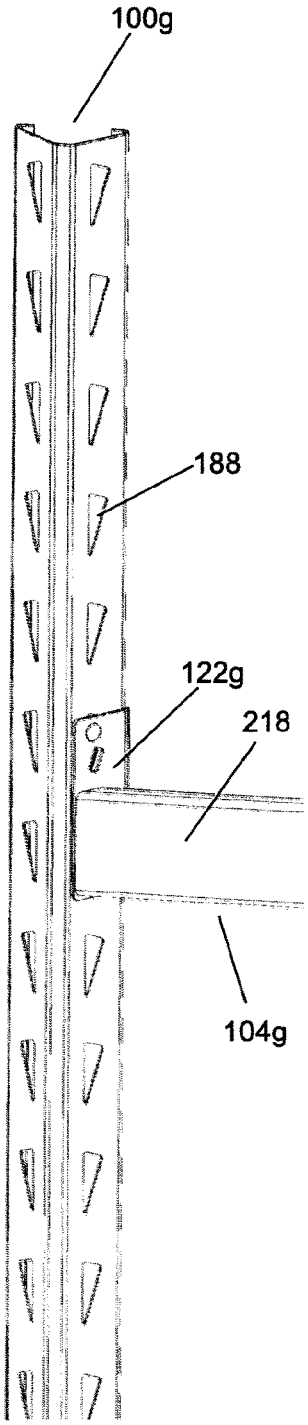
FIG. 47 is a partial perspective view of a corner column and a support beam of the shelving system of FIG. 45.

FIGS. 45 to 50 show a further embodiment for the corner columns 100*g*, 101*g*, 102*g*, 103*g*. In this embodiment, the corner columns 100*g*, 101*g*, 102*g*, 103*g* do not have opposed column walls 178 as in the previous embodiments. Instead, the corner columns 100*g*, 101*g*, 102*g*, 103*g* comprise first and second angled column walls 208, 210. The first and second angled column walls 208, 210 preferably extend from a central wall 212; however, it is also possible for the central wall 212 to be omitted, such that the first and second angled column walls 208, 210 lie adjacent to one another. Column flanges 186 may also extend from an outer edge 214 of each of the first and second angled column walls 208, 210. Although only corner column 100*g* is shown in FIG. 47, it is understood that the other corner columns 101*g*, 102*g*, 103*g* are preferably similar.

Figure 50:
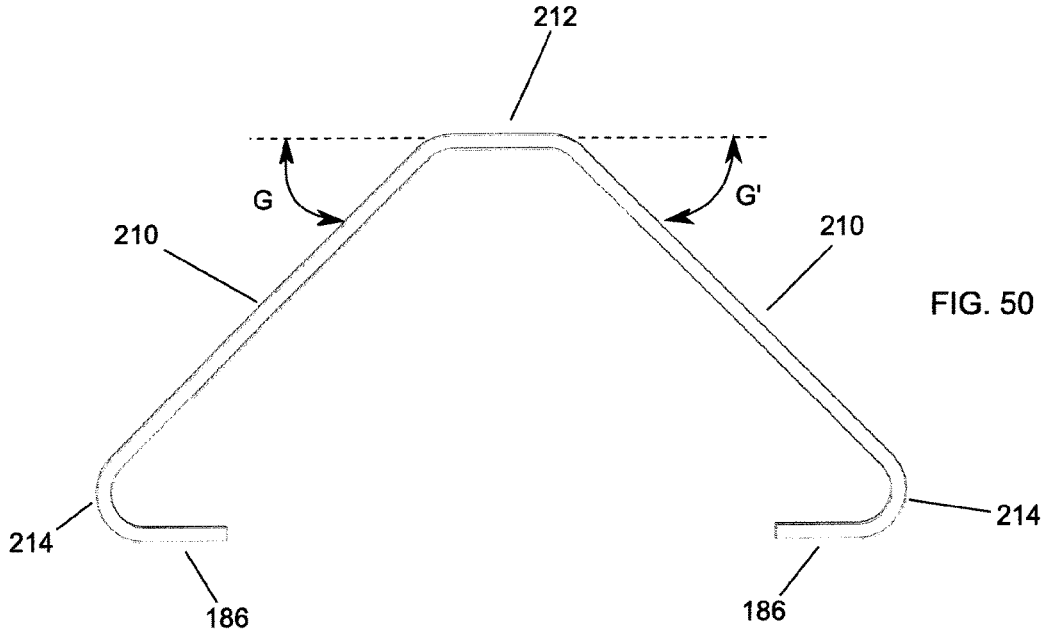
FIG. 50 is a top view of the corner column of FIG. 47.

Referring to FIG. 50, the first and second angled corner walls 208, 210 are angled with respect to the column flanges 186 at an angle G, G'. Preferably, the angles G, G' are identical to each other and are acute angles (when viewed from above). Preferably, the angles G, G' are approximately 45 degrees, although other angles are also possible.

As best shown in FIGS. 45 and 46, the corner columns 100*g*, 101*g*, 102*g*, 103*g* are arranged such that their first and second angled column walls 208, 210 and the central wall 212 (if any) face the exterior of the shelving system 10*g*. Referring to FIG. 47, the first and second angled column walls 208, 210 preferably comprise a plurality of slots 188.

In the embodiment shown in FIGS. 45 to 50, the slots 188 are arranged in two columns that extend for at least a portion of the corner columns 100*g*, 101*g*, 102*g*, 103*g*, with one column of slots 188 on the first angled column wall 208 and a second column of slots 188 on the second angled column wall 210.

Figure 48:
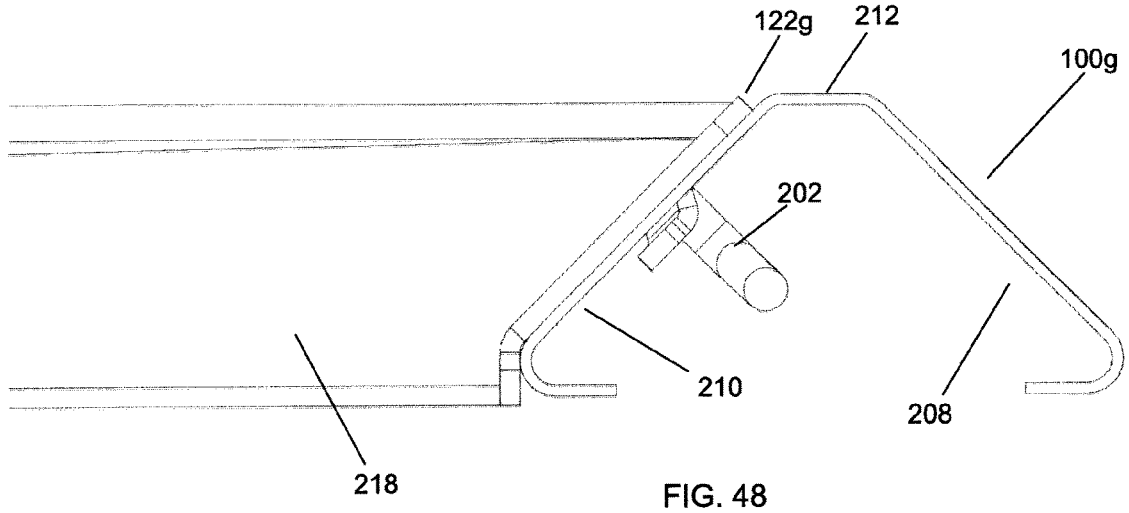
FIG. 48 is a top view of the corner column and support beam of FIG. 47.
Figure 49:
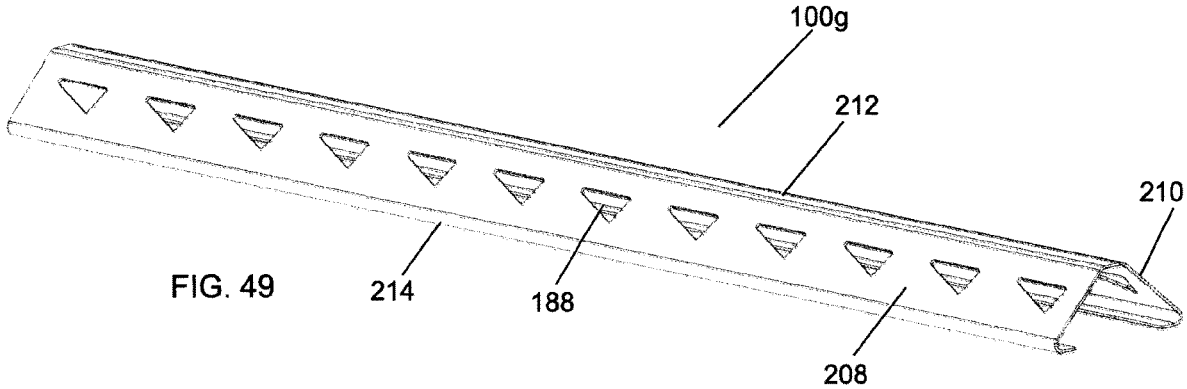
FIG. 49 a perspective view of the corner column of FIG. 47.
Figure 51:
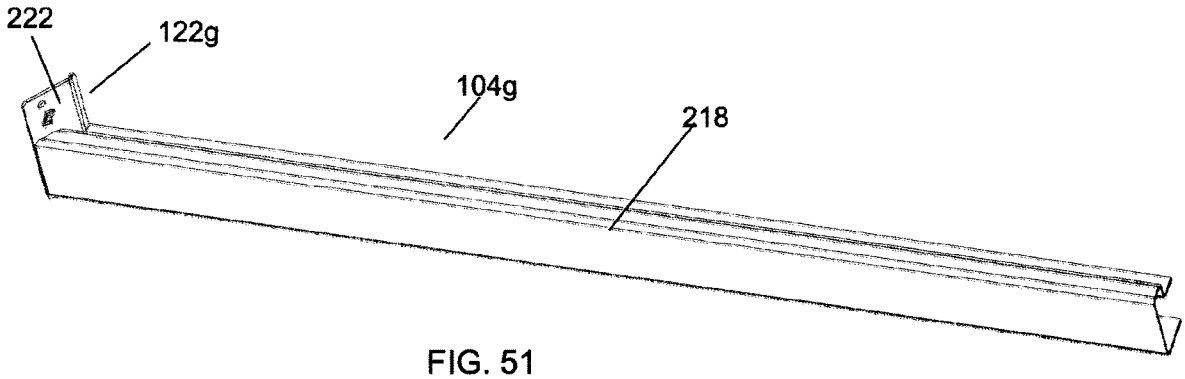
FIG. 51 is a perspective view of the support beam of FIG. 47.
Figure 52:
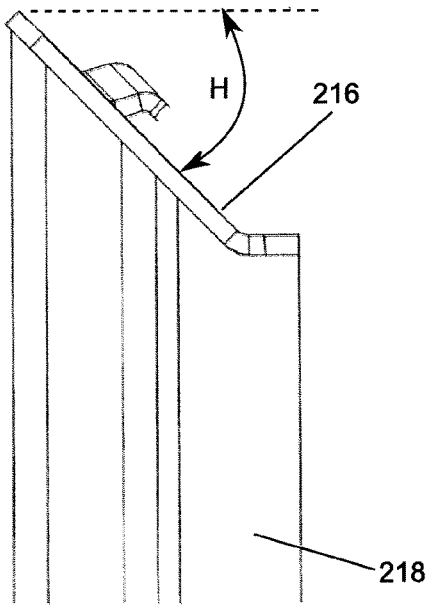
FIG. 52 is a top view of the support beam of FIG. 47.
Figure 53:
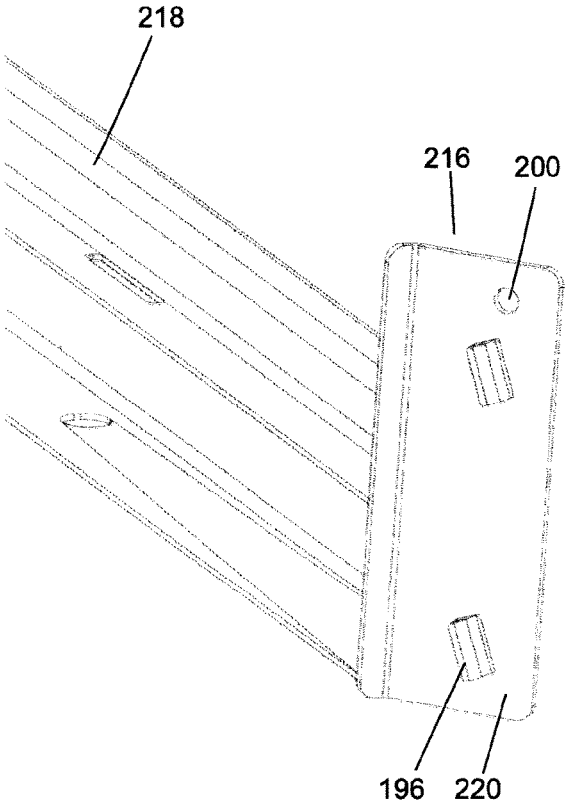
FIG. 53 is another perspective view of the support beam of FIG. 47.

Referring to FIGS. 51 to 53, in this embodiment, the end connector 122*g* is adapted to couple with either the first angled column wall 208 or the second angled column wall 210. FIGS. 47 and 48 show the support beam 104*g* attached to corner column 100*g*. It is understood that the attachment of the support beam 104*g* to other corner columns 101*g*, 102*g*, 103*g* is similar. In this embodiment, the end connector 122*g* comprises a substantially planar end plate 216 with first and second end plate surfaces 220, 222. The first end plate surface 220 is oriented away from the elongated portion 218, while the second end plate surface 222 is oriented toward the elongated portion 218. The end plate 216 further comprises one or more tabs end plate tabs 196 that extend from the first end plate surface 220. As with the previous embodiments, the end plate tabs 196 are preferably formed by cutting through the end plate 216 and bending the cut portion such that it protrudes from the first end plate surface 220. However, other methods for forming the end plate tabs 196 are also possible. The position and size of the end plate tabs 196 are designed so that they will fit within the slots 188 on the corner columns 100*g*, 101*g*, 102*g*, 103*g*, thereby allowing for attachment of the end connector 122*g* to the corner columns 100*g*, 101*g*, 102*g*, 103*g*.

Referring to FIG. 52, an angle H of the end plate 216 with respect to the elongated member 218 should be substantially identical to the angle G. This would allow the end plate 216 to sit substantially flush against the first or second angled column walls 208, 210.

As with the previous embodiments, the end plate 216 also preferably comprises one or more pin openings 200. The pin opening 200 allows beam pin 202 to be inserted through the end plate 216 and one of the slots 188. The beam pin 202 acts to secure the end plate 216 to the corner columns 100*g*, 101*g*, 102*g*, 103*g* and prevents the unintended detachment of the end plate 216 from the corner column 100*g*, 101*g*, 102*g*, 103*g*.

Figure 54:
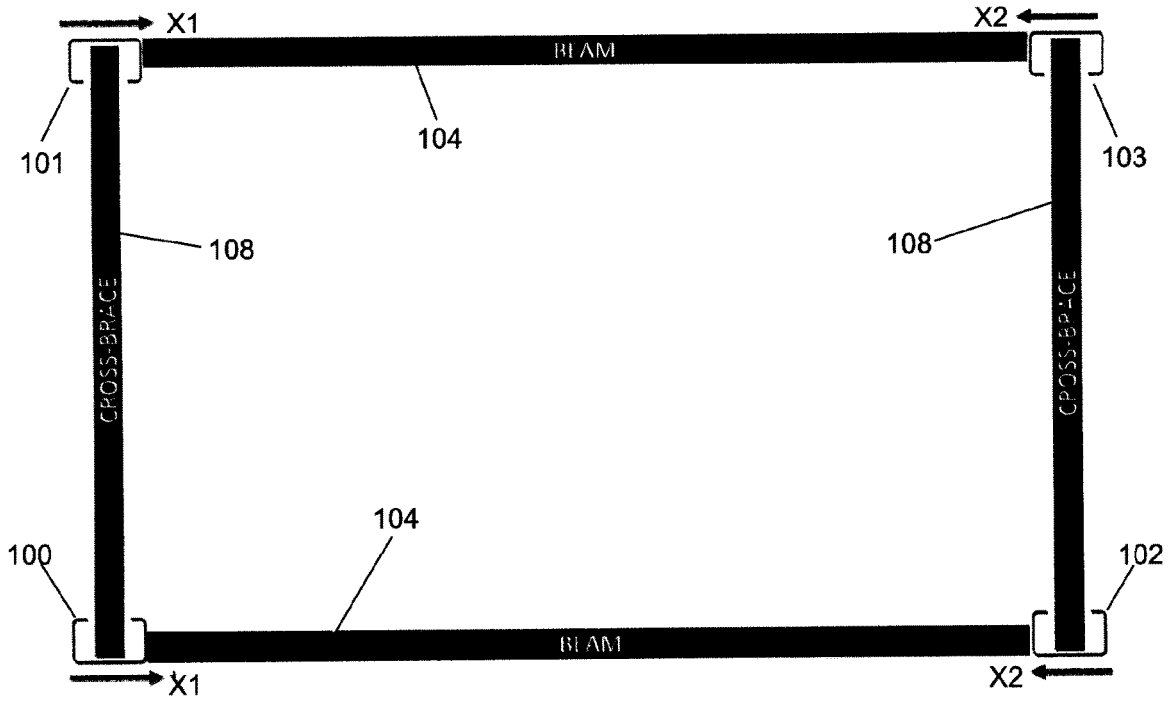
FIG. 54 is a top representation of one of the embodiments of the shelving system.
Figure 55:
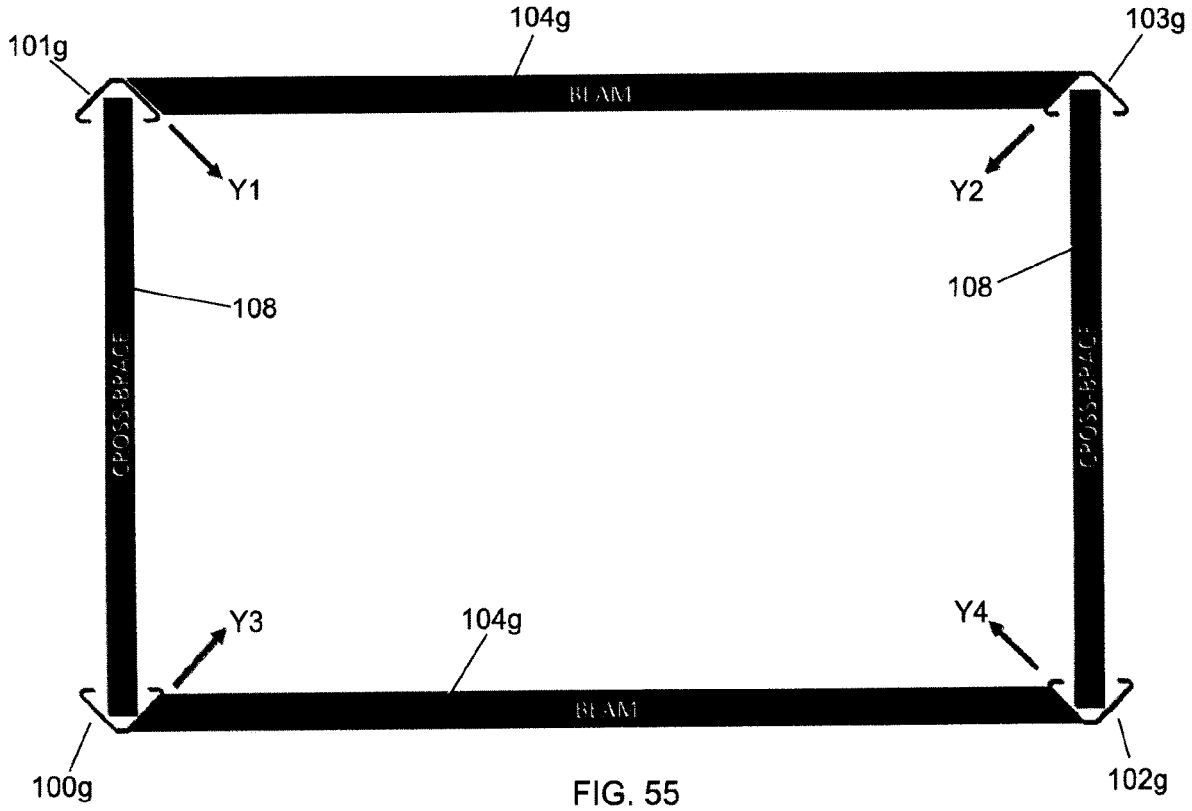
FIG. 55 is a top representation of another of the embodiments of the shelving system.

FIGS. 54 and 55 show a comparison between the different embodiments of the corner columns 100, 101, 102, 103. FIG. 54 shows one of the embodiments of the shelving system 10 with corner columns 100, 101, 102, 103 having a generally rectangular cross-section. In such an embodiment, the support beams 104 stabilize the shelving system 10 in two directions only (as indicated by X1, X2). In comparison, FIG. 55 shows the embodiment of the shelving system 10*g* with the corner columns 100*g*, 101*g*, 102*g*, 103*g* having a generally triangular cross-section. In such an embodiment, the support beams 104*g* stabilize the shelving system 10*g* in four directions (as indicated by Y1, Y2, Y3, Y4). This stabilization in four directions results in additional stability for the shelving system 10*g*.

The slots 188 on the corner columns 100, 101, 102, 103 may also be used for attachment of various accessories, as described below.

Figure 57:
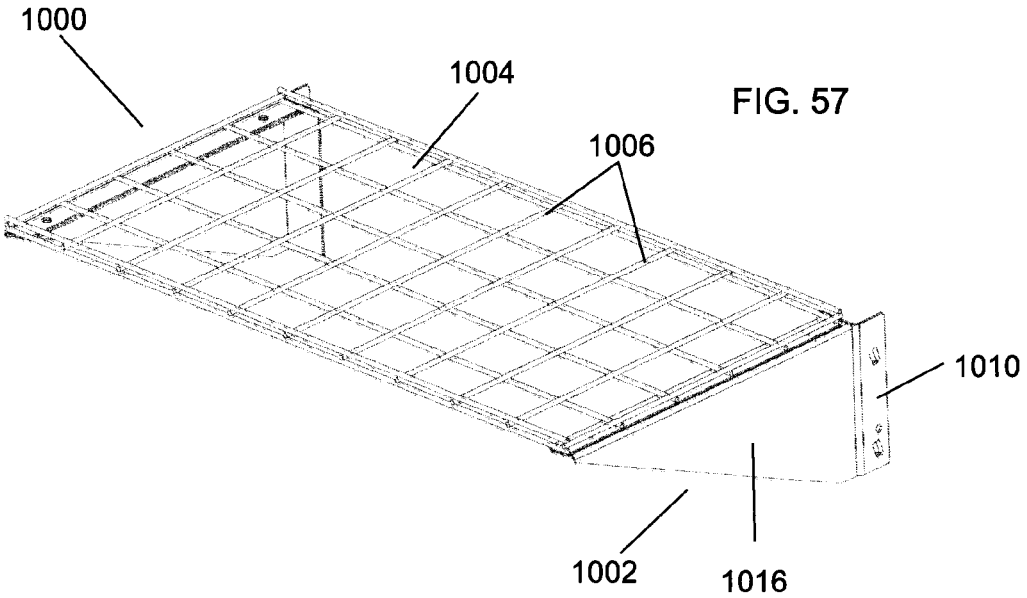
FIG. 57 is top perspective view of one of the shelving racks of FIG. 56.
Figure 58:
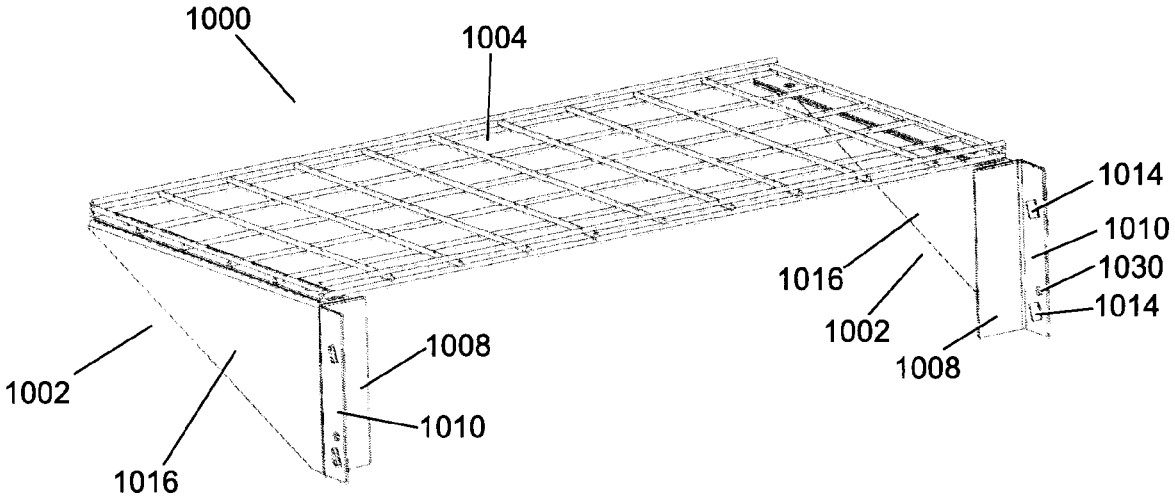
FIG. 58 is a rear perspective view of the shelving rack of FIG. 57.
Figure 59:
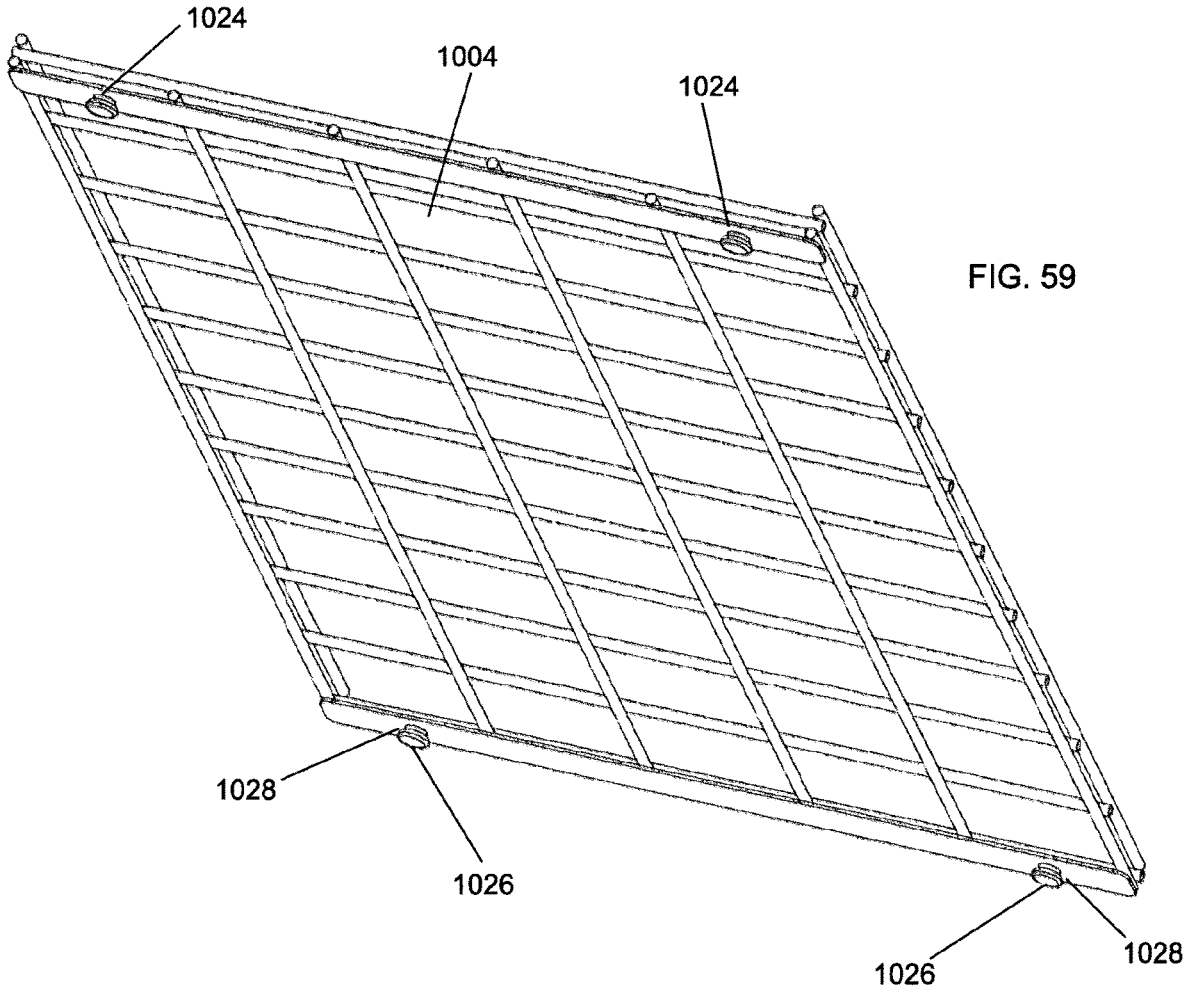
FIG. 59 is a perspective view showing the rack surface of the shelving rack of FIG. 56.
Figure 60:
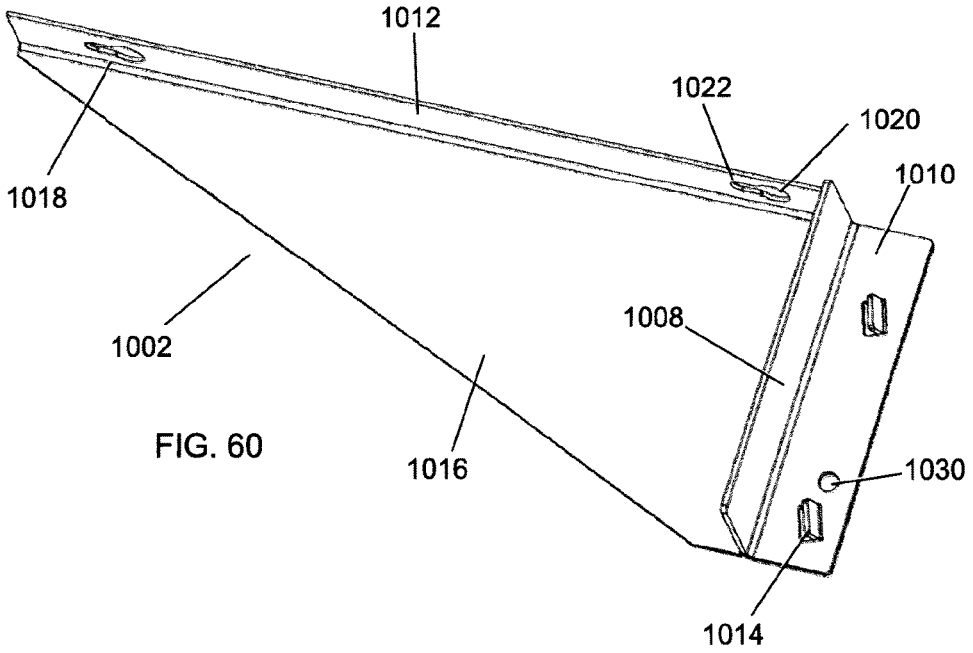
FIG. 60 is a perspective view showing one of the brackets of the shelving rack of FIG. 56.

Referring to FIGS. 56 to 60, one or more shelving racks 1000 are provided. Preferably, two shelving racks 1000 are provided, as shown in FIG. 56. Referring to FIGS. 57 and 58, each of the shelving racks 1000 comprises two brackets 1002 and a rack surface 1004 extending between the brackets 1002. The rack surface 1004 may be a solid surface or it may be a wire rack (as shown in FIG. 56). The rack surface 1004 is preferably generally flat and where the rack surface 1004 is a wire rack, it may be formed from a number of wires 1006 arranged in a grid-like pattern. The brackets 1002 comprise an upright member 1008, with an attachment flange 1010 and a support flange 1012 extending from the upright member 1008. Preferably, both the attachment flange 1010 and the support flange 1012 extend substantially perpendicularly from the upright member 1008. One or more rack tabs 1014 extends from the attachment flange 1010. The rack tabs 1014 are adapted to fit within the slots 188 on the corner columns 100, 101, 102, 103 to provide for secure attachment of the shelving rack 1000 to the corner columns 100, 101, 102, 103.

For example, the shelving rack 1000 may be attached to the corner columns 100, 101 (as shown in FIG. 56). The rack tabs 1014 of one of the attachment flanges 1010 will engage with the slots 188 on corner column 100, while the rack tabs 1014 of the other attachment flange 1010 will engage with the slots 188 on corner column 101. The attachment of the attachment flange 1010 to corner column 100 will now be described in detail; however, it is understood that the attachment of the attachment flange 1010 to corner column 101 is similar.

When the attachment flange 1010 is attached to corner column 100, the attachment flange 1010 preferably sits against the central portion 184 (with the rack tabs 1014 fitted within the slots 188). The upright member 1008 preferably rests against one of the column walls 178, acting as a form of brace for the shelving rack 1000. A support brace 1016 may also be provided to provide support between the support flange 1012 and the upright member 1008. For example, in the embodiment shown in FIGS. 56 to 59, the support brace 1016 comprises a generally triangular member that extends substantially perpendicularly from both the support flange 1012 and the upright member 1008.

The support flange 1012 preferably comprises one or more rack keyholes 1018. In the embodiment shown in FIGS. 59 and 60, the bracket 1002 has two rack keyholes 1018. The rack keyholes 1018 comprise an enlarged portion 1020 and a locking portion 1022 and allow for the attachment of the rack surface 1004. The locking portion 1022 preferably has a smaller diameter than the enlarged portion 1020. The rack surface 1004 comprises one or more rack protrusions 1024. For example, in the embodiment shown in FIGS. 59 and 60, the rack surface 1004 comprises four rack protrusions 1024. The rack protrusions 1024 preferably comprise an enlarged rack knob 1026 attached to a stem 1028. The stem 1028 is attached to the surface of the rack surface 1004. The rack knob 1026 preferably has a diameter that is less than that of the enlarged portion 1020 of the rack keyhole 1018, but greater than that of the locking portion 1022. The stem 1028 preferably has a diameter that is less than that of both the enlarged portion 1020 and the locking portion 1022. In order to attach the rack surface 1004 to the bracket 1002, the rack knobs 1026 are first inserted through the enlarged portions 1020. Then, the rack surface 1004 is moved laterally with respect to the brackets 1002 such that the stems 1028 are now within the locking portions 1022. Because the rack knobs 1026 have a greater diameter than that of the locking portions 1022, the rack surface 1004 is generally secured in place vertically.

Referring to FIG. 56, two or more shelving racks 1000 may be arranged on top of each other. Because of the arrangement of the slots 188 on the corner columns 100, 101, 102, 103, the vertical positions of the shelving racks 1000 may be adjusted in numerous ways. Where the rack surface 1004 is a wire rack, various tools or implements may be inserted through the shelving racks 1000. For example, a rake or broom (not shown) may be threaded through the shelving racks 1000 in order to hold the rake or broom in a substantially vertically orientation.

The attachment flange 1010 may further comprise one or more rack pin openings 1030 to allow the insertion of accessory pin 500. The accessory pin 500 helps to secure the shelving rack 1000 to the corner columns 100, 101, 102, 103 and prevents the unintended detachment of the shelving rack 1000 from the corner columns 100, 101, 102, 103. The function of the accessory pin 500 will be described later.

The shelving racks 1000 described above are generally suitable for corner columns 100, 101, 102, 103 where the central portion 184 is substantially planar. In other embodiments of the corner columns 100, 101, 102, 103, the central portion 184 may not be necessarily substantially planar. For example, in the embodiment shown in FIGS. 31 to 34 and previously described above, the central portion **184*e* comprises first and second angled surfaces 204, 206, with the first and second angled surfaces 204, 206 angled inwardly. Because of this geometry of the corner columns 100*e*, 101*e*, 102*e*, 103*e*, shelving racks 1000** will have to be altered accordingly.

Figure 61:
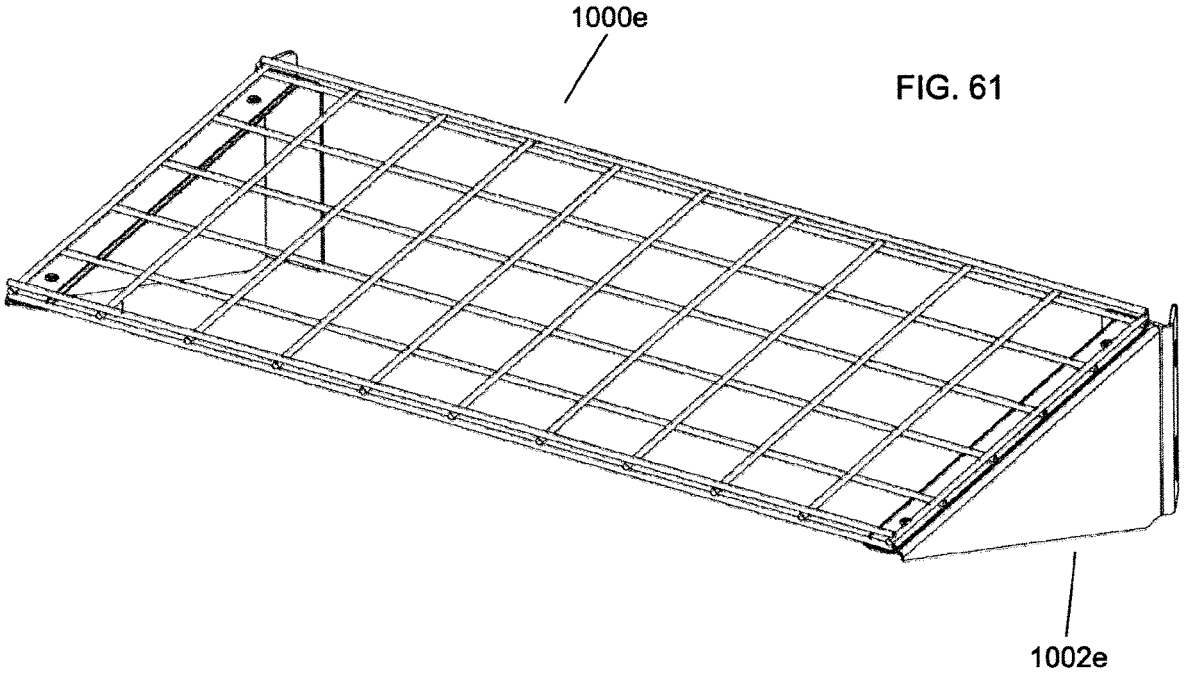
FIG. 61 is a perspective view of another embodiment of the shelving racks.
Figure 62:
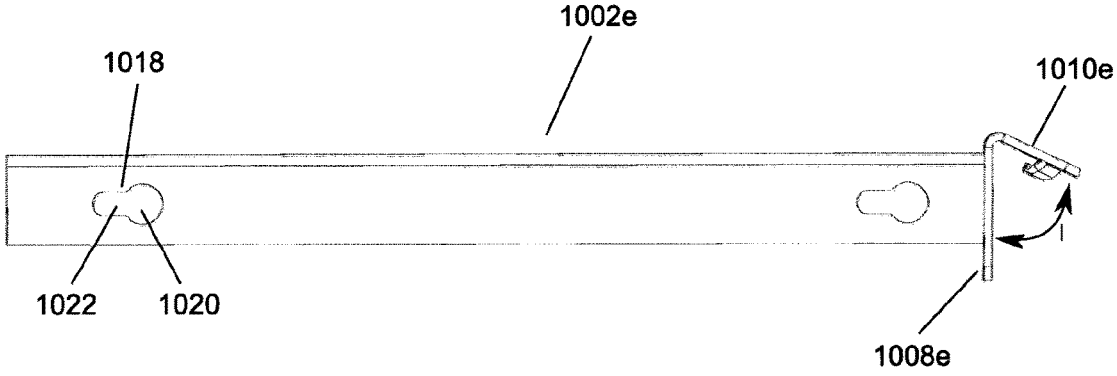
FIG. 62 is a top view of the bracket of the embodiment of FIG. 61.

FIGS. 61 and 62 show an embodiment of the shelving racks **1000*e* to accommodate corner columns 100*e*, 101*e*, 102*e*, 103*e* with inward-oriented first and second angled surfaces 204, 206. In this embodiment, the brackets 1002*e* are preferably altered to accommodate the first and second angled surfaces 204, 206. In particular, the attachment flange 1010*e* is no longer substantially perpendicular to the upright member 1008*e* but instead forms an acute angle I, as best shown in FIG. 62. This angle I preferably corresponds to the angles C, D between the opposed column walls 178 and the first or second angled surfaces 204, 206. This allows the upright member 1008*e* and the attachment flange 1010*e* to snugly fit over a portion of one of the corner columns 100*e*, 101*e*, 102*e*, 103*e*** for attachment.

Figure 63:
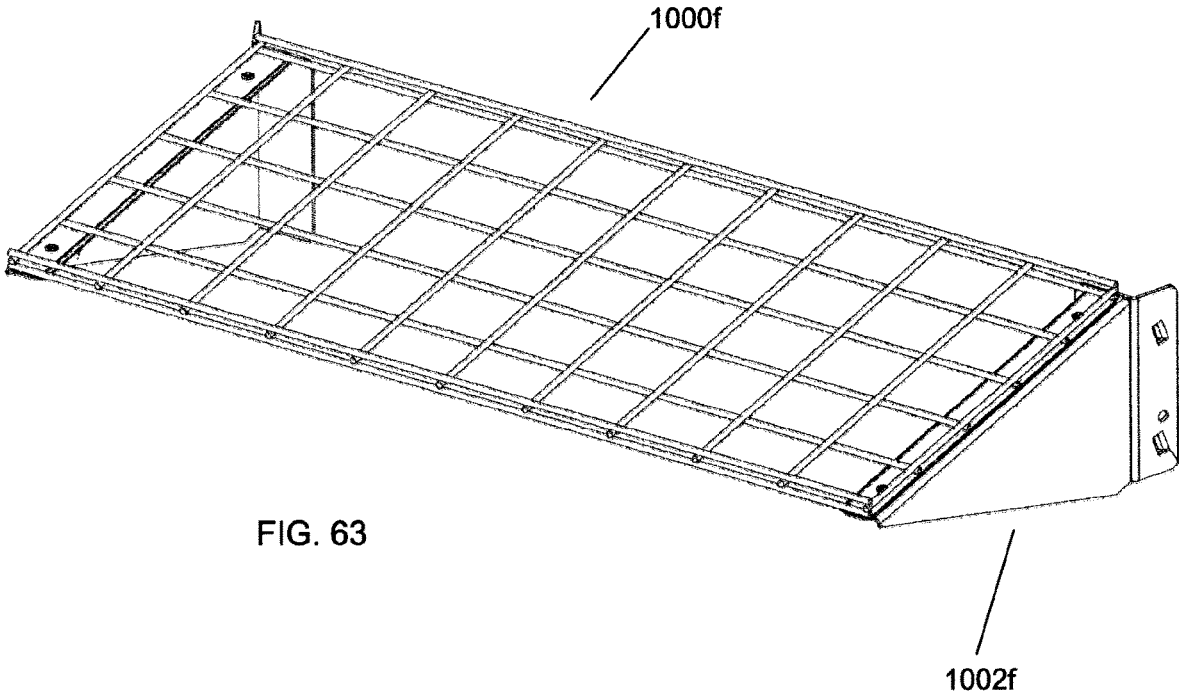
FIG. 63 is a perspective view of a further embodiment of the shelving racks.
Figure 64:
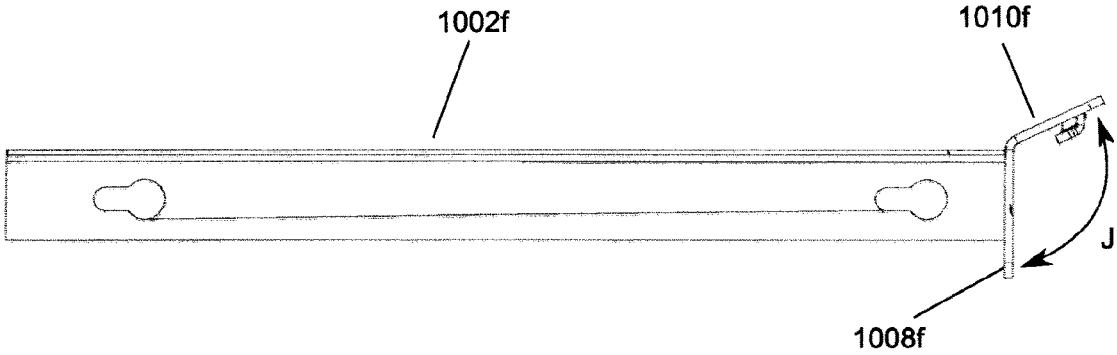
FIG. 64 is a top view of the bracket of the embodiment of FIG. 63.

In the embodiment shown in FIGS. 38 to 41 and previously described above, the central portion **184*f* comprises first and second angled surfaces 204*f*, 206*f*, with the first and second angled surfaces 204*f*, 206*f* angled outwardly. FIGS. 63 and 64 show another embodiment of the shelving racks 100*f* to accommodate such corner columns 100*f*, 101*f*, 102*f*, 103*f* with outward-oriented first and second angled surfaces 204*f*, 206*f*. In particular, the attachment flange 1010*f* of the bracket 1002*f* is no longer substantially perpendicular to the upright member 1008*f* but instead forms an obtuse angle J, as best shown in FIG. 64. This angle J preferably corresponds to the angles E, F between the opposed column walls 178 and the first or second angled surfaces 204*f*, 206*f*. This allows the upright member 1008*f* and the attachment flange 1010*f* to snugly fit over a portion of one of the corner columns 100*f*, 101*f*, 102*f*, 103*f*** for attachment.

Referring to FIGS. 65 to 70, one or more door assemblies 2000 for attachment to the corner columns 100, 101, 102, 103 are provided. The door assembly 2000 comprises a door panel 2002, one or more hinge pins 2004, and one or more hinge plates 2006.

Figure 68:
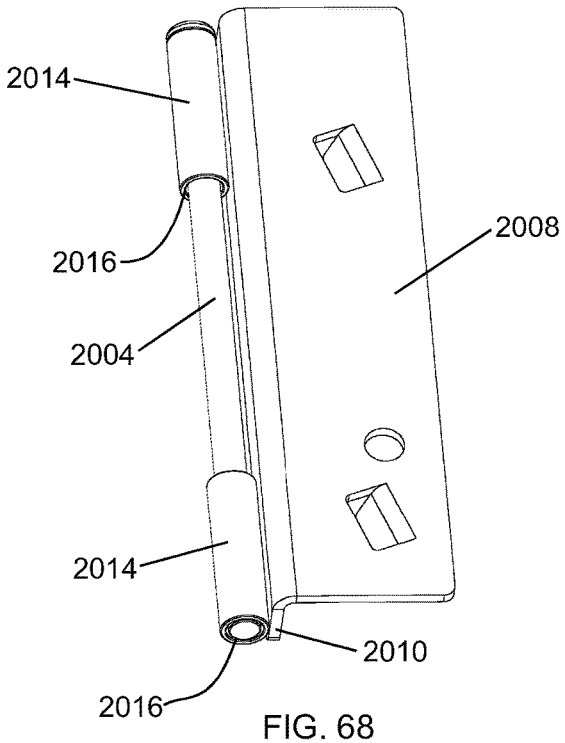
FIG. 68 is a front perspective view of the hinge pin and hinge plate of the door assembly of FIG. 64.
Figure 69:
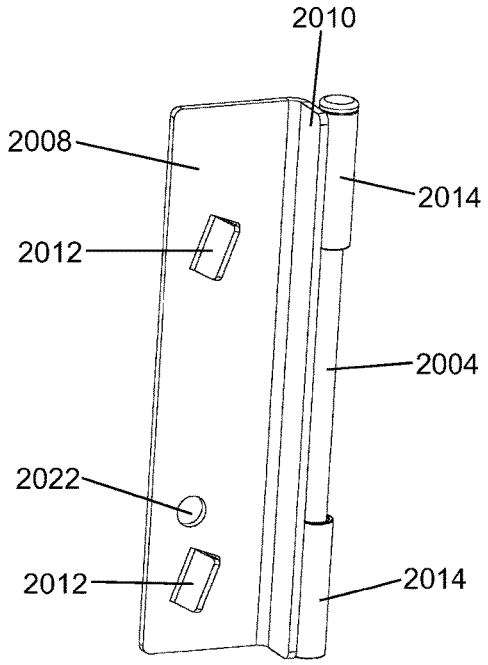
FIG. 69 is a rear perspective view of the hinge pin and hinge plate of FIG. 68.

Referring to FIGS. 68 and 69, the hinge plate 2006 comprises first and second hinge members 2008, 2010, preferably arranged substantially perpendicularly to each other. A plurality of hinge tabs 2012 extend from the first hinge member 2008. The hinge tabs 2012 are adapted to fit within the slots 188 to provide for secure attachment of the hinge plate 2006 to one of the corner columns 100, 101, 102, 103. When the hinge plate 2006 is attached to the corner column 100, 101, 102, 103, the first hinge member 2008 preferably sits against the central portion 184 (with the hinge tabs 2012 fitted within slots 188). The second hinge member 2010 preferably rests against one of the column walls 178, acting as a form of brace for the hinge plate 2006.

The hinge plate 2006 preferably further comprises one or more first knuckles 2014. The first knuckles 2014 comprise a first tubular opening 2016 through which the hinge pin 2004 may be inserted.

The door panel 2002 preferably comprises one or more second knuckles 2018. The second knuckles 2018 comprise a second tubular opening 2020 through which the hinge pin 2004 may be inserted.

Figure 70:
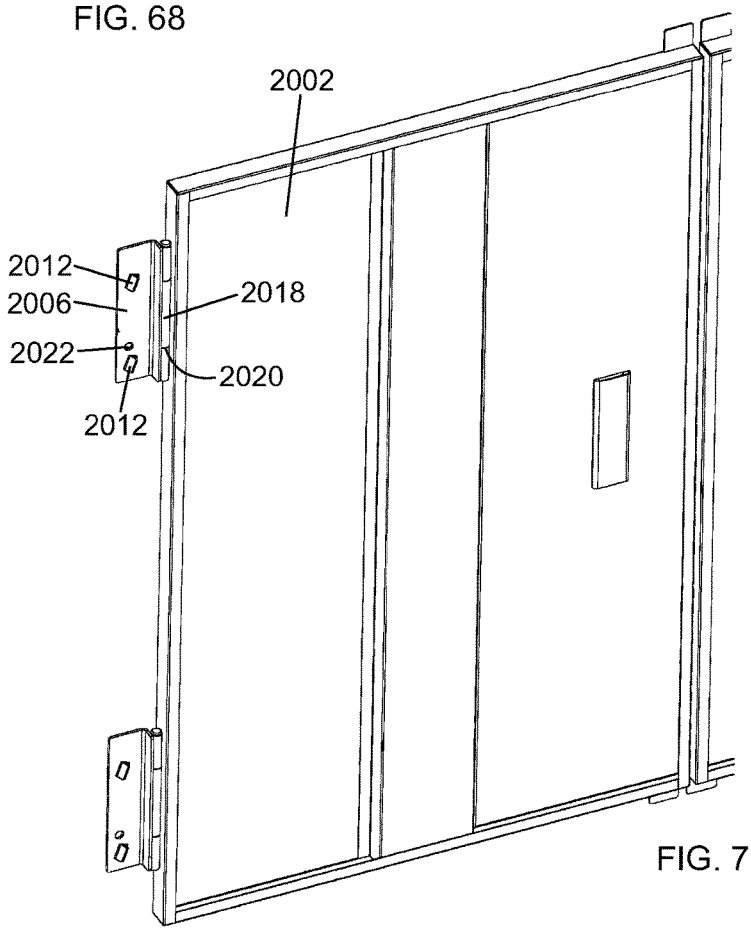
FIG. 70 is a partial view of the door assembly of FIG. 66.
Figure 71:
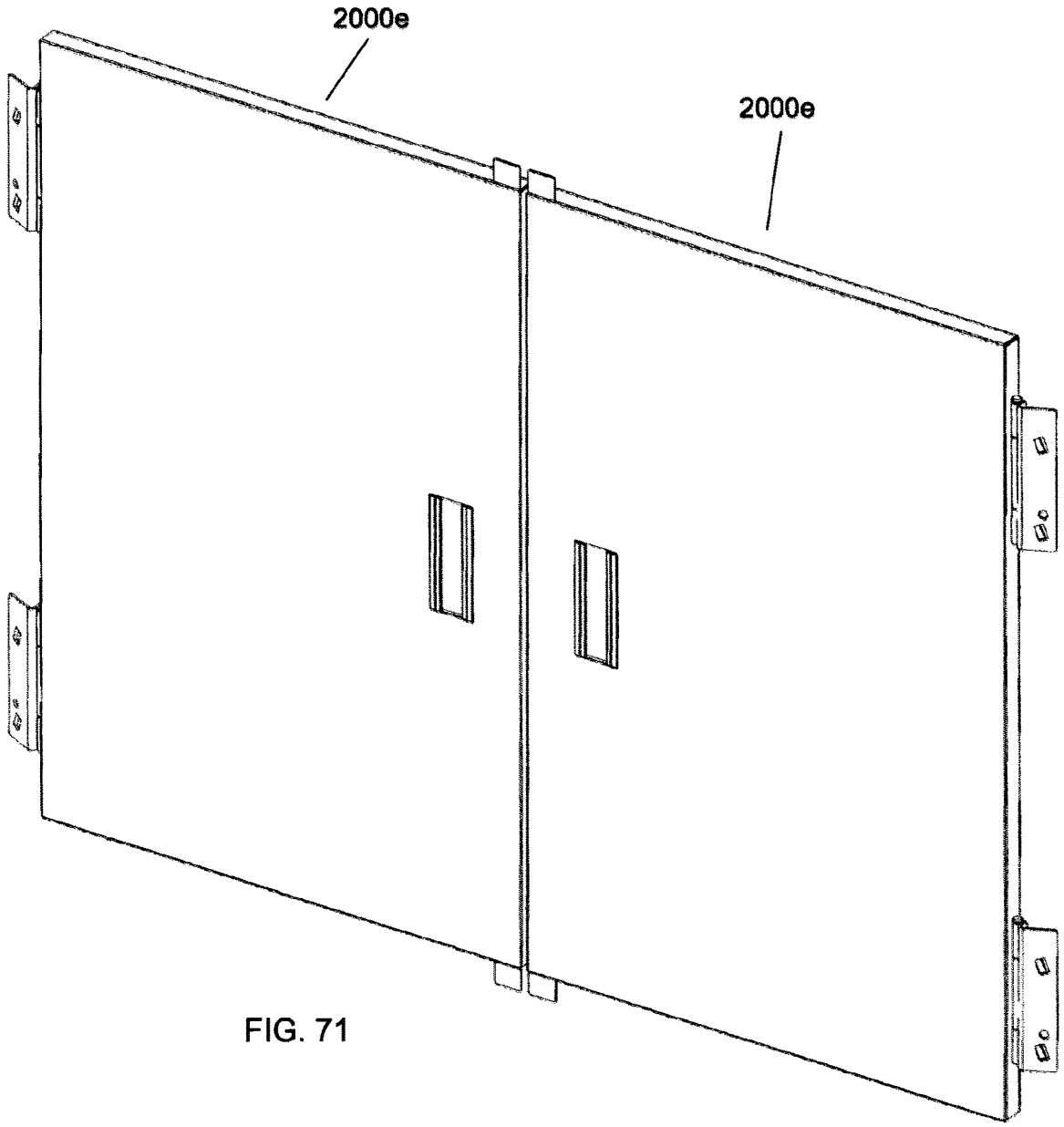
FIG. 71 is a front perspective view of another embodiment of two door assemblies.
Figure 72:
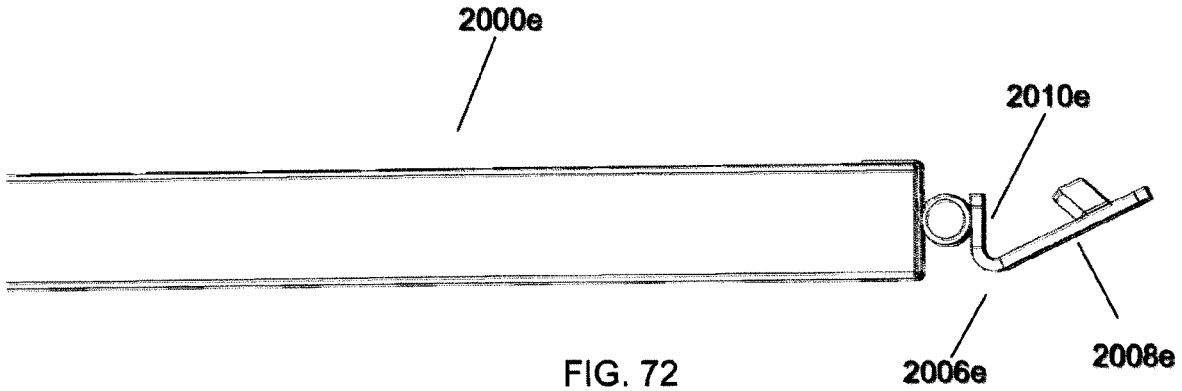
FIG. 72 is a top partial view of the door assembly of FIG. 71.
Figure 73:
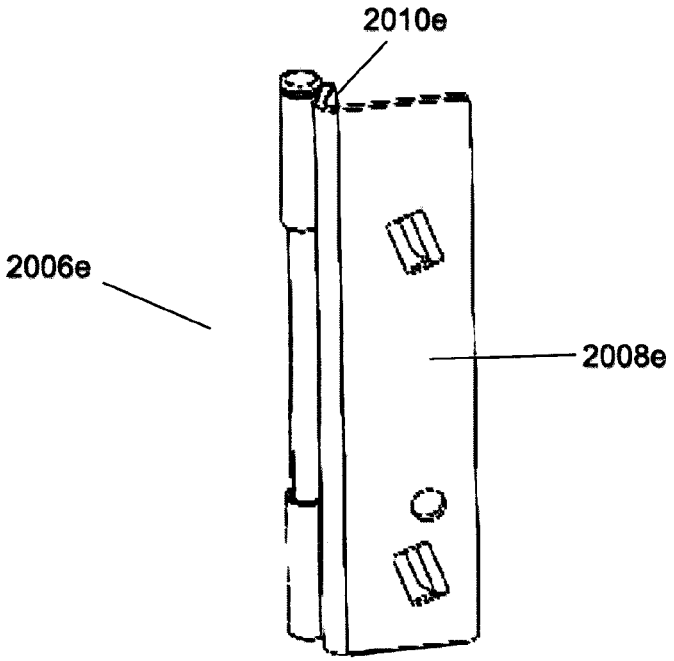
FIG. 73 is a perspective view of the hinge pin and hinge plate of the door assembly of FIG. 72.

As shown in FIG. 70, the hinge pin 2004 is inserted through the first and second tubular openings 2016, 2020 in order to attach the door panel 2002 to the hinge plate 2006, while at the same time allowing for pivotable movement of the door panel 2002 with respect to the hinge plate 2006.

The first hinge member 2008 may further comprise one or more hinge plate openings 2022 to allow the insertion of accessory pin 500. The accessory pin 500 helps to secure the hinge plate 2006 to the corner columns 100, 101, 102, 103 and prevents the unintended detachment of the hinge plate 2006 from the corner columns 100, 101, 102, 103, as described later.

Figure 65:
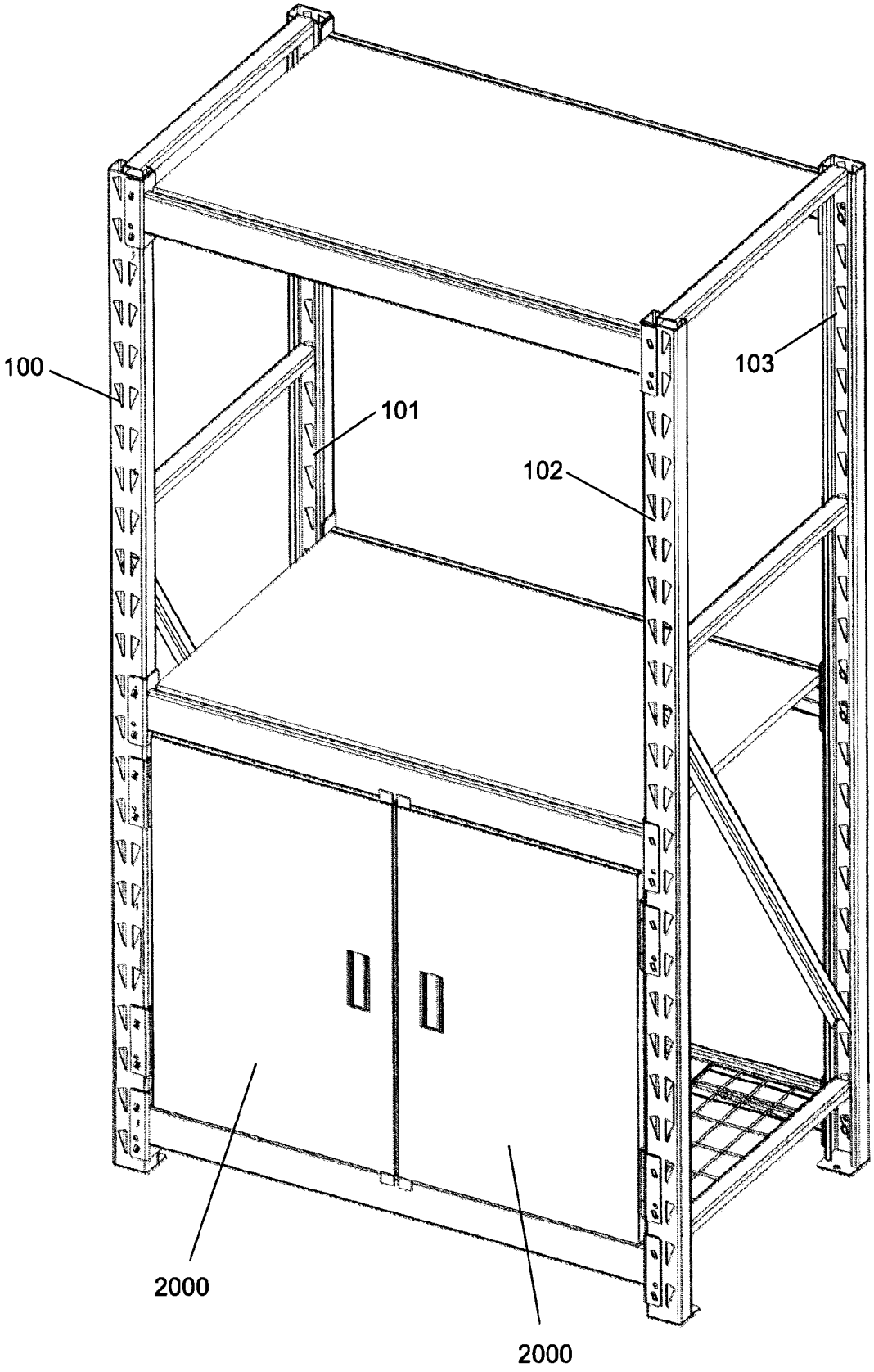
FIG. 65 is a front perspective view of a shelving system with two door assemblies.
Figure 66:
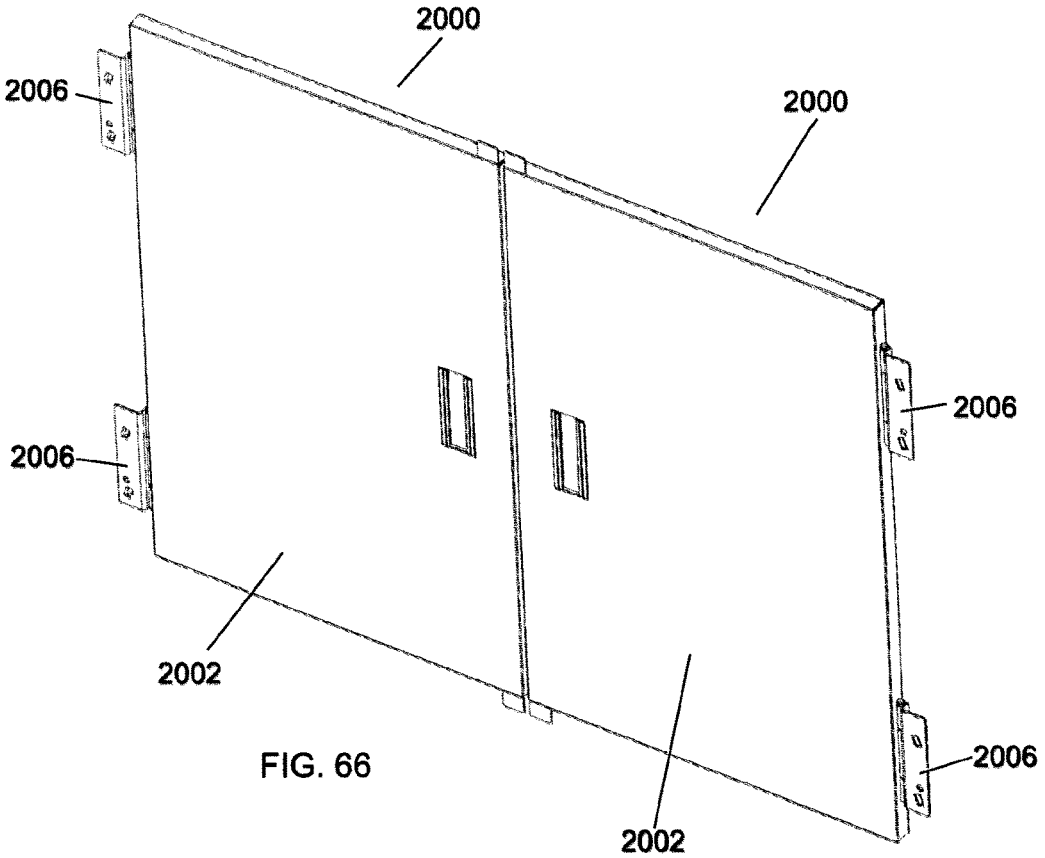
FIG. 66 is a front perspective view of the two door assemblies of FIG. 65.
Figure 67:
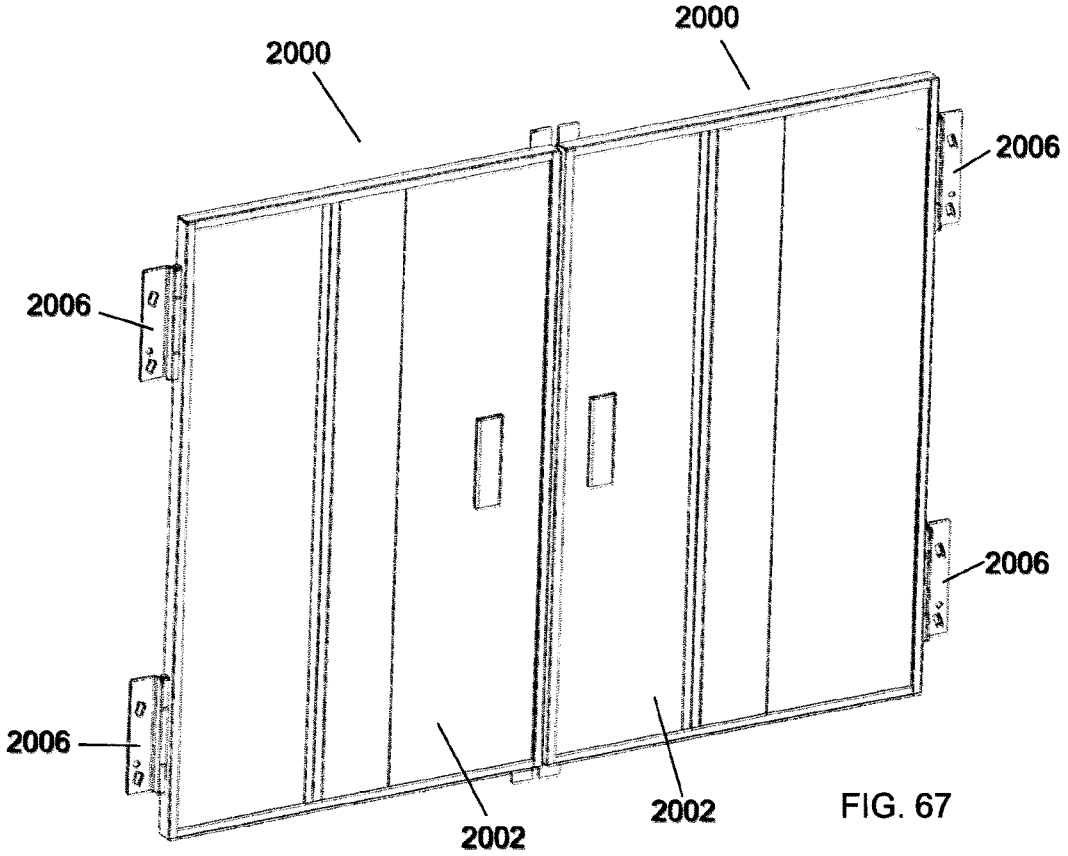
FIG. 67 is a rear perspective view of the two door assemblies of FIG. 66.

As shown in FIG. 65, two door assemblies 2000 may be arranged on opposed corner columns (e.g. corner columns 100 and 102) so that a portion of the front of the shelving system 10 is covered by the door assemblies 2000. Because a plurality of the slots 188 are arranged vertically on the corner columns 100, 101, 102, 103, the vertical positions of the door assemblies 2000 may be adjusted. For example, the door assemblies 2000 may be moved either higher or lower on the shelving system 10 by detaching the door assemblies 2000 from the corner columns 100, 101, 102, 103 and re-attaching them on the corner columns 100, 101, 102, 103 using slots 188 that are either higher or lower, respectively.

Figure 74:
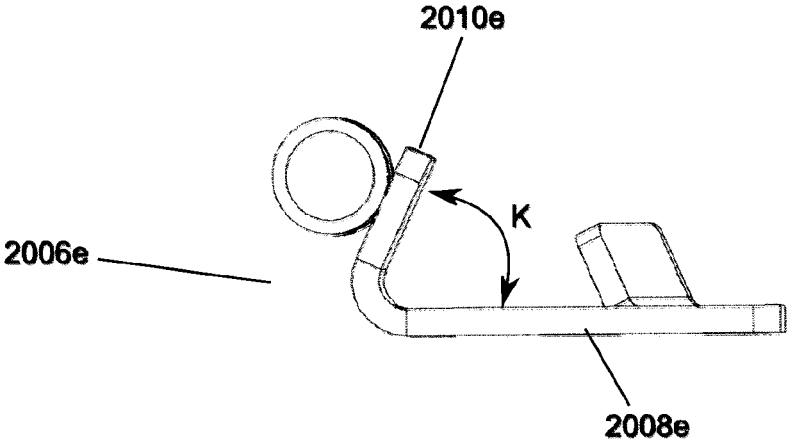
FIG. 74 is a top view of the hinge pin and hinge plate of FIG. 72.
Figure 75:
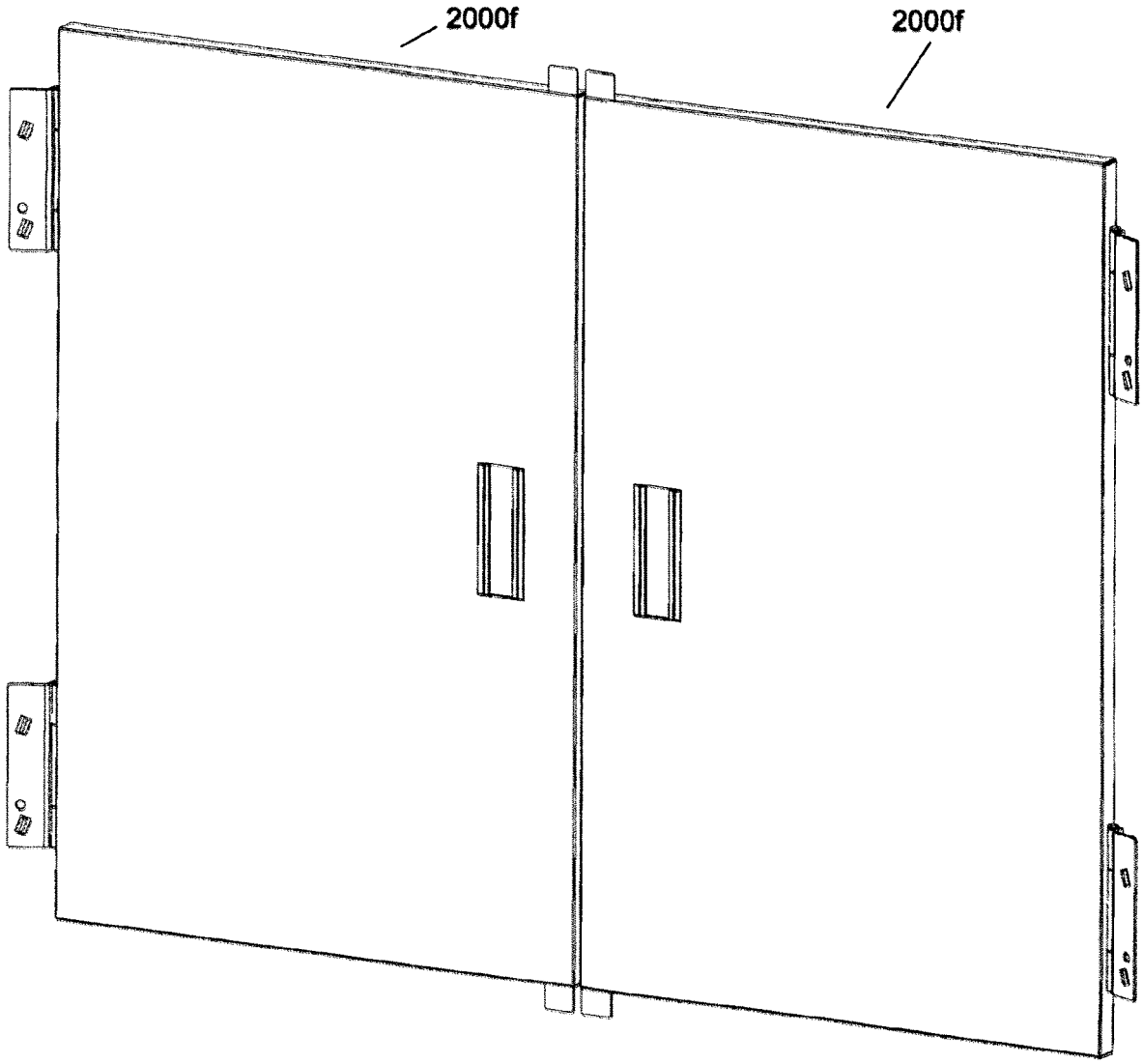
FIG. 75 is a front perspective view of a further embodiment of two door assemblies.
Figure 76:
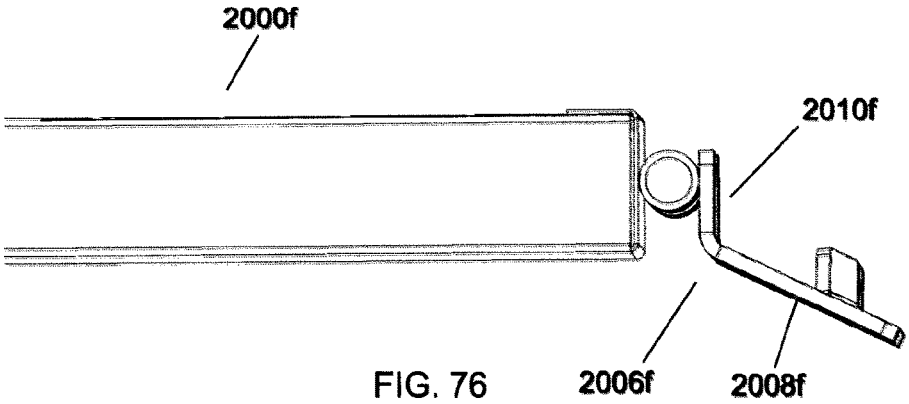
FIG. 76 is a top partial view of the door assembly of FIG. 74.

FIGS. 71 to 74 show another embodiment of the door assemblies 2000*e* to accommodate the situation where the corner columns 100*e*, 101*e*, 102*e*, 103*e* are in the embodiment shown in FIGS. 31 to 34 and described earlier (i.e. the first and second angled surfaces 204, 206 are angled inwardly). In this embodiment, the hinge plates 2006*e* are altered to accommodate the altered geometry of the corner columns 100*e*, 101*e*, 102*e*, 103*e*. In particular, the first and second hinge members 2008*e*, 2010*e* are no longer substantially perpendicular to each other, but now form an acute angle K, as best seen in FIG. 74. This angle K preferably corresponds to the angles C, D between the opposed column walls 178 and the first or second angled surfaces 204, 206. This allows the first hinge member 2008*e* to fit snugly over the corner columns 100*e*, 101*e*, 102*e*, 103*e* for attachment.

Figure 77:
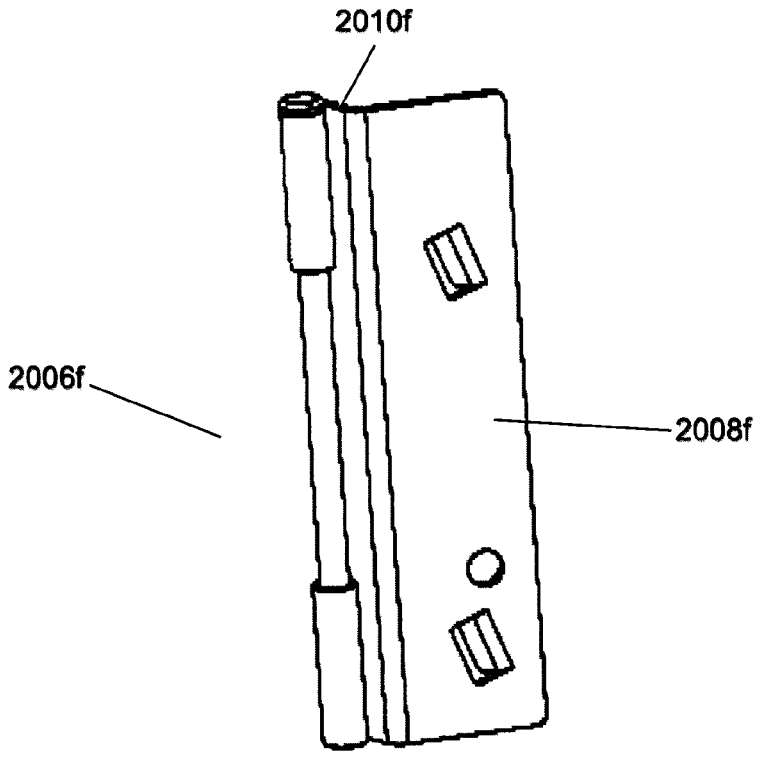
FIG. 77 is a perspective view of the hinge pin and hinge plate of the door assembly of FIG. 76.
Figure 78:
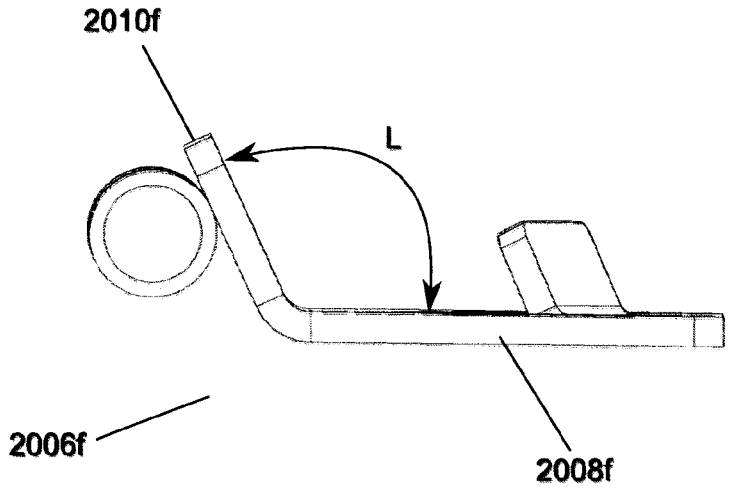
FIG. 78 is a top view of the hinge pin and hinge plate of FIG. 76.

FIGS. 75 to 78 show another embodiment of the door assemblies 2000*f* to accommodate the situation where the corner columns 100*f*, 101*f*, 102*f*, 103*f* are in the embodiment shown in FIGS. 38 to 41 and described earlier (i.e. the first and second angled surfaces 204*f*, 206*f* are angled outwardly). In this embodiment, the hinge plates 2006*f* are altered to accommodate the altered geometry of the corner columns 100*f*, 101*f*, 102*f*, 103*f*. In particular, the first and second hinge members 2008*f*, 2010*f* are no longer substantially perpendicular to each other, but now form an obtuse angle L, as best seen in FIG. 77. This angle L preferably corresponds to the angles E, F between the opposed column walls 178 and the first or second angled surfaces 204*f*, 206*f*. This allows the first hinge member 2008*f* to fit snugly over the corner columns 100*f*, 101*f*, 102*f*, 103*f* for attachment.

Figure 79:
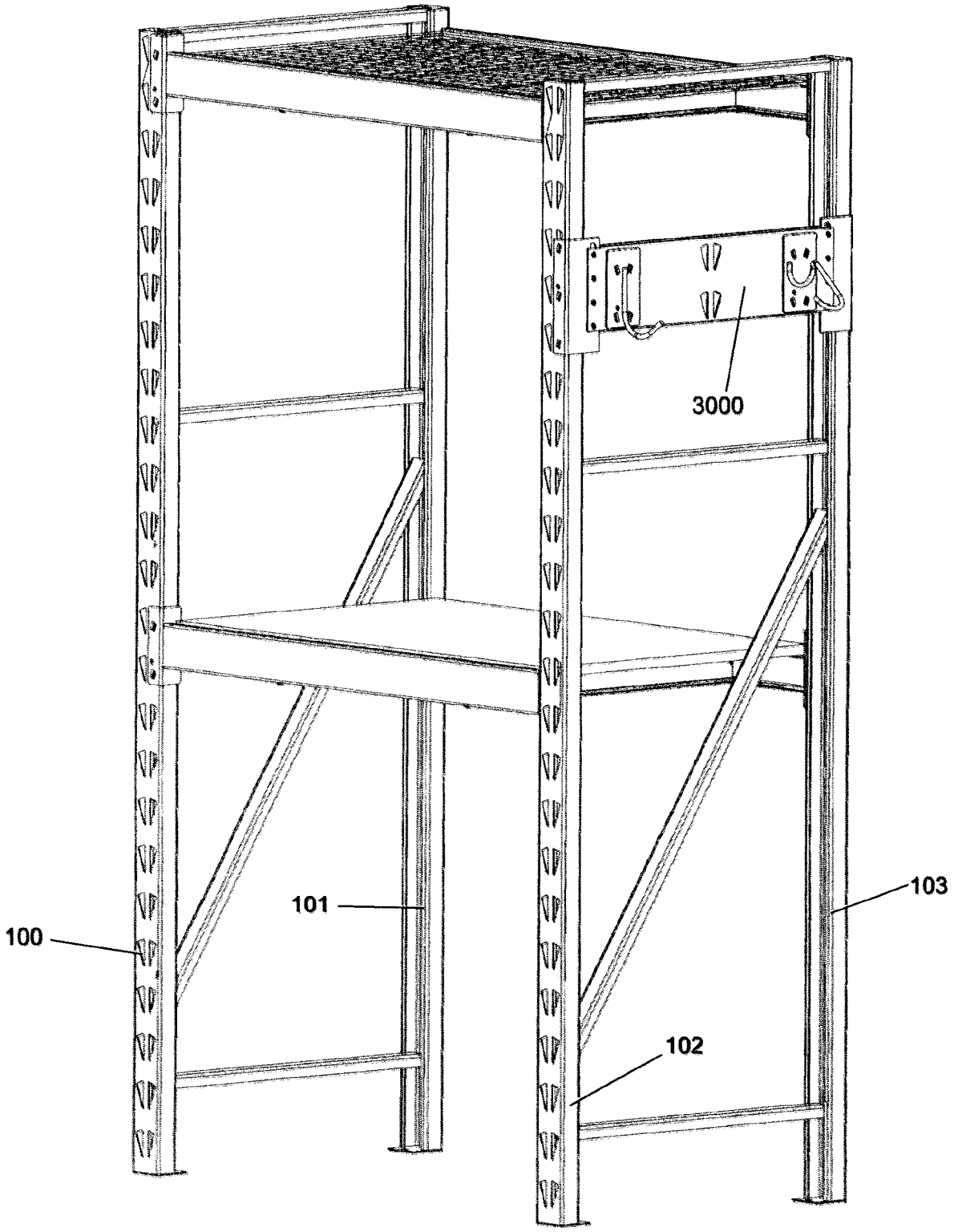
FIG. 79 is a front perspective view of a shelving system with a hook plate.
Figure 80:
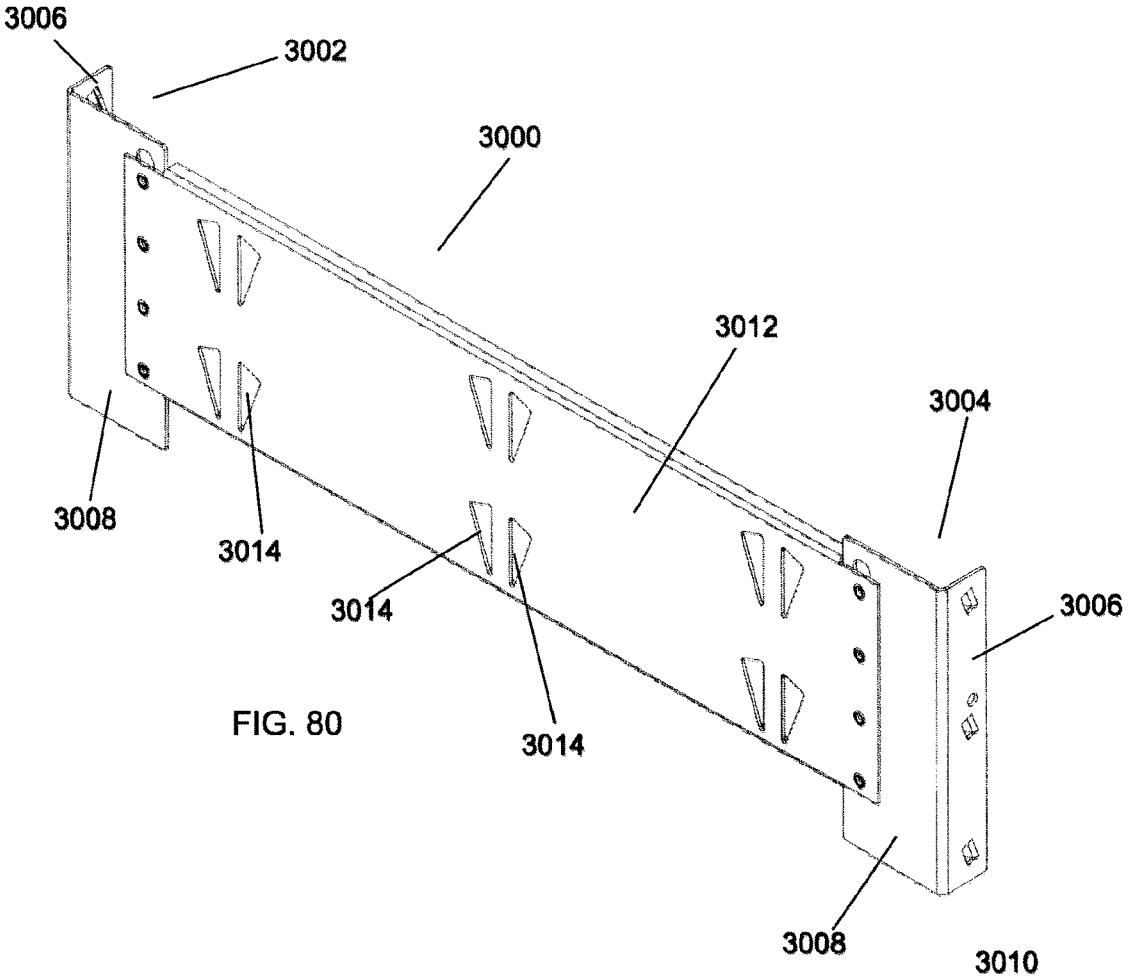
FIG. 80 is a front perspective view of the hook plate of FIG. 79.
Figure 81:
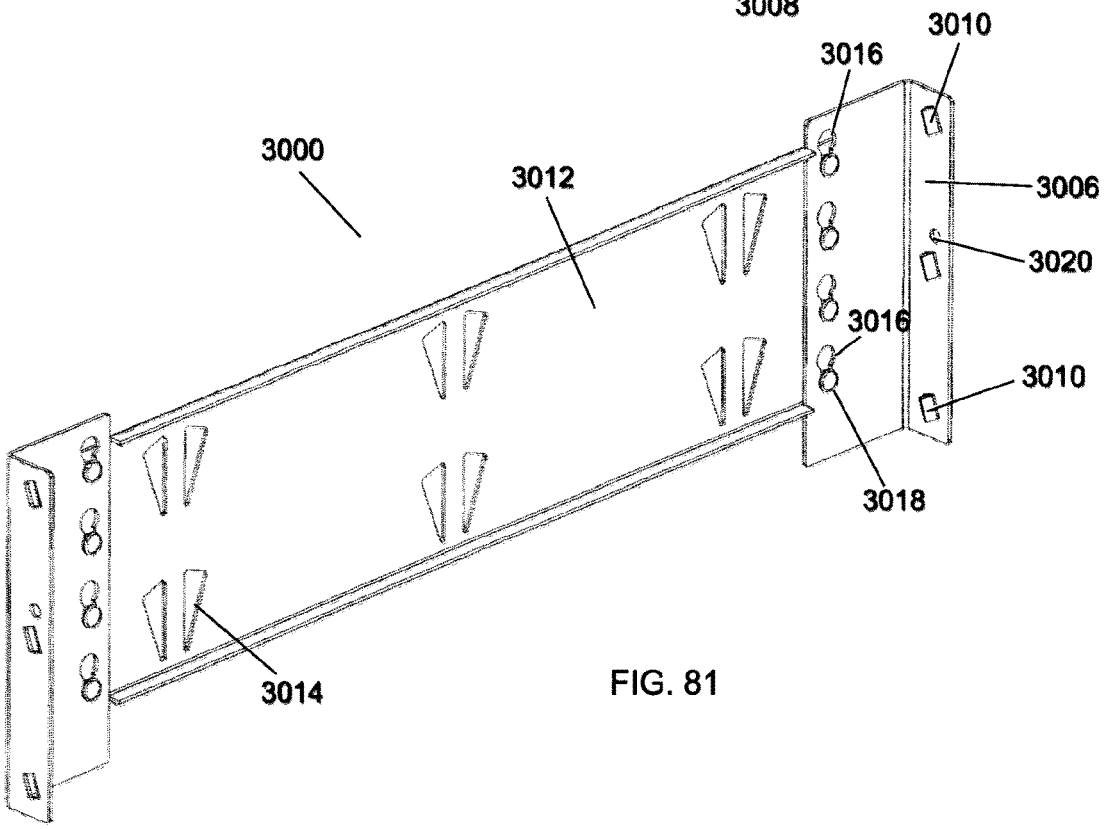
FIG. 81 is a rear perspective view of the hook plate of FIG. 80.

Referring to FIGS. 79 to 81, one or more hook plates 3000 for attachment to the corner columns 100, 101, 102, 103 are provided. In the example shown in FIG. 79, the hook plate 3000 is attached to corner columns 102 and 103. However, it is understood that the hook plate 3000 may also be attached to corner columns 100 and 101.

Referring to FIGS. 80 and 81, the hook plate 3000 comprises first and second plate ends 3002, 3004. Each of the first and second plate ends 3002, 3004 comprises a plate attachment member 3006 and a plate support member 3008. The plate attachment member 3006 is preferably arranged substantially perpendicularly from the plate support member 3008. A plurality of plate tabs 3010 extends from the plate attachment member 3006. The plate tabs 3010 are adapted to fit within the slots 188 to provide for secure attachment of the hook plate 3000 to the corner columns 100, 101, 102, 103. When the hook plate 3000 is attached to the corner columns 100, 101, 102, 103, the plate attachment member 3006 preferably sits against the central portion 184 (with the plate tabs 3010 fitted within slots 188). The plate support member 3008 preferably rests against one of the column walls 178, acting as a form of brace for the plate ends 3002, 3004.

A central plate 3012 extends between the first and second plate ends 3002, 3004. One or more central plate slots 3014 are preferably formed on the central plate 3012. When the hook plate 3000 is attached to the corner columns (e.g. at corner columns 100 and 101), the central plate 3012 spans for substantially the depth of the shelving system 10. The central plate slots 3014 now face away from the sides of the shelving system 10, in a direction that is substantially perpendicular to the direction of the slots 188. This allows for hooks or other items to be attached to the central plate slots 3014 in a manner similar to that for the slots 188, except now these items may be attached to the sides of the shelving system 10.

The central plate 3012 may also be removably attached to the first and second plate ends 3002, 3004. As with the shelving racks 2000, the first and second plate ends 3002, 3004 may comprise one or more plate keyholes 3016, and the central plate 3012 may comprise one or more plate protrusions 3018. The attachment of the central plate 3012 to the first and second plate ends 3002, 3004 would be similar to that of the rack surface 1004 to the bracket 1002 (through the use of the plate protrusion 3018 and the plate keyholes 3016).

The plate attachment member 3006 may further comprise one or more plate openings 3020 to allow the insertion of accessory pin 500. The accessory pin 500 helps to secure the hook plate 3000 to the corner columns 100, 101, 102, 103 and prevents the unintended detachment of the hook plate 3000 from the corner columns 100, 101, 102, 103, as described later.

Because of the arrangement of the slots 188, the vertical position of the hook plate 3000 may be adjusted.

Figure 82:
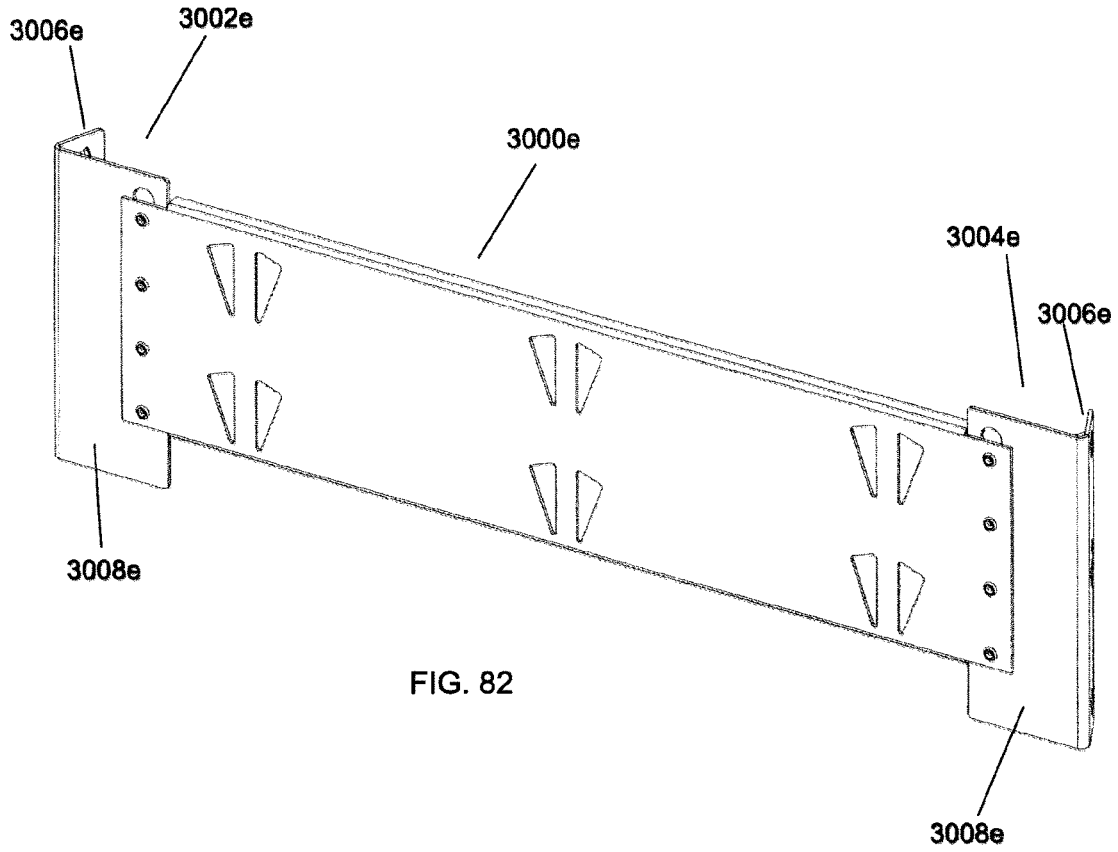
FIG. 82 is a perspective view of another embodiment of the hinge plate.
Figure 83:
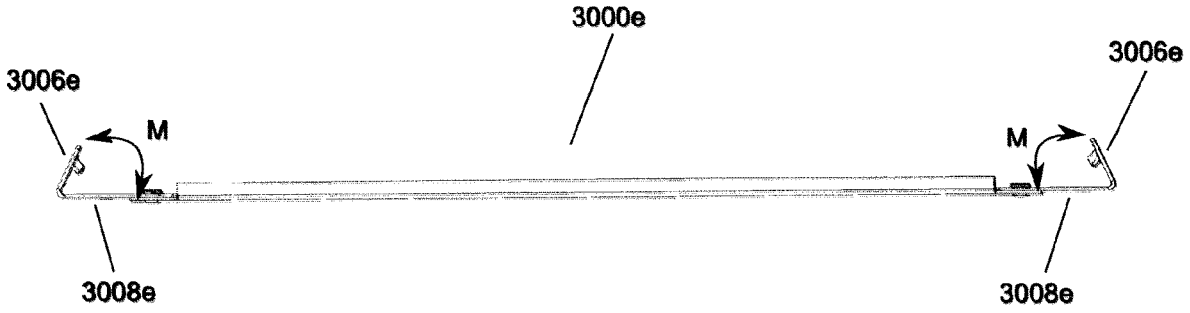
FIG. 83 is a top view of the hinge plate of FIG. 82.

FIGS. 82 to 83 show another embodiment of the hook plate 3000*e* to accommodate the situation where the corner columns 100*e*, 101*e*, 102*e*, 103*e* are in the embodiment shown in FIGS. 31 to 34 and described earlier (i.e. the first and second angled surfaces 204, 206 are angled inwardly). The first and second hook plate ends 3002*e*, 3004*e* are altered to accommodate the altered geometry of the corner columns 100*e*, 101*e*, 102*e*, 103*e*. In particular, the plate attachment member 3006*e* is no longer substantially perpendicular to the plate support member 3008*e*, but they now instead form an acute angle M, as best seen in FIG. 83. This angle M preferably corresponds to the angles C, D between the opposed column walls 178 and the first or second angled surfaces 204, 206. This allows the plate attachment member 3006*e* to fit over the corner columns 100*e*, 101*e*, 102*e*, 103*e* for attachment.

Figure 84:
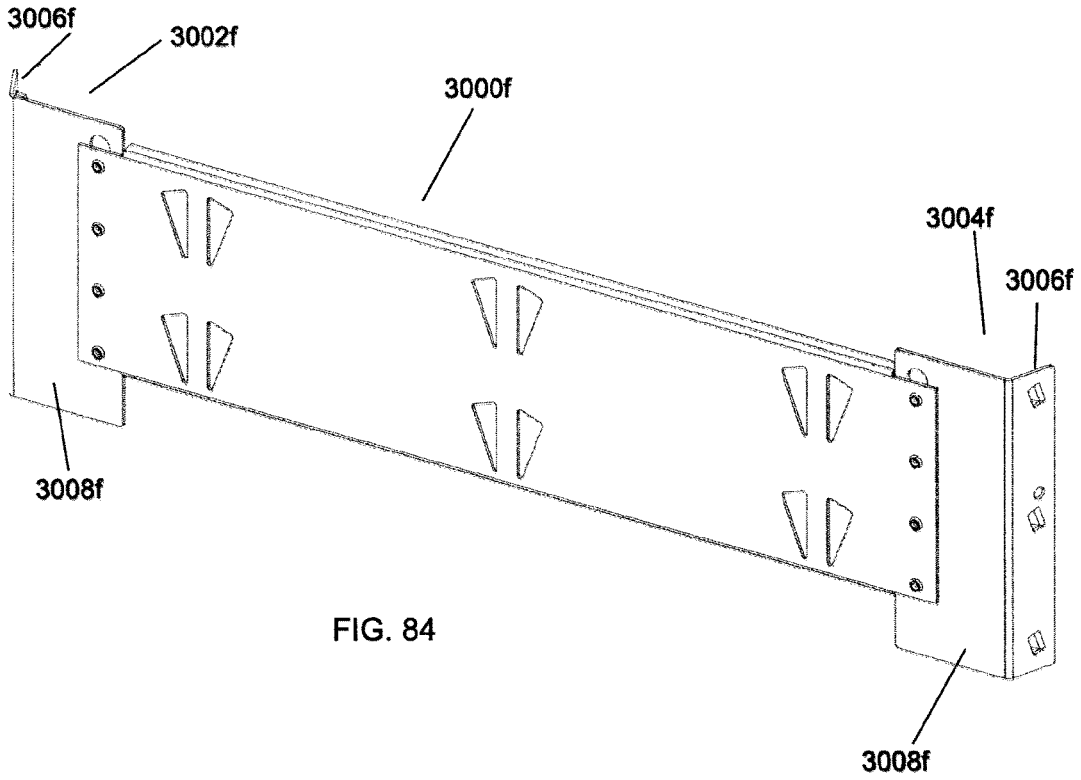
FIG. 84 is a perspective view of a further embodiment of the hinge plate.
Figure 85:
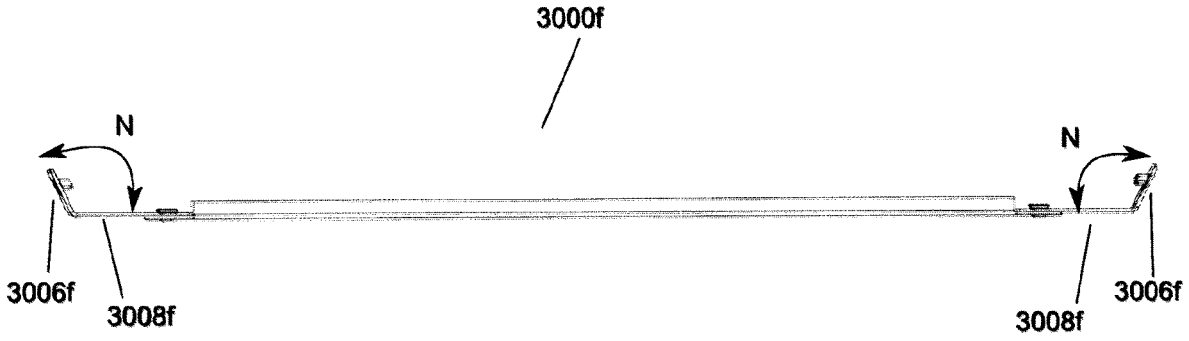
FIG. 85 is a top view of the hinge plate of FIG. 84.
Figure 86:
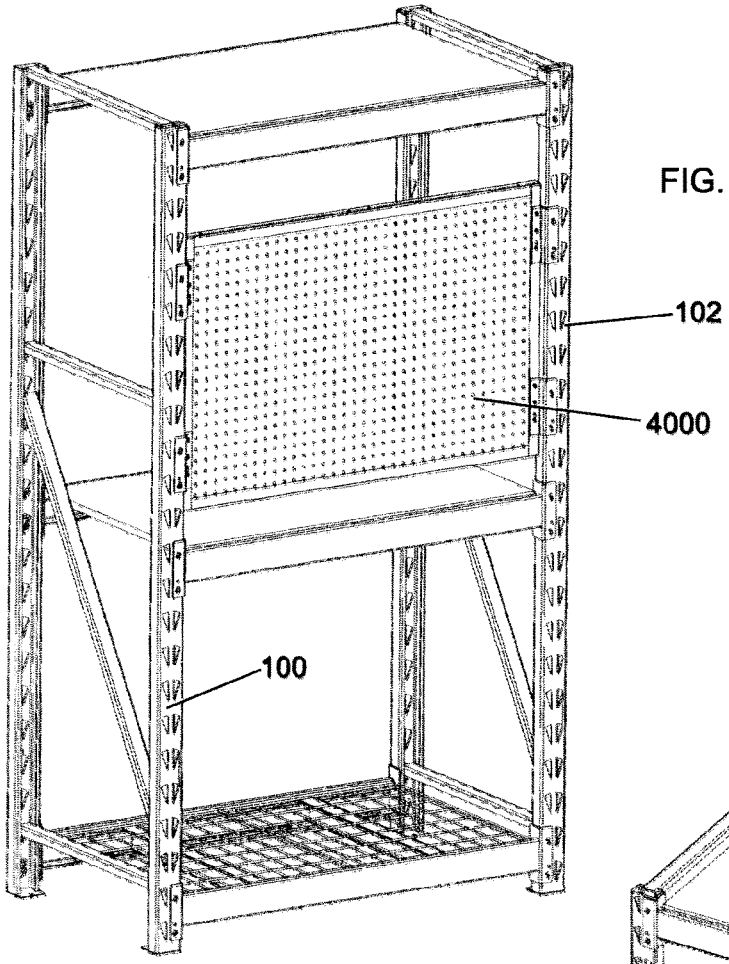
FIG. 86 is a front perspective view of a shelving system with a pegboard assembly.
Figure 87:
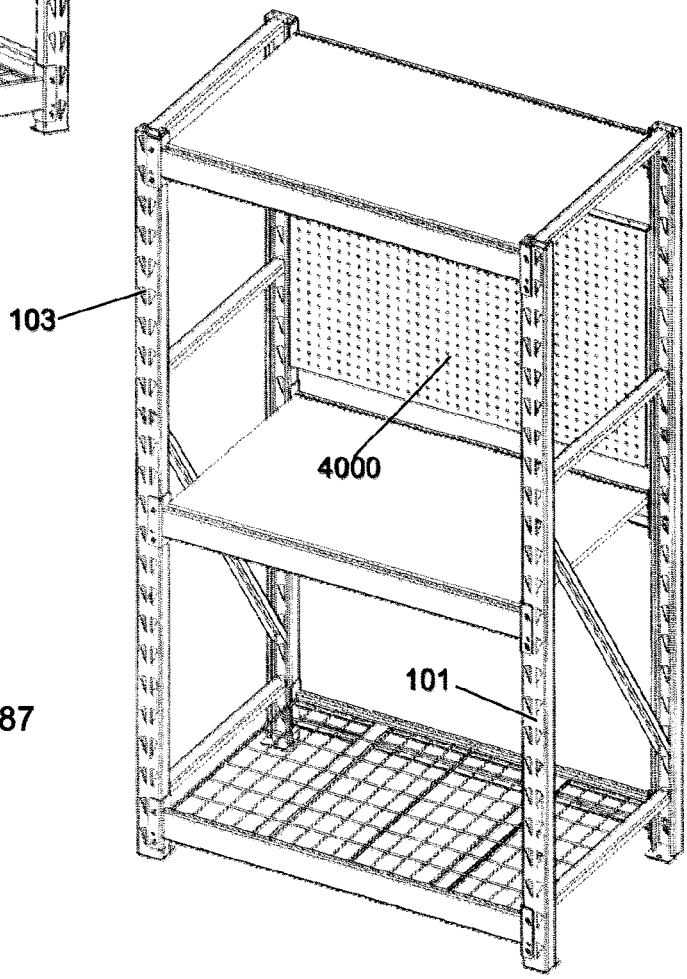
FIG. 87 is a rear perspective view of the shelving system of FIG. 86.
Figure 88:
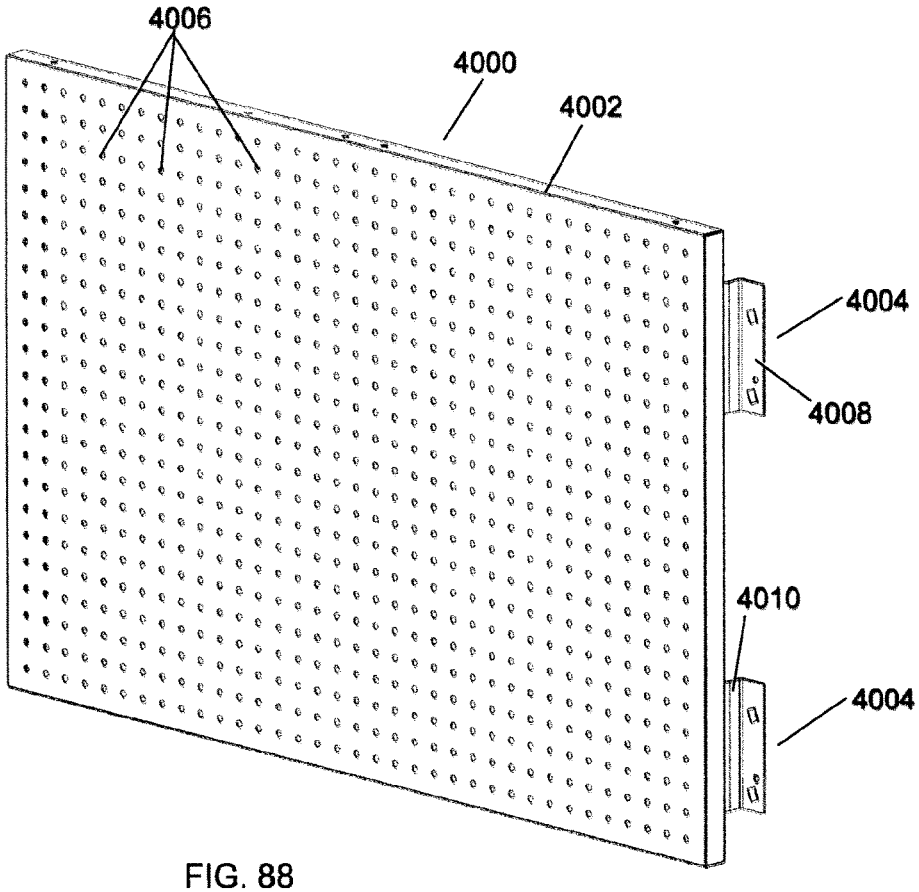
FIG. 88 is a front perspective view of the pegboard assembly of FIG. 86.
Figure 89:
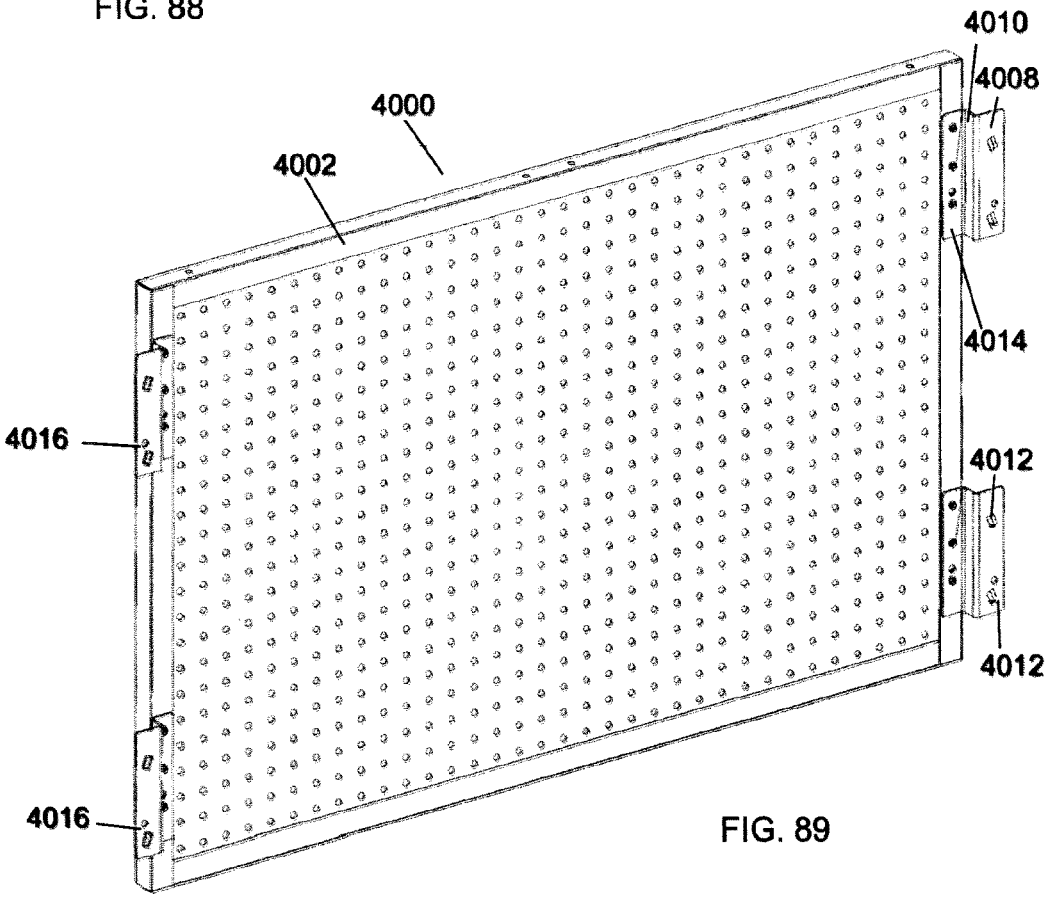
FIG. 89 is a rear perspective view of the pegboard assembly of FIG. 88.

FIGS. 84 to 85 show another embodiment of the hook plate 3000*f* to accommodate the situation where the corner columns 100*f*, 101*f*, 102*f*, 103*f* are in the embodiment shown in FIGS. 38 to 41 and described earlier (i.e. the first and second angled surfaces 204*f*, 206*f* are angled outwardly). The first and second hook plate ends 3002*f*, 3004*f* are altered to accommodate the altered geometry of the corner columns 100*f*, 101*f*, 102*f*, 103*f*. In particular, the plate attachment member 3006*f* is no longer substantially perpendicular to the plate support member 3008*f*, but they now instead form an obtuse angle N, as best seen in FIG. 85. This angle N preferably corresponds to the angles E, F between the opposed column walls 178 and the first or second angled surfaces 204*f*, 206*f*. This allows the plate attachment member 3006 to fit over the corner columns 100*f*, 101*f*, 102*f*, 103*f* for attachment.

Referring to FIGS. 86 to 89, one or more pegboard assemblies 4000 for attachment to the corner columns 100, 101, 102, 103 are provided. The pegboard assembly 4000 comprises a pegboard 4002 with one or more pegboard brackets 4004 arranged on a periphery of the pegboard 4002.

The pegboard 4002 preferably comprises a number of pegboard openings 4006 to allow for the attachment of various hooks or similar items. In the example shown in FIGS. 86 and 87, the pegboard assembly 4000 is attached to corner columns 100 and 102, although it is understood that the pegboard assembly 4000 may also be attached to corner columns 101 and 103.

The pegboard brackets 4004 comprise first and second bracket members 4008, 4010, preferably arranged substantially perpendicularly to each other. A plurality of bracket tabs 4012 extends from the first bracket member 4008. The bracket tabs 4012 are adapted to fit within the slots 188 to provide for secure attachment of the pegboard bracket 4004 to one of the corner columns 100, 101, 102, 103. When the pegboard bracket 4004 is attached to the corner columns 100, 101, 102, 103, the first bracket member 4008 preferably sits against the central portion 184 (with the bracket tabs 4012 fitted within the slots 188). The second bracket member 4010 preferably rests against one of the column walls 178, acting as a form of brace for the pegboard bracket 4004.

The pegboard bracket 4004 may comprise a third bracket member 4014 extending substantially perpendicularly from the second bracket member 4010. The pegboard 4002 may be attached to the third bracket member 4014. The attachment of the pegboard 4002 to the third bracket member 4014 may be by using keyholes and protrusions, similar to the attachment of the central plate 3012 to the first and second plate ends 3002, 3004 or the attachment of the rack surface 1004 to the bracket 1002.

The first bracket member 4008 may further comprise one or more bracket openings 4016 to allow the insertion of accessory pin 900. The accessory pin 900 helps to secure the pegboard bracket 4004 to the corner columns 100, 101, 102, 103 and prevents the unintended detachment of the pegboard bracket 4004 from the corner columns 100, 101, 102, 103, as described later.

Because of the arrangement of the slots 188, the vertical position of the pegboard brackets 4004 (and hence the pegboard assembly 4000) may be adjusted.

Where the pegboard assembly 4000 is not of sufficient width to span the entire width of the shelving system 10, two pegboard assemblies 4000, 4000' may be attached together, as shown in FIG. 90. The pegboard assemblies 4000, 4000' may be attached together using one or more pegboard ties 4018. The pegboard tie 4018 comprises a plurality of tie protrusions that are adapted to fit within pegboard keyholes located on the pegboard assemblies 4000, 4000'. The attachment of the pegboard tie 4018 to the pegboard assemblies 4000, 4000' would be similar to that of the rack surface 1004 to the bracket 1002 (through the use of the tie protrusions and the pegboard keyholes).

Figure 92:
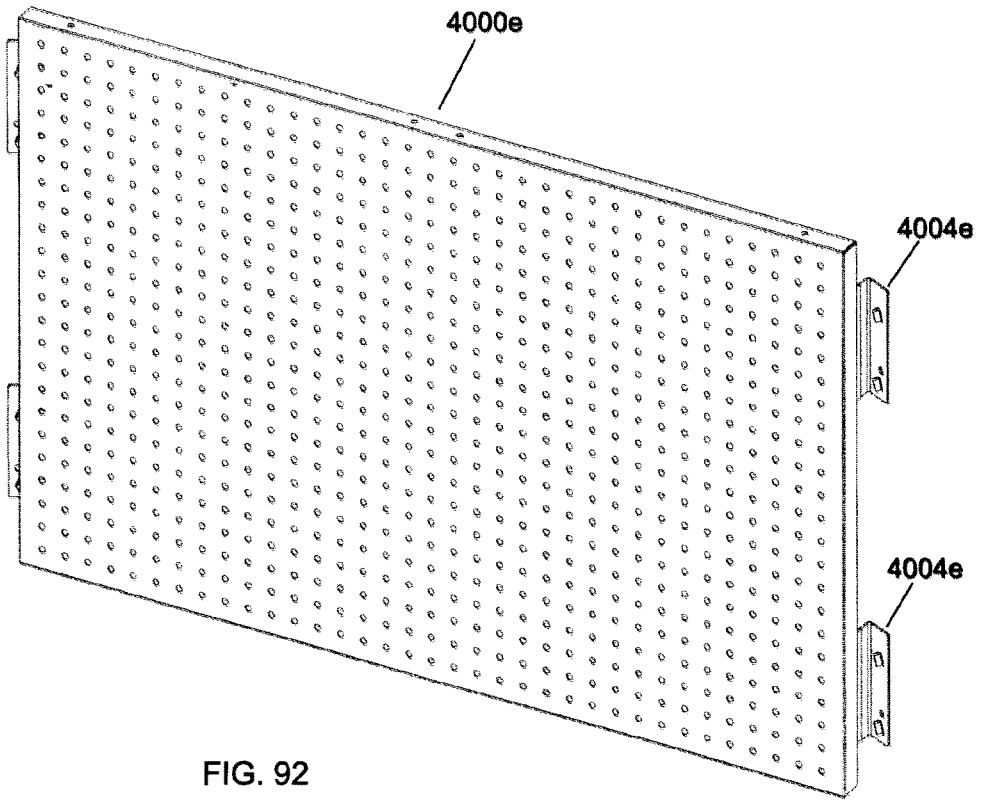
FIG. 92 is a front perspective view of the pegboard assembly of FIG. 91.
Figure 93:
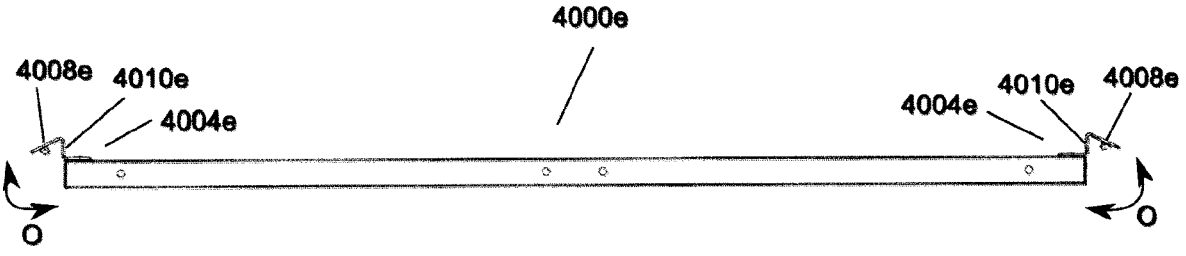
FIG. 93 is a top view of the pegboard assembly of FIG. 92.

FIGS. 91 to 93 show another embodiment of the pegboard assembly **4000*e* to accommodate the situation where the corner columns 100*e*, 101*e*, 102*e*, 103*e* are in the embodiment shown in FIGS. 31 to 34 and described earlier (i.e. the first and second angled surfaces 204, 206 are angled inwardly). The pegboard brackets 4004*e* are altered to accommodate the altered geometry of the corner columns 100*e*, 101*e*, 102*e*, 103*e*. In particular, the first and second bracket members 4008*e*, 4010*e* are no longer substantially perpendicular to each other, but now form an acute angle O, as best seen in FIG. 93. This angle O preferably corresponds to the angles C, D between the opposed column walls 178 and the first or second angled surfaces 204, 206. This allows the first bracket member 4008*e* to fit over the corner columns 100*e*, 101*e*, 102*e*, 103*e*** for attachment.

Figure 94:
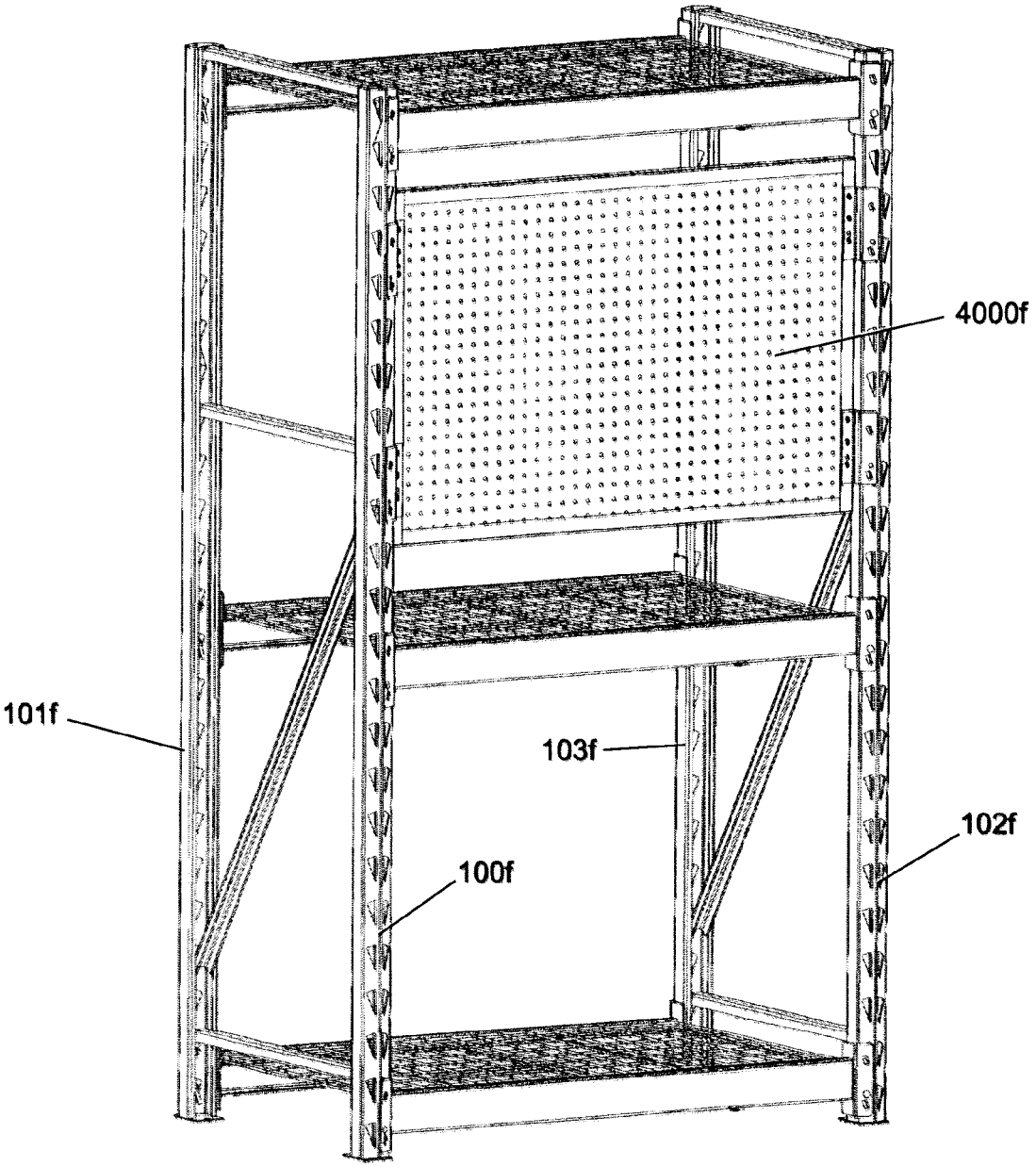
FIG. 94 is a front perspective view of a shelving system with a further embodiment of the pegboard assembly.
Figure 95:
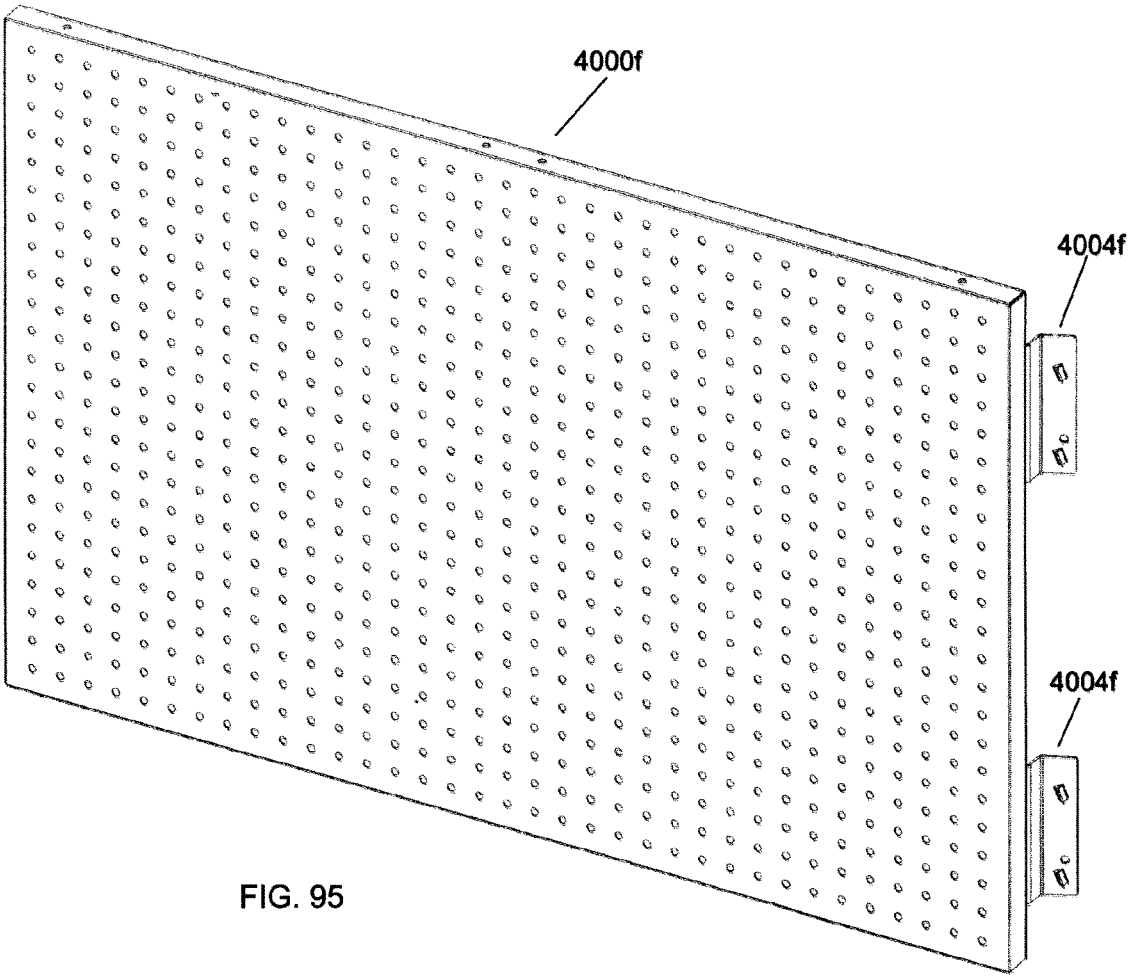
FIG. 95 is a front perspective view of the pegboard assembly of FIG. 94.
Figure 96:
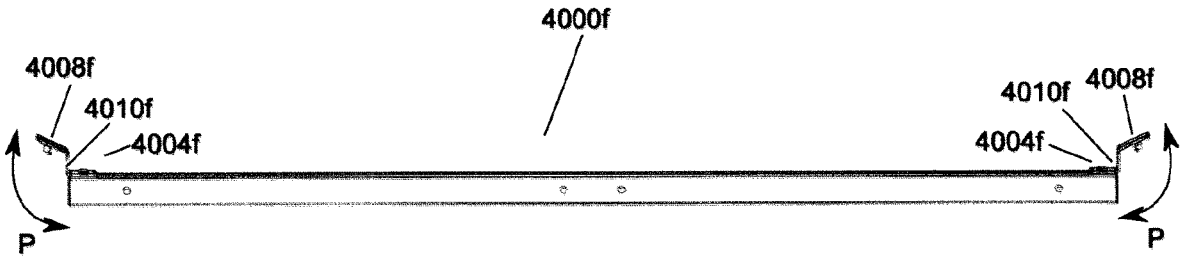
FIG. 96 is a top view of the pegboard assembly of FIG. 95.
Figure 97:
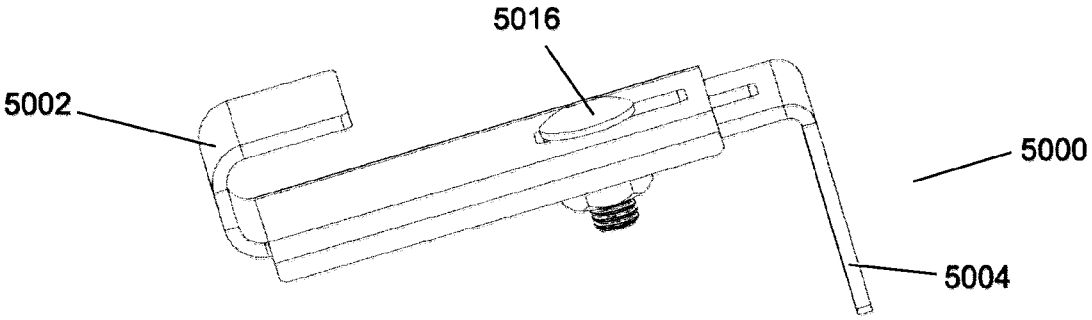
FIG. 97 is a perspective view of a wall tie for a shelving system in accordance with the invention.

FIGS. 94 to 96 show another embodiment of the pegboard assembly **4000*f* to accommodate the situation where the corner columns 100*f*, 101*f*, 102*f*, 103*f* are in the embodiment shown in FIGS. 38 to 41 and described earlier (i.e. the first and second angled surfaces 204*f*, 206*f* are angled outwardly). The pegboard brackets 4004*f* are altered to accommodate the altered geometry of the corner columns 100*f*, 101*f*, 102*f*, 103*f*. In particular, the first and second bracket members 4008*f*, 4010*f* are no longer substantially perpendicular to each other, but now form an obtuse angle P, as best seen in FIG. 96. This angle P preferably corresponds to the angles E, F between the opposed column walls 178 and the first or second angled surfaces 204*f*, 206*f*. This allows the first bracket member 4008*f* to fit over the corner columns 100*f*, 101*f*, 102*f*, 103*f*** for attachment.

Figure 100:
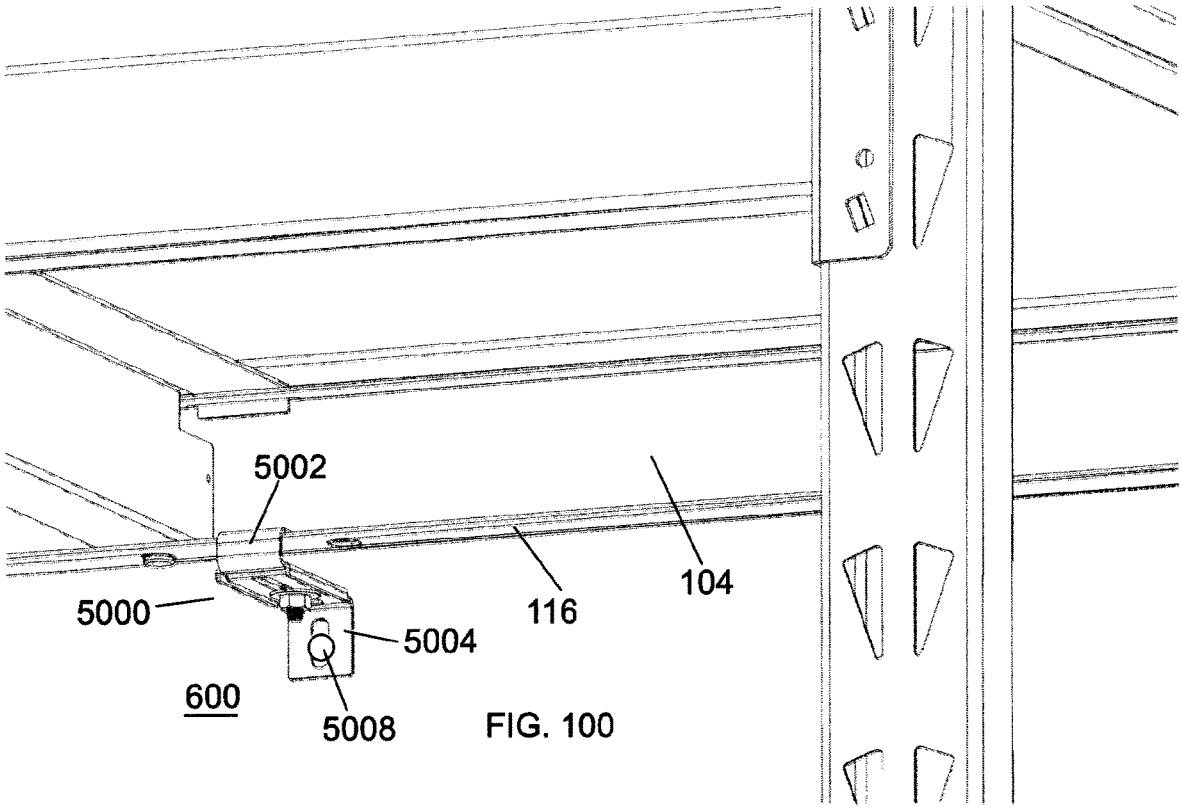
FIG. 100 is a partial perspective view showing a shelving system with the wall tie of FIG. 97.
Figure 101:
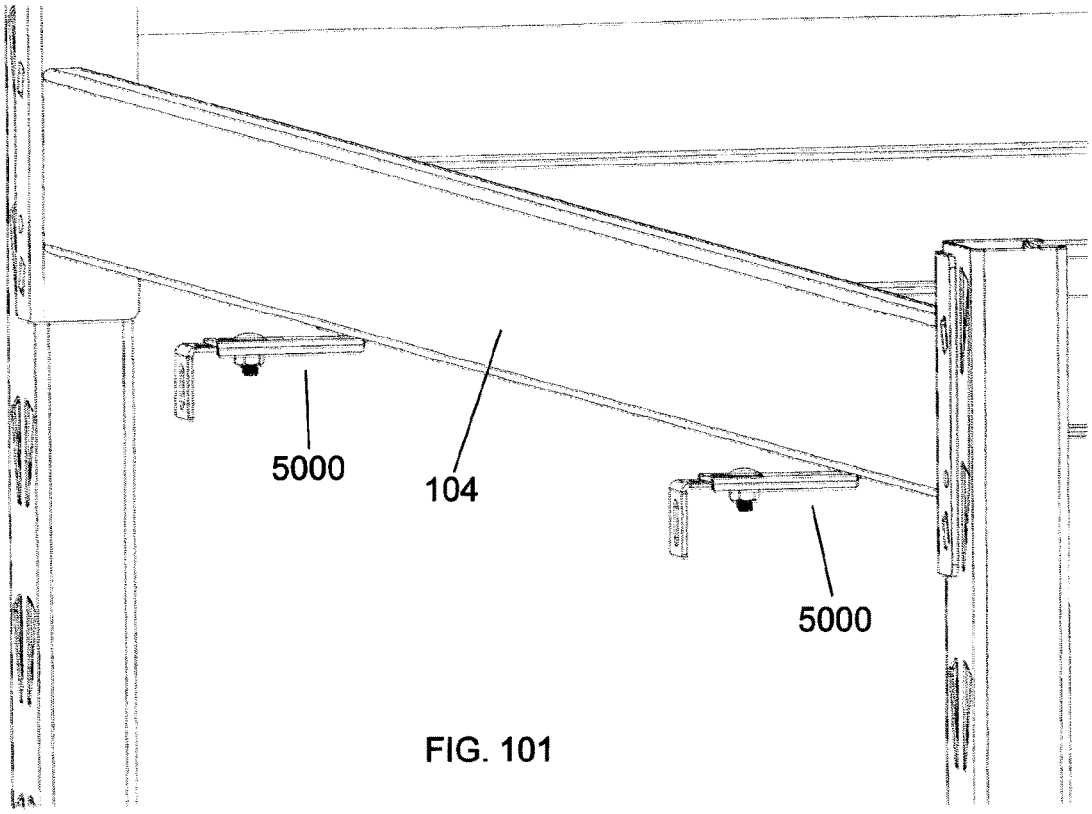
FIG. 101 is another partial perspective view showing a shelving system with the wall tie of FIG. 97.

Referring to FIGS. 97 to 101, one or more wall ties 5000 to secure the shelving system to a wall 600 are provided. The wall tie 5000 comprises a hook portion 5002 and an anchor portion 5004. Referring to FIGS. 100 and 101, the hook portion 5002 is preferably attached to one of the support beams 104, while the anchor portion 5004 is secured to the wall 600. Preferably, the hook portion 5002 hooks over the lower horizontal face 116, thereby preventing the shelving system 10 from toppling forward. The anchor portion 5004 comprises an anchor opening 5006 to allow for a wall fastener 5008 to be used to secure the wall tie 5000 to the wall 600.

Figure 98:
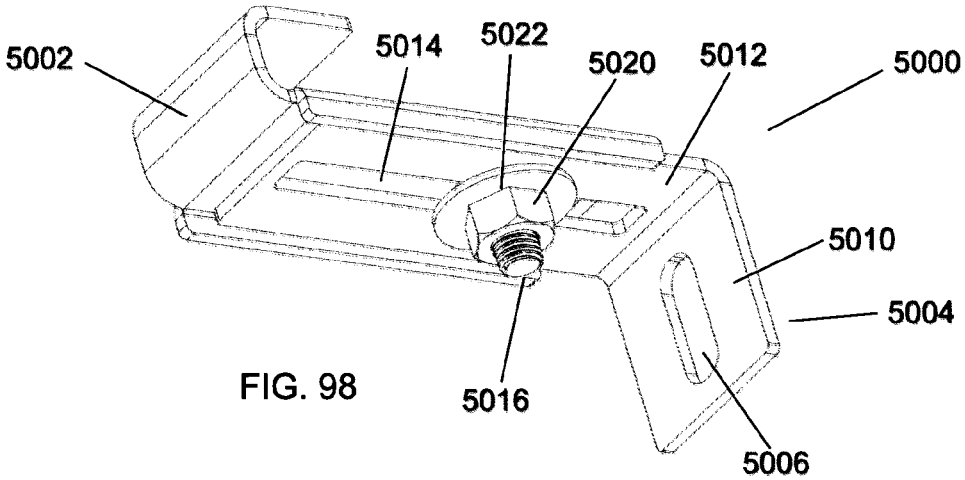
FIG. 98 is another perspective view of the wall tie of FIG. 97.
Figure 99:
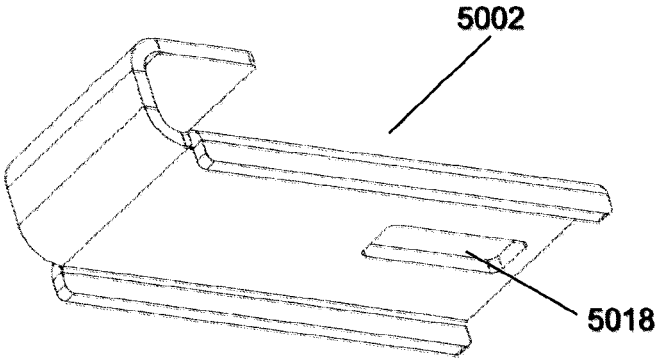
FIG. 99 is a perspective view showing the hook portion of the wall tie.

Referring to FIG. 98, the anchor portion 5004 comprises first and second anchor members 5010, 5012. The anchor opening 5006 is located on the first anchor member 5010, while the second anchor member 5012 comprises an adjustment slot 5014. The adjustment slot 5014 is preferably elongated and is preferably sized to accommodate a bolt 5016.

The hook portion 5002 comprises a nut opening 5018 also preferably sized to accommodate the bolt 5016. The hook portion 5002 may slide along the second anchor member 5012 in order to adjust the relative distance between the hook portion 5002 and the first anchor member 5010. When the desired distance is attained, a nut 5020 may be threaded onto to the bolt 5016 and tightened to fix the position of the hook portion 5002 relative to the anchor portion 5004. A washer 5022 may also be provided to facilitate the contact of the nut 5020 with the second anchor member 5012.

Figure 102:
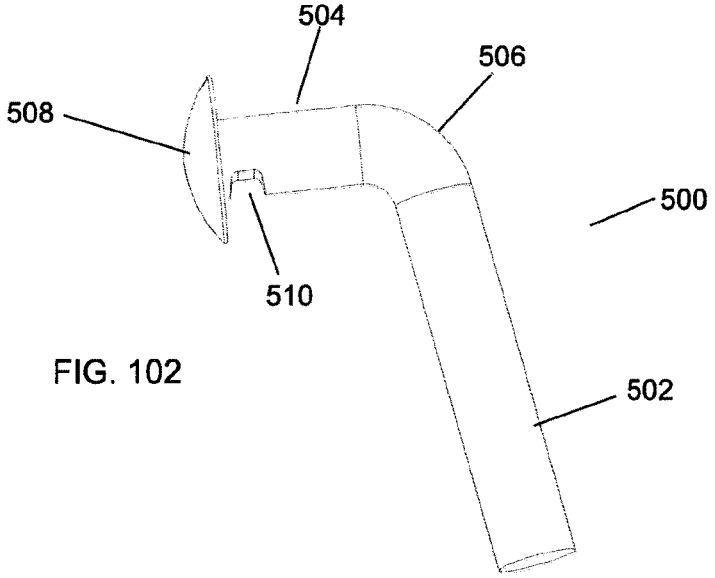
FIG. 102 is a perspective view showing an accessory pin.
Figure 103:
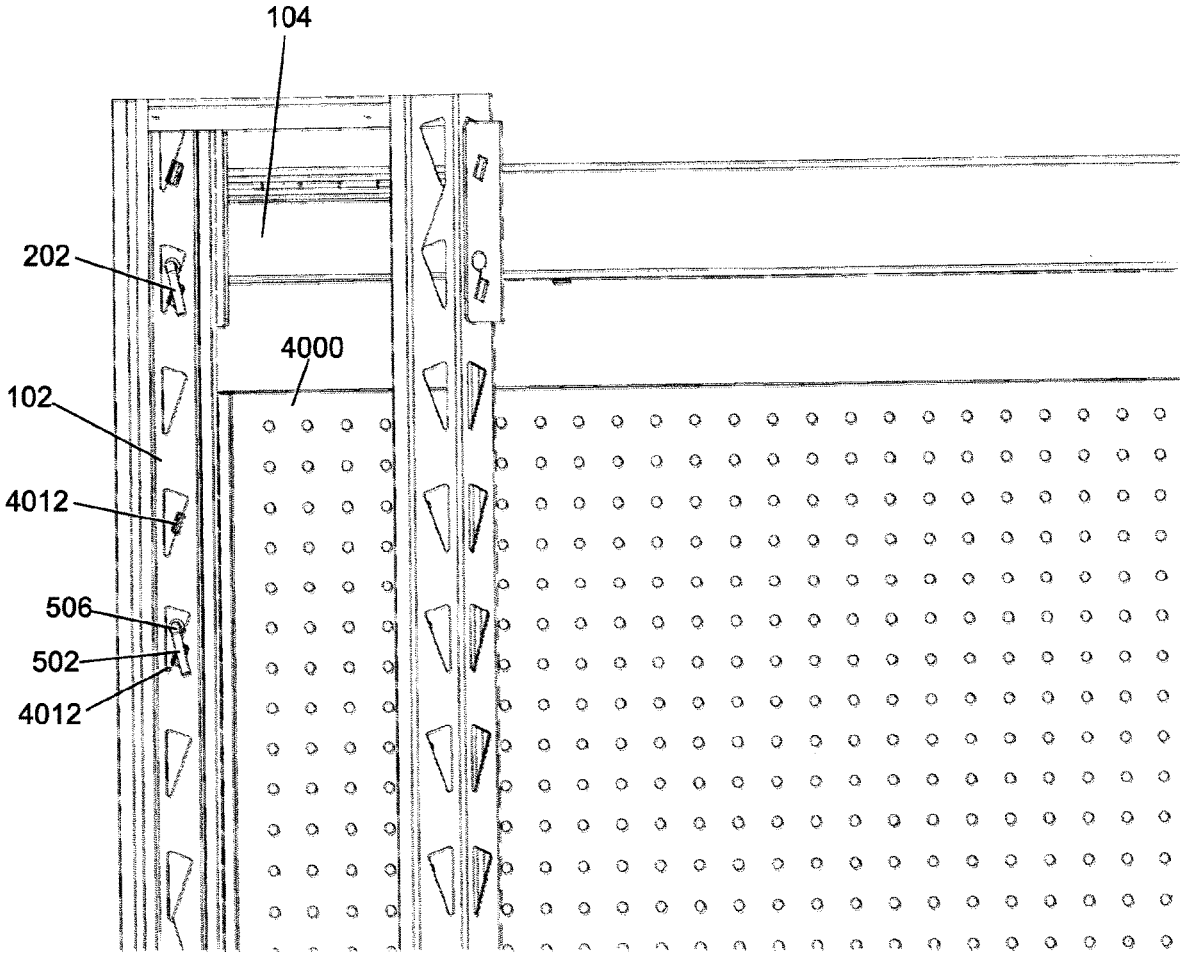
FIG. 103 is a partial perspective view showing a shelving system with a pegboard assembly and the accessory pin of FIG. 102.

Referring to FIGS. 102 and 103, there is provided the accessory pin 500, which is adapted to be inserted into one of the rack pin openings 1030, hinge plate openings 2022, plate openings 3020, or bracket openings 4016. The accessory pin 500 comprises first and second accessory pin ends 502, 504 and has a generally bent tubular shape caused by a bend 506, with a cap 508 preferably formed on the second accessory pin end 504.

For example, for shelving rack 1000, when the first accessory pin end 502 is inserted into the rack pin opening 1030, the accessory pin 500 passes through the attachment flange 1010 and into one of the slots 188 on the corner columns 100, 101, 102, 103. Because of the bend 506, the accessory pin 500 cannot be inserted straight through the rack pin opening 1030. Instead, the accessory pin 500 must be maneuvered through the rack pin opening 1030 by guiding it along the curvature of the accessory pin 500. The cap 508 preferably has a diameter that is greater than the diameter of the rack pin opening 1030. Therefore, once movement of the accessory pin 500 reaches the second pin end 504, the cap 508 will prevent the accessory pin 500 from passing through any further. Once the accessory pin 500 has been fully inserted, the bend 506 prevents the accessory pin 500 from easily falling out, thus providing a degree of security for the attachment of the shelving rack 1000 to the corner columns 100, 101, 102, 103.

Preferably, the accessory pin 500 further comprises a pin notch 510 formed on the accessory pin 500 proximate to the cap 508. The pin notch 510 allows the cap 508 to sit substantially flush against the attachment flange 1010 when the accessory pin 500 has been inserted fully through the rack pin opening 1030. The pin notch 510 prevents the accessory pin 500 from sliding about.

Similarly, for door assembly 2000, when the first accessory pin end 502 is inserted into the hinge plate opening 2022, the accessory pin 500 passes through the attachment flange 2008 and into one of the slots 188 on the corner columns 100, 101, 102, 103. Because of the bend 506, the accessory pin 500 cannot be inserted straight through the hinge plate opening 2022 but instead must be maneuvered through the hinge plate opening 2022 by guiding it along the curvature of the accessory pin 500. The cap 508 preferably has a diameter that is greater than the diameter of the hinge plate opening 2022. Once the accessory pin 500 has been fully inserted, the bend 506 prevents the accessory pin 500 from easily falling out, thus providing a degree of security for the attachment of the door assembly 2000 to the corner columns 100, 101, 102, 103.

For hook plate 3000, when the first accessory pin end 502 is inserted into the plate opening 3020, the accessory pin 500 passes through the plate attachment member 3006 and into one of the slots 188 on the corner columns 100, 101, 102, 103. Because of the bend 506, the accessory pin 500 cannot be inserted straight through the plate opening 3020 but instead must be maneuvered through the plate opening 3020 by guiding it along the curvature of the accessory pin 500. The cap 508 preferably has a diameter that is greater than the diameter of the plate opening 3020. Once the accessory pin 500 has been fully inserted, the bend 506 prevents the accessory pin 500 from easily falling out, thus providing a degree of security for the attachment of the hook plate 3000 to the corner columns 100, 101, 102, 103.

Referring to FIG. 103, for pegboard assembly 4000, when the first accessory pin end 502 is inserted into the bracket opening 4016, the accessory pin 500 passes through the first bracket member 4008 and into one of the slots 188 on the corner columns 100, 101, 102, 103. Because of the bend 506, the accessory pin 500 cannot be inserted straight through the bracket opening 4016 but instead must be maneuvered through the bracket opening 4016 by guiding it along the curvature of the accessory pin 500. The cap 508 preferably has a diameter that is greater than the diameter of the bracket opening 4016. Once the accessory pin 500 has been fully inserted, the bend 506 prevents the accessory pin 500 from easily falling out, thus providing a degree of security for the attachment of the pegboard assembly 4000 to the corner columns 100, 101, 102, 103.

The beam pin 202 may act in a similar manner to the accessory pin 500. Referring to FIG. 103, the beam pin 202 is shown securing the support beam 104 to the corner column 102.

It will be appreciated by those skilled in the art that the preferred embodiments have been described in some detail but that certain modifications may be practiced without departing from the principles of the invention.

What is claimed:

1. A shelving system comprising:

four corner columns comprising a plurality of slots arranged substantially vertically;

a plurality of substantially horizontal support beams, each of the support beams extending between two of the four corner columns, wherein each support beam is paired with a corresponding second support beam to form pairs of support beams and wherein each support beam comprises:

an outer face;

an upper horizontal face extending from the outer face;

an inward face extending from the upper horizontal face;

a shelf support ledge extending from the inward face, the shelf support ledge comprising one or more slot openings; and a lower horizontal face extending from the outer face, the lower horizontal face comprising one or more beam openings;

a plurality of beam braces, each of the beam braces extending between the support beams of one of the pairs of support beams and comprising:

a first end portion comprising:

a substantially planar first face; and tabs extending from opposing ends of the first face, the tabs sized to fit into the slot openings;

a second end portion comprising a substantially planar second face with brace openings proximate to opposing ends of the second face, the brace openings aligning with the beam openings; and a middle portion between the first end portion and the second end portion comprising first and second edges, wherein the first end portion and the second end portion extend away from the first and second edges, respectively, in opposite directions.

2. The shelving system of claim 1, wherein the middle portion comprises:

a vertical segment;

upper and lower inclined segments extending angularly from the vertical segment;

an upper portion extending from the upper inclined segment;

a lower portion extending from the lower inclined segment; and notches on opposing ends of the middle portion, the notches extending at least a portion through the upper portion and the upper inclined segment.

3. The shelving system of claim 1, wherein the middle portion comprises an inclined surface, the inclined surface having an angle away from a vertical plane.

4. The shelving system of claim 3, wherein the angle is such that the first face and the second face are substantially aligned with one another.

5. The shelving system of claim 1, further comprising one or more fasteners, wherein the beam openings and the brace openings are adapted to engage with the fasteners to secure the beam braces to the support beams.

6. The shelving system of claim 1, further comprising a pin extending through at least one beam opening on each of the support beams, the pin also extending through a corresponding one of the brace openings on one of the beam braces to allow for pivotable movement of the beam brace with respect to the support beam.

7. The shelving system of claim 6, wherein the pin comprises opposed ends, and wherein a diameter of the opposed ends is greater than a diameter of the brace openings or the beam openings.

8. A shelving system comprising:

four corner columns, wherein each of the corner columns comprises a plurality of slots arranged substantially vertically;

a plurality of substantially horizontal support beams, each of the support beams extending between two of the four corner columns, wherein each support beam is paired with a corresponding second support beam to form pairs of support beams and wherein each support beam comprises:

an outer face;

an upper horizontal face extending from the outer face;

an inward face extending from the upper horizontal face;

a shelf support ledge extending from the inward face; and a lower horizontal face extending from the outer face; and a plurality of beam braces, each of the beam braces extending between the support beams of one of the pairs of support beams and comprising:

a first end portion comprising a substantially planar first face;

a second end portion comprising a substantially planar second face; and a middle portion between the first end portion and the second end portion comprising first and second edges, wherein the first face and the second face extend away from the first and second edges, respectively, in opposite directions;

wherein each of the beam braces is pivotably connected with one of the support beams.

9. The shelving system of claim 8, further comprising a plurality of fasteners, wherein the fasteners pivotably connect the upper horizontal face with the first end portion and the lower horizontal face with the second end portion.

10. The shelving system of claim 8, wherein the shelf support ledge comprises one or more slot openings, wherein the first end portion comprises a tab extending from one end of the first face, and wherein the tab is sized to fit into the slot openings.

11. The shelving system of claim 8, wherein the lower horizontal face comprises one or more beam openings, wherein the second end portion comprises a knob extending from the second face, and wherein the knob is sized to engage with the beam openings.

12. A shelving system according to claim 1, further comprising one or more shelving racks attached to two of the corner columns, wherein each of the shelving racks comprises:

a rack surface; and two brackets, wherein each of the brackets comprises:

a support member adapted to support the rack surface;

an attachment flange comprising one or more rack tabs adapted to engage with the slots on one of the corner columns; and an upright member extending from the attachment flange, wherein the attachment flange and the upright member are adapted to rest against the corner column.

13. A shelving system according to claim 1, further comprising one or more door assemblies attached to two of the corner columns, wherein each of the door assemblies comprises:

a door panel; and one or more hinge plates pivotably connected to the door panel, wherein each of the hinge plates comprises:

a first hinge member comprising one or more hinge tabs adapted to engage with the slots on one of the corner columns; and a second hinge member extending from the first hinge member, wherein the first and second hinge members are adapted to rest against the corner column.

14. A shelving system according to claim 1, further comprising one or more hook plates attached to two of the corner columns, wherein each of the hook plates comprises:

first and second plate ends, wherein each of the first and second plate ends comprises:

a plate attachment member comprising one or more plate tabs adapted to engage with the slots on one of the corner columns; and a plate support member extending from the plate attachment member, wherein the plate attachment member and the plate support member are adapted to rest against the corner column; and a central plate comprising one or more central plate slots and extending between the first and second plate ends.

15. A shelving system according to claim 1, further comprising one or more pegboard assemblies attached to one or more of the corner columns, wherein each of the pegboard assemblies comprises:

a pegboard; and one or more pegboard brackets attached to the pegboard, wherein each of the pegboard brackets comprises:

a first bracket member comprising one or more bracket tabs adapted to engage with the slots on one of the corner columns; and a second bracket member extending from the first bracket member, wherein the first and second bracket members are adapted to rest against the corner column.

16. A shelving system according to claim 1, further comprising one or more wall ties for attaching the shelving system to a wall, wherein the wall tie comprises:

a hook portion adapted to engage with one of the support beams; and an anchor portion attached to the wall, wherein the anchor portion is removably attached to the hook portion.

* * * * *